US006615008B2

(12) United States Patent
Higeta et al.

(10) Patent No.: US 6,615,008 B2
(45) Date of Patent: Sep. 2, 2003

(54) REMANUFACTURING METHOD FOR PROCESS CARTRIDGE

(75) Inventors: Akira Higeta, Funabashi (JP); Satoshi Yasuda, Tokyo (JP); Yoshiyuki Kakumi, Tuchiura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/887,341

(22) Filed: Jun. 25, 2001

(65) Prior Publication Data

US 2002/0034398 A1 Mar. 21, 2002

(30) Foreign Application Priority Data

Jun. 28, 2000 (JP) ..... 2000-194611

(51) Int. Cl.[7] ..... G03G 15/00
(52) U.S. Cl. ..... 399/109; 399/11
(58) Field of Search ..... 399/102, 103, 399/105, 109, 110, 111, 113

(56) References Cited

U.S. PATENT DOCUMENTS

| | | | | |
|---|---|---|---|---|
| 4,851,960 A | | 7/1989 | Nakamura et al. | 361/225 |
| 5,331,373 A | | 7/1994 | Nomura et al. | 399/111 |
| 5,452,056 A | | 9/1995 | Nomura et al. | 399/111 |
| 5,485,249 A | | 1/1996 | Higeta et al. | 399/105 |
| 5,585,889 A | | 12/1996 | Shishido et al. | 399/113 |
| 5,740,499 A | | 4/1998 | Higeta et al. | 399/105 |
| 5,809,374 A | | 9/1998 | Tsuda et al. | 399/111 |
| 5,870,654 A | * | 2/1999 | Sato et al. | 399/109 |
| 5,966,566 A | * | 10/1999 | Odagawa et al. | 399/109 |
| 6,021,291 A | * | 2/2000 | Karakama et al. | 399/104 |
| 6,101,348 A | | 8/2000 | Nonaka et al. | 399/103 |
| 6,185,390 B1 | | 2/2001 | Higeta et al. | 399/90 |
| 6,473,577 B1 | * | 10/2002 | Higeta et al. | 399/109 |

FOREIGN PATENT DOCUMENTS

JP 63-149669 6/1988

* cited by examiner

*Primary Examiner*—Hoan Tran
(74) *Attorney, Agent, or Firm*—Fitzpatrick, Cella, Harper & Scinto

(57) ABSTRACT

A remanufacturing method for a process cartridge detachably mountable to a main assembly of an electrophotographic image forming apparatus, including (a) a frame separating step of separating the first frame and the second frame from each other; (b) a developing blade dismounting step of dismounting, from the second frame, a developing blade; (c) a sealing material mounting step of mounting a sealing material between the second frame and the developing blade; (d) a developer filling step of filling the developer into a developer accommodating portion of the second frame through a developer supply opening for supplying, to a developing roller, the developer accommodated in the developer accommodating portion; (e) a developing blade mounting step of mounting the developing blade to the second frame; and (f) a frame coupling step of the coupling the first frame and the second frame.

23 Claims, 41 Drawing Sheets

REMANUFACTURING METHOD FOR PROCESS CARTRIDGE

FIELD OF THE INVENTION AND RELATED ART

The present invention relates to a method for remanufacturing a process cartridge. A process cartridge is a cartridge in which a charging means, a developing means or a cleaning means, and an electrophotographic photosensitive member, are integrally disposed, and which is removably mountable in the main assembly of an image forming apparatus, a cartridge in which at least one means among a charging means, a developing means, and a cleaning means, and an image bearing means, are integrally disposed, and which is removably mountable in the main assembly of an image forming apparatus, or a cartridge in which at least a developing means, and an electrophotographic photosensitive member, are integrally disposed, and which is removably mountable in the main assembly of an image forming apparatus.

An image forming apparatus includes, for example, an electrophotographic copying machine, an electrophotographic printer (for example, an LED printer or a laser beam printer), an electrophotographic facsimile machine, an electrophotographic word processor, and the like.

Conventionally, an image forming apparatus which employs an electrophotographic image forming process also employs a process cartridge system, in which an electrophotographic photosensitive member, and processing means which act on the electrophotographic photosensitive member, are integrally disposed in a cartridge which is removably mountable in the main assembly of the image forming apparatus. This process cartridge system makes it possible for a user to maintain an image forming apparatus without relying on service personnel, drastically improving operational efficiency. Thus, the process cartridge system is widely in use in the field of an image forming apparatus.

A process cartridge forms an image on recording medium with the use of developer. Therefore, developer is consumed as image formation is carried out. Thus, as the developer within a process cartridge is consumed to a point at which it becomes impossible to form an image which is satisfactory in quality to the user who purchased the process cartridge, the process cartridge loses its commercial value.

There has been heavy demand for a method for reviving the commercial value of a process cartridge which has lost its commercial value due to the consumption of the developer therein. Hence, there has been heavy demand for a simple method for remanufacturing a process cartridge.

SUMMARY OF THE INVENTION

The primary object of the present invention is to provide a simple method for remanufacturing a process cartridge.

Another object of the present invention is to provide a process cartridge, which can be revived in commercial value after its commercial value is lost due the consumption of the developer therein to a point at which it fails to form an image which is satisfactory in quality to a user, and a method for remanufacturing such a process cartridge.

According to an aspect of the present invention, there is provided a remanufacturing method for a process cartridge detachably mountable to a main assembly of an electrophotographic image forming apparatus, the process cartridge including a first frame for supporting an electrophotographic photosensitive drum, a second frame supporting a developing roller for developing an electrostatic latent image formed on the electrophotographic photosensitive drum and accommodating a developer to be used for development of the electrostatic latent image by the developing roller, the first frame and the second frame being rotatably coupled with each other, the method comprising:

(a) a frame separating step of separating the first frame and the second frame from each other;

(b) a developing blade dismounting step of dismounting, from the second frame, a developing blade mounted to the second frame to regulate an amount of the developer deposited on the developing roller;

(c) a sealing material mounting step of mounting a sealing material between the second frame and the developing blade;

(d) a developer filling step of filling the developer into the developer accommodating portion through a developer supply opening for supplying, to the developing roller, the developer accommodated in the developer accommodating portion;

(e) a developing blade mounting step of mounting the developing blade to the second frame; and (f) a frame coupling step of coupling the first frame and the second frame. According to another aspect of the present invention, there is provided a remanufacturing method for a process cartridge detachably mountable to a main assembly of an electrophotographic image forming apparatus, the process cartridge including a first frame for supporting an electrophotographic photosensitive drum, a second frame supporting a developing roller for developing an electrostatic latent image formed on the electrophotographic photosensitive drum and accommodating a developer to be used for development of the electrostatic latent image by the developing roller, the first frame and the second frame being rotatably coupled with each other, said method comprising:

(a) a frame separating step of separating the first frame and the second frame from each other;

(b) a developing blade dismounting step of dismounting, from the second frame, a developing blade mounted to the second frame to regulate an amount of the developer deposited on the developing roller;

(c) a sealing material mounting step of mounting a sealing material between the second frame and the developing blade;

(d) a developing blade mounting step of mounting the developing blade to the second frame; and (e) a developer filling step of filling the developer into the developer accommodating portion through a developer filling port provided in the developer accommodating portion; and (f) a frame coupling step of coupling the first frame and the second frame.

According to a further aspect of the present invention, there is provided a remanufacturing method for a process cartridge detachably mountable to a main assembly of an electrophotographic image forming apparatus, the process cartridge including an electrophotographic photosensitive drum, a first frame for supporting a cleaning blade for removing a developer remaining on the electrophotographic photosensitive drum, and a second frame supporting a developing roller for developing an electrostatic latent image formed on the electrophotographic photosensitive drum and having a developer accommodating portion accommodating a developer to be used for development of the electrostatic latent image by the developing roller, comprising:

(a) a frame separating step of separating the first frame and the second frame from each other;

(b) a drum exchanging step of exchanging the electrophotographic photosensitive drum mounted to the first frame with a new electrophotographic photosensitive drum;

(c) a developing roller dismounting step of dismounting a developing roller mounted to the second frame;

(d) a developing blade dismounting step of dismounting, from the second frame, a developing blade mounted to the second frame to regulate an amount of the developer deposited on the developing roller;

(e) a sealing material mounting step of mounting a sealing material between the second frame and the developing blade;

(f) a developer filling step of filling the developer into the developer accommodating portion through a developer supply opening for supplying, to the developing roller, the developer accommodated in the developer accommodating portion;

(g) a developing blade mounting step of mounting the developing blade to the second frame; and (h) a developing roller mounting step of mounting a developing roller to the second frame; and (i) a frame coupling step of coupling the first and second frames.

There is also provided a process cartridge which has been remanufactured in accordance with the remanufacturing method of the presend invention.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Next, the preferred embodiments of the present invention will be described. In the following descriptions of the preferred embodiments of the present invention, the short dimension direction, or width direction, of a process cartridge B is the direction parallel to the direction in which the process cartridge B is mounted into or dismounted from the image forming apparatus main assembly 15, and coincides with the direction in which recording medium is conveyed. The long dimension direction, or length direction, of the process cartridge B is the direction perpendicular (approximately perpendicular) to the direction in which the process cartridge B is mounted into or dismounted from the apparatus main assembly 15, and which is parallel to the surface of the recording medium and perpendicular (approximately perpendicular) to the direction in which the recording medium is conveyed. The left and right directions with respect to the process cartridge B are the left and right directions when the process cartridge B is seen from behind in terms of the direction in which the recording medium is conveyed.

{Descriptions of Process Cartridge and Entirety of Image Forming Apparatus Which Contains process Cartridge}

Figure 1:
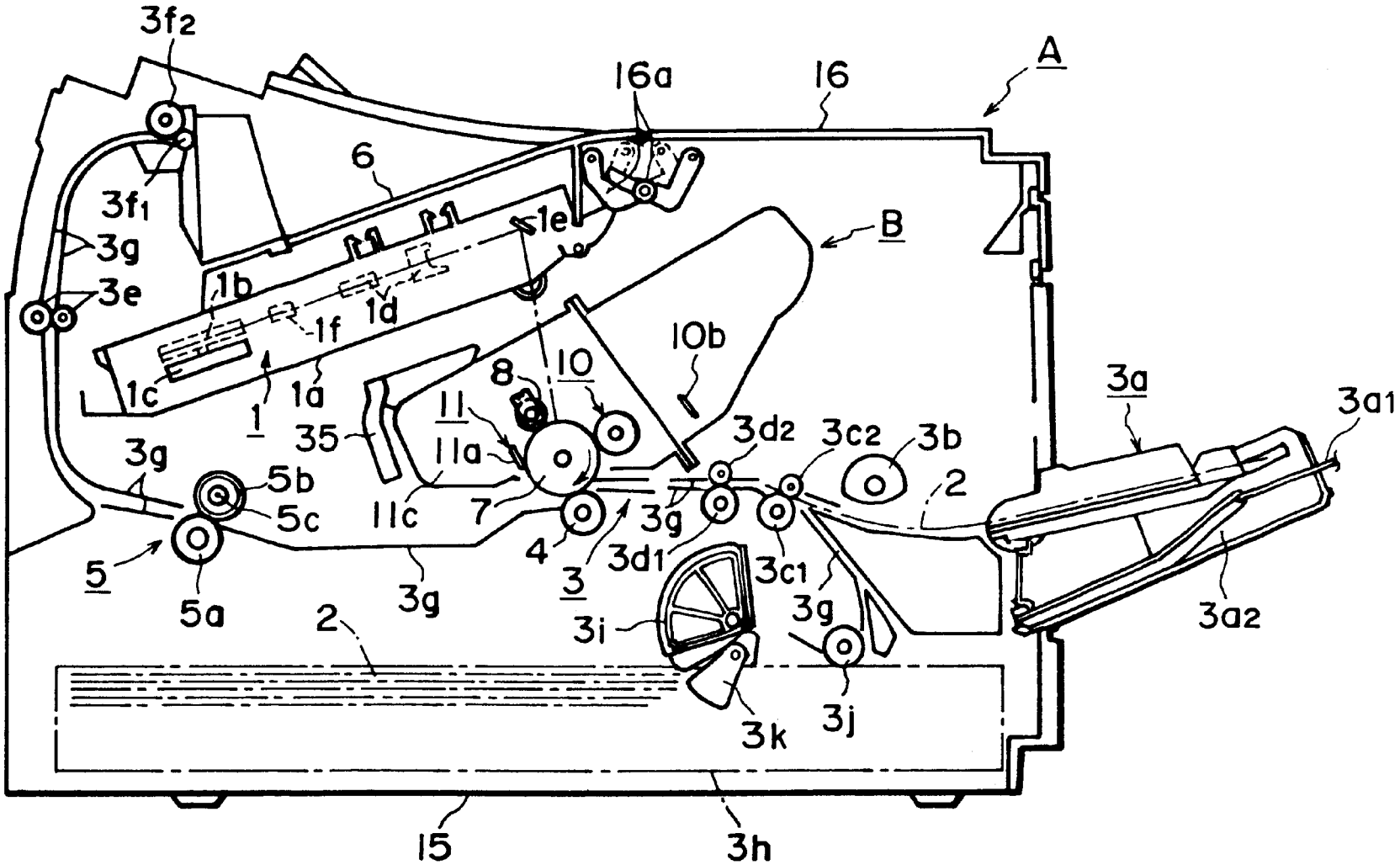
FIG. 1 is a vertical sectional view of the entirety of an image forming apparatus in which a process cartridge has been properly mounted.
Figure 2:
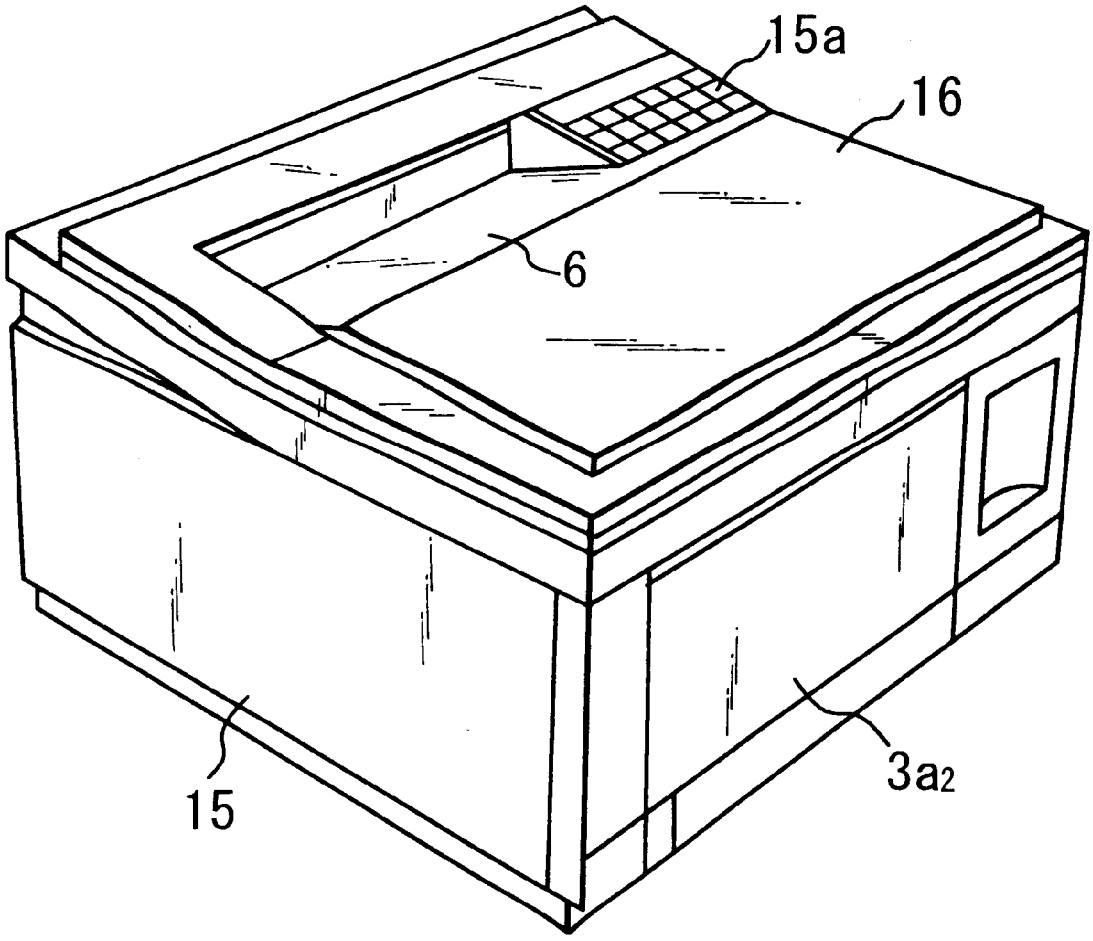
FIG. 2 is an external perspective view of the image forming apparatus.
Figure 3:
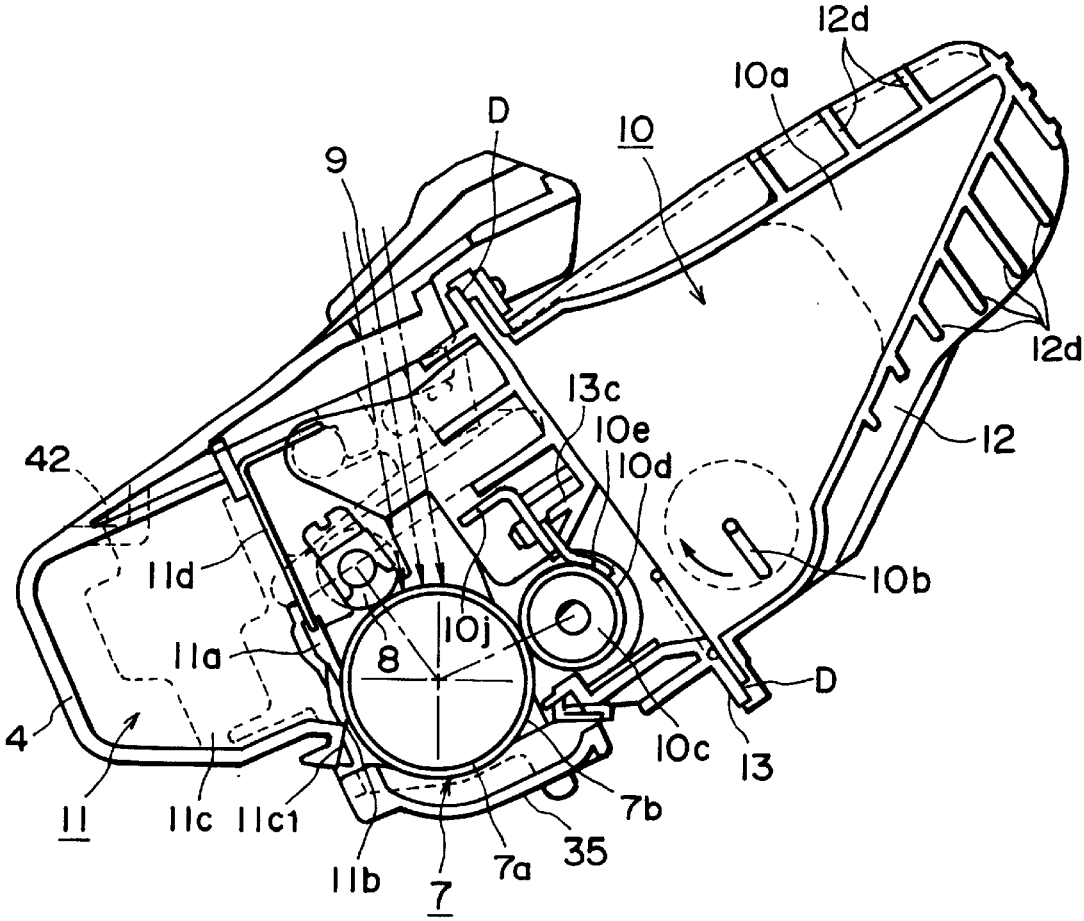
FIG. 3 is a vertical sectional view of the process cartridge.
Figure 4:
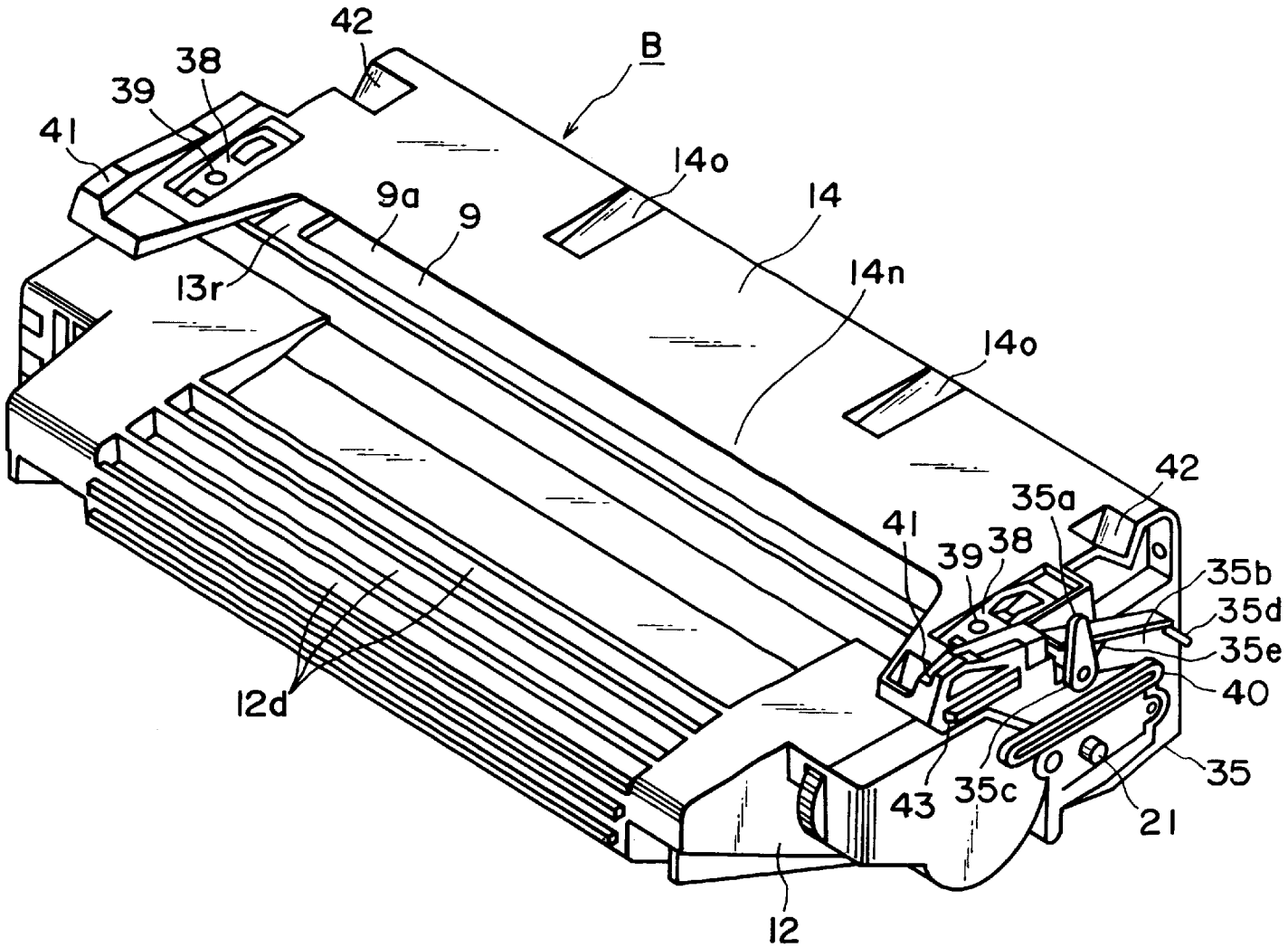
FIG. 4 is an external perspective view of the process cartridge.

First, the overall structure of a typical image forming apparatus will be roughly described. FIG. 1 is a sectional view of a laser printer, that is, a typical image forming apparatus, in which a process cartridge has been mounted, and FIG. 2 is an external perspective view of the image forming apparatus. FIG. 3 is a sectional view of the process cartridge, and FIG. 4 is an external view of the process cartridge. Referring to FIG. 1, in this image forming apparatus A, a latent image is formed on a photosensitive drum as an image bearing member by projecting, from an optical system, an optical image in accordance with image formation information, on the photosensitive drum, and a toner image is formed by developing the latent image with the use of developer (which hereinafter may be referred to as toner). In synchronism with the formation of the toner image, a recording medium 2 is conveyed by a conveying means 3, and the toner image having been formed on the photosensitive drum in the image forming portion in the process cartridge B, is transferred onto the recording medium 2. Then, the recording medium 2 is conveyed to a fixing means 5, in which the transferred toner image is fixed to the recording medium 2. Then, the recording medium 2 is discharged into a delivery tray 6.

Referring to FIG. 4, in the process cartridge B which comprises the aforementioned image forming portion, a photosensitive drum 7 as an image forming apparatus is rotated, and as the photosensitive drum 7 is rotated, the peripheral surface of the photosensitive drum 7 is uniformly charged by a charging means 8. The charged peripheral surface of the photosensitive drum 7 is exposed to an optical image projected from the aforementioned optical system 1 through an exposing portion 9. As a result, a latent image is formed. The latent image is developed by a developing means 10 into a toner image, or a visible image, which reflects the latent image. Then, the toner image is transferred onto the recording medium 2 by a transferring means 4. Thereafter, the toner remaining on the photosensitive drum 7, or the residual toner, is removed by a cleaning means 11. The process cartridge B comprises: a toner holding frame 12, or a first frame, which has a toner bin and the like; a developing means holding frame 13, or a second frame which has a development roller and the like; and a cleaning means holding frame 14, or a third frame, which has the photosensitive drum 7, cleaning means 11, and the like. In FIG. 2, a referential code 15*a* designates a control panel, which has a copy count setting button, an image density setting button, a test print button, a cartridge replacement warning lamp, and the like. The cartridge replacement warning lamp will be described later.

Next, the various portions of the image forming apparatus A, and the various portions of the process cartridge B which is mounted in the apparatus A, will be described in detail.

{Image Forming Apparatus}

First, the structures of the various portions of the image forming apparatus A will be described in the order of the optical system, conveying means, transferring means, fixing means, and a cartridge mounting means.

(Optical System)

The optical system 1 is a system which projects onto the photosensitive drum 7, an optical image in accordance with the image formation information read into the system through an external apparatus or the like. Referring to FIG. 1, within the optical unit 1*a* of the apparatus main assembly 15, a polygon mirror 1*b*, a scanner motor 1*c*, a focusing lens 1*d*, a reflection mirror 1*e*, and a laser diode 1*f* are disposed. As image signals are given from an external device, for example, a computer or a word processor, the laser diode 1*f* emits light in response to the image signals, and the emitted light is projected as image light onto the polygon mirror 1*b*, which is being rotated at a high speed by the scanner motor 1*c*. The image light reflected by the polygon mirror 1*b* is projected upon the photosensitive drum 7 through the focusing lens 1*d* and reflection mirror 1*e*, selectively exposing the peripheral surface of the photosensitive drum 7. As a result, a latent image in accordance with the image formation information is formed on the peripheral surface of the photosensitive drum 7.

(Recording Medium Conveying Means)

Next, the structure of the conveying means 3 for conveying the recording medium 2 (for example, a recording paper, an OHP sheet, a fabric, a thin plate, and the like) will be described. In this embodiment, the recording medium 2 can be fed into the apparatus 15 in two different ways: manually, or automatically through a cassette. When manually feeding the recording medium 2, a single recording medium 2 or a plurality of recording media 2 are placed in a feeder tray 3*a*. Then, as an image forming operation is started, with the recording medium 2 set in the feeder tray 3*a* as shown in FIG. 1, the recording medium 2 in the feeder tray 3*a* is sent into the apparatus main assembly 15; when a plurality of recording media 2 are placed in the feeder tray 3*a*, they are fed into the apparatus main assembly 15 while being separated by a pair of separation rollers 3*c*1 and 3*c*2. After being fed into the apparatus main assembly 15, the recording medium 2 is conveyed to a pair of registration rollers 3*d*1 and 3*d*2 in a manner to bump into the pair. The pair of registration rollers 3*d*1 and 3*d*2 are rotationally driven in synchronism with the image forming operation, releasing the recording medium 2 to be conveyed to the image forming portion. After the formation of an image on the recording medium 2, the recording medium 2 is conveyed to the fixing means 5. Thereafter, the recording medium 2 is discharged into a delivery tray 6 by an intermediary discharge roller pair 3*e* and a pair of discharge rollers 3*f*1 and 3*f*2. There is a pair of guiding members 3*g* for guiding the recording medium 2, between the discharge roller pair 3*e* and the pair of discharge rollers 3*f*1 and 3*f*2. The feeder tray 3*a* comprises an internal member 3*a*1 and an external member 3*a*2. When the feeder tray 3*a* is not in use, the internal member 3*a*1 is stored in the external member 3*a*2. The external member 3*a*2 projects from the apparatus main assembly 15, constituting a part of the exterior of the apparatus main assembly 15.

As for the structure for feeding the recording medium 2 with the use of the aforementioned cassette, referring to FIG. 1, the apparatus main assembly 15 is provided with a cassette 3*h* mounting portion, which is located at the bottom of the apparatus main assembly 15. When the recording medium 2 is not manually fed, the recording media 2 in the cassette 3*h* in the aforementioned recording medium cassette mounting portion are fed into the apparatus main assembly 15 by a pickup roller 3*i* and a pair of feed rollers 8*j*, while being separated one by one from the top, and are sent to the pair of registration rollers 3*d*1 and 3*d*2. After the pair of registration rollers 3*d*1 and 3*d*2, the recording medium 2 is conveyed further in the same manner as when it is manually fed. A referential code 3*k* designates a sensor for detecting the presence or absence of the recording medium 2 in the cassette 3*h*.

(Transferring Means)

The transferring means 4 is a means for transferring onto the recording medium 2, the toner image formed on the photosensitive drum 7 in the image forming portion. Referring to FIG. 1, the transferring means 4 in this embodiment comprises a transfer roller 4. More specifically, the apparatus main assembly 15 is structured so that the recording medium 2 is pressed upon the photosensitive drum 7 in the process cartridge B by the transfer roller 4. The toner image on the photosensitive drum 7 is transferred onto the recording medium 2 by applying to the transfer roller 4, such voltage (in this embodiment, a DC voltage of approximately 1,000 V is applied while carrying out constant current control) that is reverse in polarity to the toner image formed on the photosensitive drum 7.

(Fixing Means)

The fixing means 5 is a means for fixing the toner image to the recording medium 2 after the toner image is transferred to the recording medium 2 by applying voltage to the transfer roller 4. Referring to FIG. 1, the fixing means 5 has a driving roller 5*a*, which is rotationally driven, and a fixing roller 5*b*, which contains a heater 5*c*. The fixing roller 5*b* is kept pressed upon the driving roller 5*a*, and is rotated by the rotation of the driving roller 5*a*. As the recording medium 2 onto which the toner image has been transferred in the image forming portion is passed between the driving roller 5*a* and fixing roller 5*b*, pressure is applied to the recording medium 2 in a manner to pinch the recording medium 2 by the rollers 5*a* and 5*b*, while applying to the recording medium 2, the heat generated by the heater 5*c* in the fixing roller 5*b*. As a result, the toner image on the recording medium 2 is fixed to the recording medium 2.

(Cartridge Mounting Means)

Figure 5:
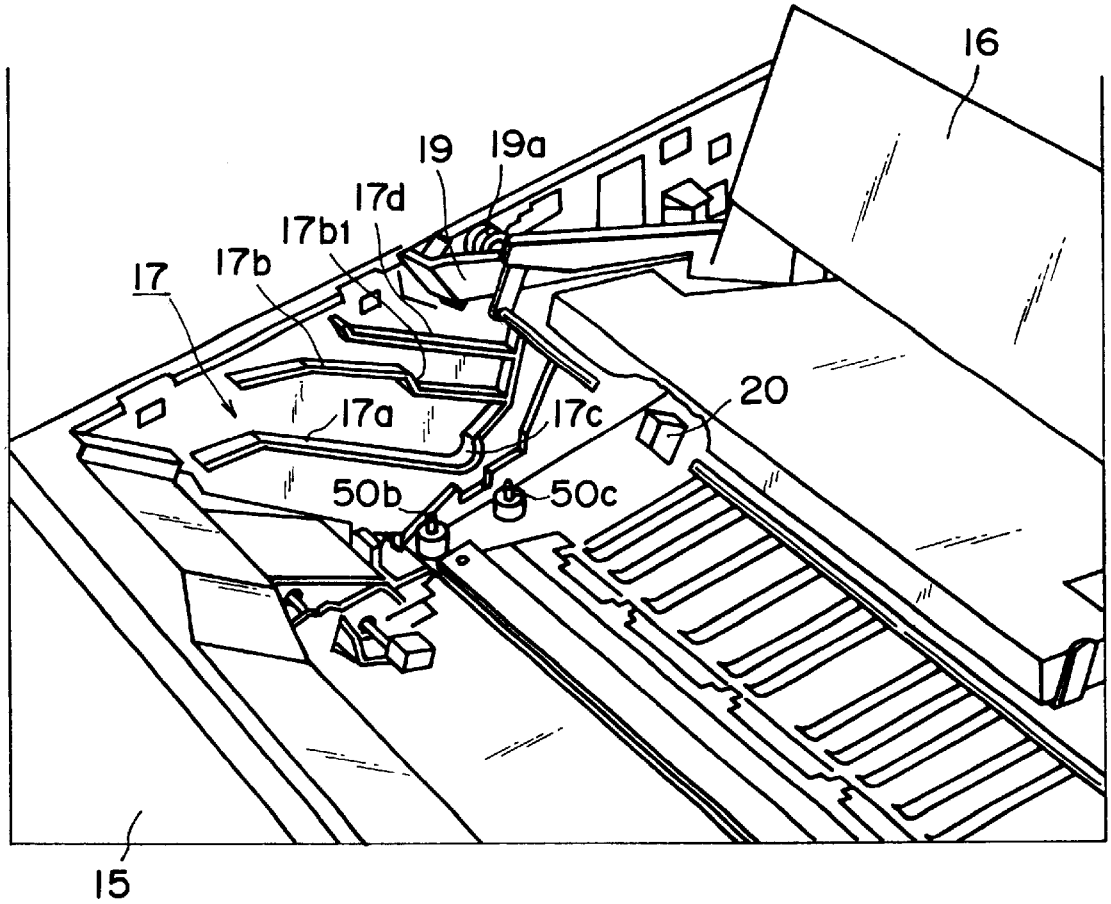
FIG. 5 is a perspective view of the guiding member on the left side.
Figure 6:
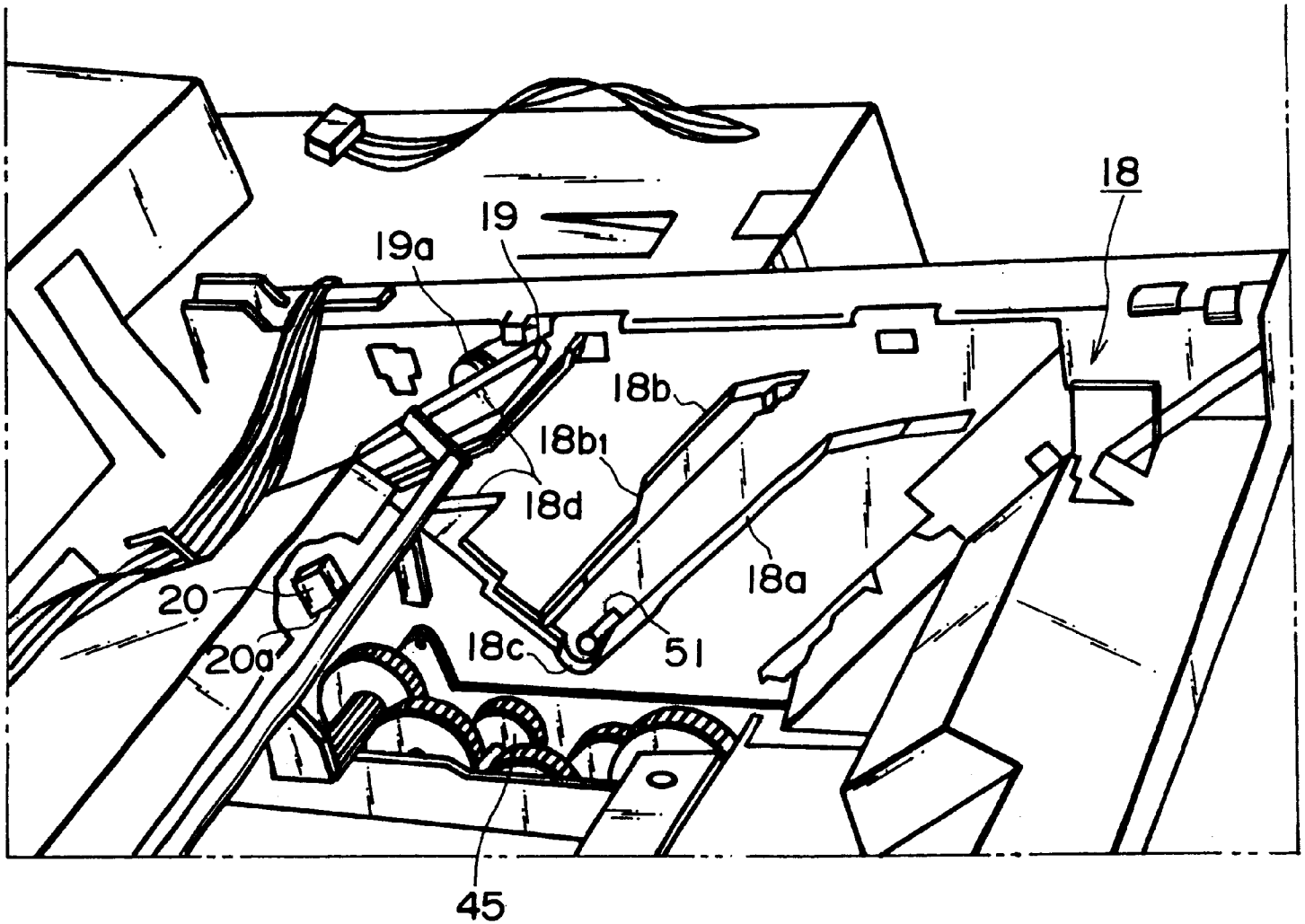
FIG. 6 is a perspective view of the guiding member on the right side.

The image forming apparatus A is provided with the process cartridge mounting portion, which is within the image forming apparatus A. The process cartridge B is mounted into or dismounted from the apparatus main assembly 15 by opening a cover 16. More specifically, the top portion of the apparatus main assembly 15 is provided with a cover 16, which is attached to the apparatus main assembly 15 with the use of hinges 16*a*. Referring to FIGS. 5 and 6, the apparatus main assembly 15 is also provided with a left guiding member 17 and a right guiding member 18, which are attached to the left and right inward surfaces of the side walls of the apparatus main assembly 15, respectively. The left and right guiding members 17 and 18 comprise first guiding portions 17*a* and 18*a*, and second guiding portions 17*b* and 18*b*, respectively, which are symmetrical in position with respect to each other, and are slanted downward in terms of the inward direction. The second guiding portions 17*b* and 18*b* are above the first guiding portions 17*a* and 18*b*, respectively. Further, the apparatus main assembly 15 is provided with bearing portions 17*c* and 18*c* for supporting the drum bearings of the process cartridge B, which are located at the deepest ends of the first guiding portions 17*a* and 18*b*, respectively. The bearing portions 17*c* and 18*c* will be described later. The second guiding portions 17*b* and 18*b* have stepped portions 17*b*1 and 18*b*1, respectively. The left guiding member 17 is provided with a cartridge rotation regulating guiding portion 17*d*, which is located above the second guiding portion 17*b*. The right guiding member 18 is provided with a shutter cam portion 18*d* for opening or closing a drum shutter 35 of the process cartridge B, which is located above the second guiding portion 18*b*. Located above the rotation regulating portion 17*b* and shutter cam portion 18*d* are a pair of pressuring members 19, one for one, which keep the mounted process cartridge B pressed downward with the pressure from coil springs 19*b*. Further, the apparatus main assembly 15 is provided with a pair of projections 20, as process cartridge positioning members, which are located approximately straight ahead of the front ends (in terms of the cartridge insertion direction) of the left and right guiding members 17 and 18, one for one.

After the opening of the cover 16, the process cartridge B is mounted while being guided by the first guiding portions 17*a* and 18*a* and second guiding portions 17*b* and 18*b* of the guiding members 17 and 18, respectively. This process of mounting the process cartridge B will be described in detail when the structure of the process cartridge B is described later.

(Process Cartridge)

Next, the structures of the various portions of the process cartridge B to be mounted into the image forming apparatus A will be described. This process cartridge B comprises an image bearing member, and a minimum of one processing means. As for processing means, there are, for example, a charging means for charging the peripheral surface of the image bearing member, a developing means for forming a toner image on the image bearing member, a cleaning means for removing the toner remaining on the peripheral surface of the image bearing member, and the like. Referring to FIG. 3, the process cartridge B in this embodiment comprises: the electrophotographic photosensitive drum 7 as an image bearing member, charging means 8, exposing portion 9, developing means 10 for developing a latent image with the use of toner, cleaning means 11, and the like, which are integrally covered and supported by a housing, or a combination of the toner holding frame 12, developing means holding frame 13, and cleaning means holding frame 14, so that they can be mounted into or dismounted from the apparatus main assembly 15. The charging means 8, exposing portion 9, developing means 10, and cleaning means 11 are disposed in a manner to surround the peripheral surface of the photosensitive drum 7.

Next, the structure of the various portions of the process cartridge B will be described in detail in the order of the photosensitive drum 7, charging means 8, exposing portion 9, developing means 10, and cleaning means 11.

(Photosensitive Drum)

Figure 7:
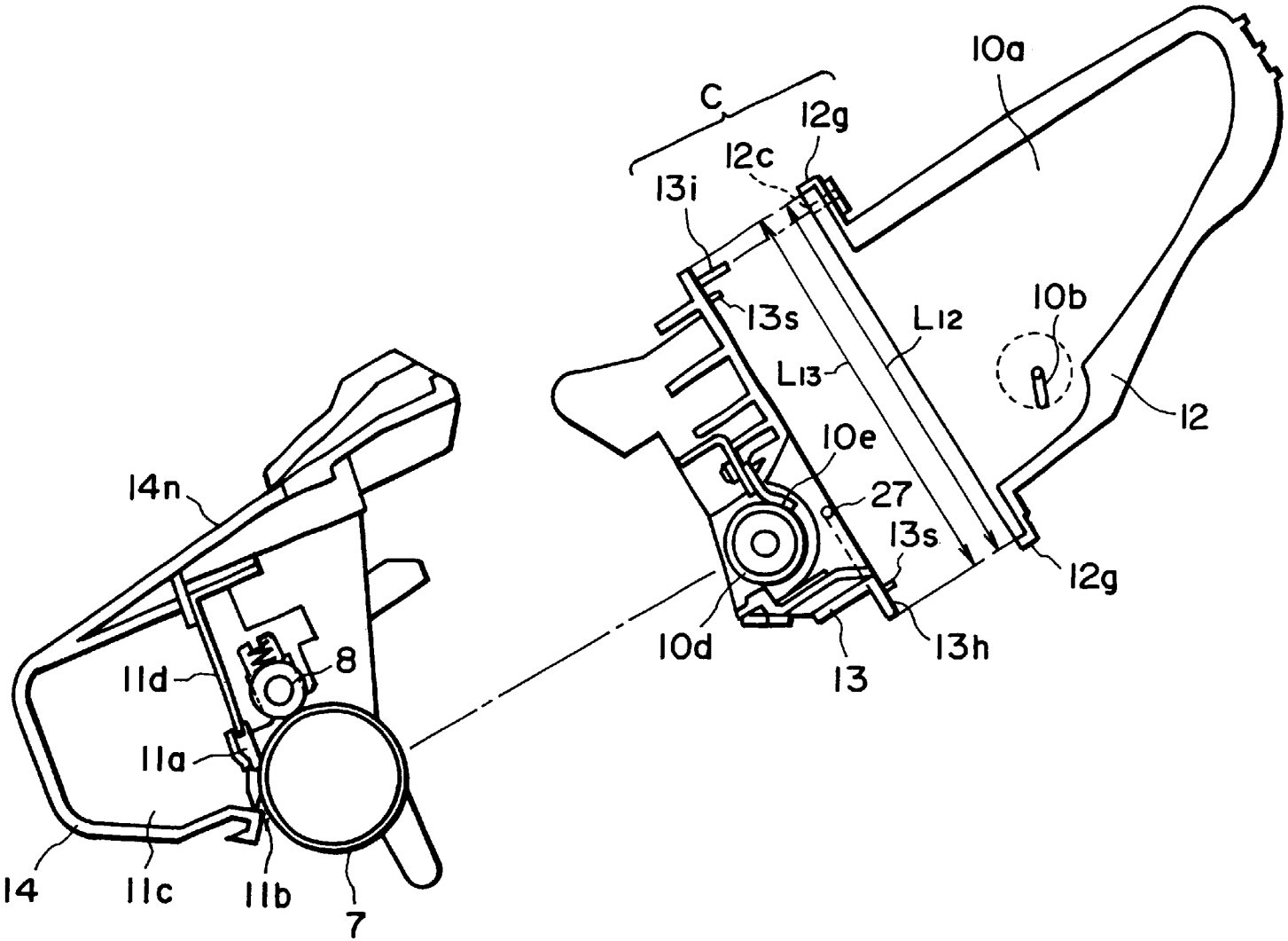
FIG. 7 is a vertical sectional view of the process cartridge, which has been separated into its major structures, that is, frames.

The photosensitive drum 7 in this embodiment comprises a base member 7*a*, which is a cylindrical aluminum drum, and a layer 7*b* of organic photosensitive substance, which is coated on the peripheral surface of the cylindrical aluminum drum 7*a*. Referring to FIG. 7, the photosensitive drum 7 is provided with a helical gear 7*c* (FIG. 8(A)) fixed to one end of the photosensitive drum 7 in terms of the length direction, and is rotationally attached to the cleaning means holding frame 15. As a driving force is transmitted from an unshown motor on the apparatus main assembly side to the helical gear 7*c*, the photosensitive drum 7 is rotated in the direction indicated by an arrow mark in FIG. 1 in coordination with an image forming operation. More specifically, referring to FIG. 8(A), which is a sectional view of the photosensitive drum 7 at a plane parallel to the length direction, the boss 7*d*1 of a gear flange 7*d* attached to the other end of the photosensitive drum 7 is fitted in the bearing portion 14*a* of the cleaning means holding frame 14, and a metallic shaft 21 (which is an iron shaft, in this embodiment) is put through the hole of the aforementioned helical gear 7*c* formed of resinous material. The shaft 21 is fixed to the cleaning means holding frame 14. As a result, the photosensitive drum 7 is rotationally attached to the cleaning means holding frame 14. The shaft 21 is a single piece component and comprises a shaft portion 21*a* and a collar portion 22*b*. It is fixed to the cleaning means holding frame 14 by screwing small screws 21*c* into the cleaning means holding frame 14. The aforementioned gear flange 7*d* is a spur gear, and transmits to the transfer roller 4, the rotational force of the photosensitive drum 7, which rotates as the helical gear 7*c* receives the driving force from the apparatus main assembly 15, to rotate the transfer roller 4. The metallic shaft 21 is an electrically conductive member. The end of the photosensitive drum 7, into which the metallic shaft 21 is inserted, is fitted with an electrically conductive member 22 (which in this embodiment is formed of phosphor bronze), which is placed in contact with the internal surface of the base 7*a*, or the aluminum drum, of the photosensitive drum 7. Thus, as the metallic shaft 21 is put through the hole of the helical gear 7*c*, it makes contact with the electrically conductive member 22, grounding the photosensitive drum 7 to the apparatus main assembly 15 through the electrically conductive member 22 and metallic shaft 21. More specifically, referring to FIG. 9, the conductive member 22 is fixed to the flange portion 7*c*1 by press fitting a pair of bosses 7*c*2 inwardly projecting from the inwardly facing surface of the flange portion 7*c*1 of the helical gear 7*c* into a pair of holes, one for one, of the electrically conductive member 22. The conductive member 22 is also provided with a hole 22*a* through which the metallic shaft 21 is put, and a springy contact portion 22*b*, which slightly extends into the hole 22*a*. Thus, as the metallic shaft 21 is put through the hole 22*a*, the tip of the shaft 21 comes into contact with the contact portion 22*b* in a manner to push the contact portion 22*b* slightly out of the hole. Further, the conductive member 22 is provided with a pair of claw-like portions with a forked tip, which are symmetrical with respect to the axial line of the helical gear 7*c* and extend in the radial direction of the conductive member 22. Thus, as the flange portion 7*c*1 is fitted into the photosensitive drum 7, the claw-like portions 22*c* make contact with the internal surface of the photosensitive drum 7.

In an image forming operation, the photosensitive drum 7 is rotated, and a combination of DC and AC voltages is applied to the charge roller 8, as a charging means, placed in contact with the photosensitive drum 7. As a result, the peripheral surface of the photosensitive drum 7 is uniformly charged. In order to uniformly charge the peripheral surface of the photosensitive drum 7, not only is it desired that a combination of DC and AC voltage is applied to the charge roller 8, but also it is desired that the frequency of the AC voltage is high. However, when the frequency of the AC voltage is higher than approximately 200 Hz, the so-called "charging noise" becomes loud, which occurs as the photosensitive drum 7 and charge roller 8 vibrate. More specifically, as AC voltage is applied to the charge roller 8, the photosensitive drum 7 and charge roller 8 are pulled toward each other by an electrostatic force. This electrostatic force, which causes the photosensitive drum 7 and charge roller 8 to be pulled toward each other, becomes largest and causes the charge roller 8 to be deformed toward the photosensitive drum 7, when the AC voltage takes the largest or smallest value. On the other hand, when the AC voltage takes the middle value, the electrostatic force becomes relatively small, allowing the resiliency of the charge roller 8 to restore its original shape, that is, allowing the deformed charge roller 8 to move in the direction to move away from the photosensitive drum 7. Thus, the photosensitive drum 7 and charge roller 8 vibrate at twice the frequency of the AC voltage. Further, as the charge roller 8 is pulled toward the photosensitive drum 7 by the electrostatic force, the charge roller 8 and the photosensitive drum 7 are made to act in a manner of braking each other, intermittently sticking to and slipping against each other as a finger sticks to and slips on the surface glass as the glass is rubbed by a finger when it is wet. This sticking and slipping also causes the charge roller 8 and photosensitive drum 7 to vibrate, which also results in noise, adding to the so-called charging noise.

Figure 8:
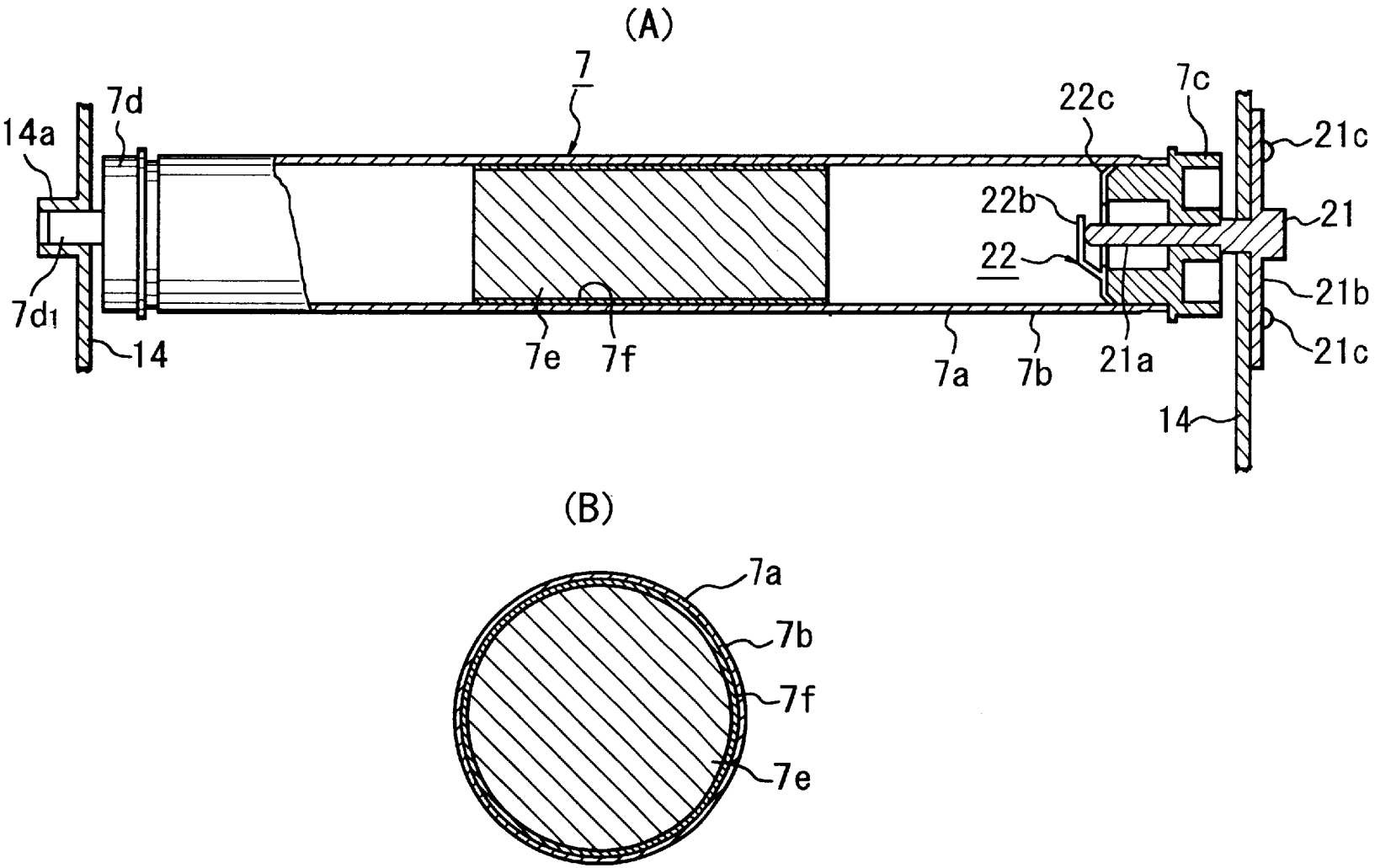
FIG. 8(A) is a sectional view of a photosensitive drum, at a plane which includes the axial line of the photosensitive drum.
FIG. 8(B) is a sectional view of the photosensitive drum, at a plane perpendicular to the axial line of the photosensitive drum.
Figure 9:
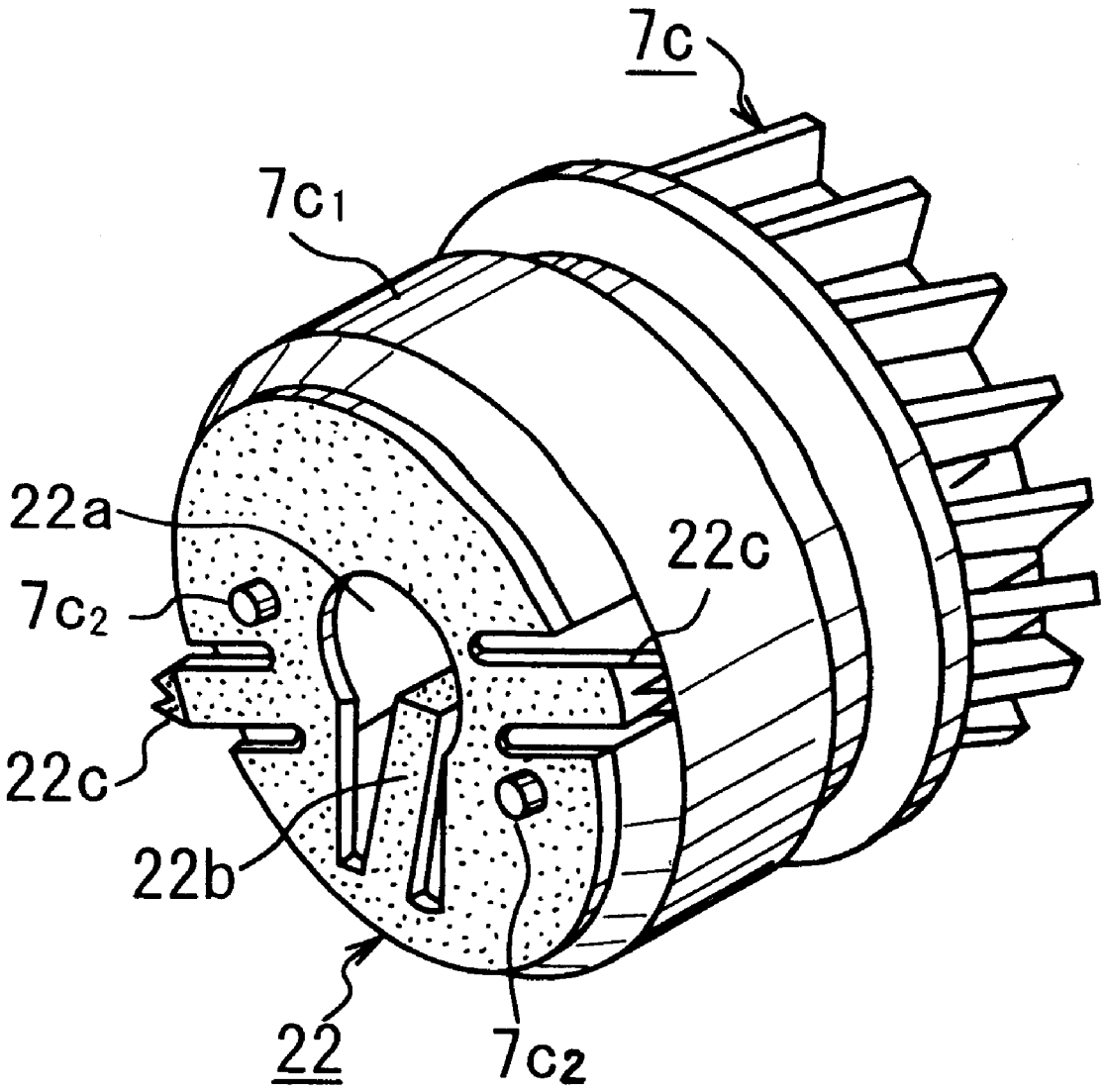
FIG. 9 is a perspective view of an electrically conductive member which contacts a metallic shaft.

Thus, in this embodiment, in order to reduce the vibration of the photosensitive drum 7, the approximately center portion of the photosensitive drum 7 in terms of the axial direction of the photosensitive drum 7 is filled with a filler 7*e* formed of rigid or elastic substance, as shown in FIG. 8(A), and FIG. 8(B), which is a sectional view of the photosensitive drum 7 at a plane parallel to the radial direction of the photosensitive drum 7. As for the material for the filler 7*e*, a metallic substance such as aluminum or brass, ceramic such as cement or plaster, or rubber such as natural rubber, may be used. An optimum one among the above listed substances should be selected in consideration of such factors as productivity, processability, weight effect, and cost. Incidentally, in this embodiment, approximately 120 g of aluminum is used as the filler 7*e*.

The shape of the filler 7*e* is like a round pillar or a cylinder (which in this embodiment is shaped like a round pillar as shown in FIG. 8(B)). More specifically, the filler 7*e*, the external diameter of which is approximately 100 $\mu$m smaller than the internal diameter of the photosensitive drum 7, is inserted into the hollow base 7*a* of the photosensitive drum 7, and is fixed to the aforementioned portion of the photosensitive drum 7; the gap between the internal surface of the base 7*a* of the photosensitive drum 7 and the peripheral surface of the filler 7*e* is rendered no more than 100 $\mu$m, and the filler 7*e* is inserted into the base 7*a* of the photosensitive drum 7 after coating the peripheral surface of the filler 7*e* or the internal surface of the base 7*a* of the photosensitive drum 7 with adhesive (for example, cyanoacrylate, epoxy resin, and the like).

The placement of the filler 7*e* within the photosensitive drum 7 enables the photosensitive drum 7 to rotate in a stable manner, minimizing the vibrations resulting from the rotation of the photosensitive drum 7 during an image forming operation. Therefore, even if the frequency of the AC voltage applied to the charge roller 8 is increased, the charging noise remains small.

(Charging Means)

The charging means is a means for charging the peripheral surface of the photosensitive drum 7. In this embodiment, a so-called contact charging method, such as the one disclosed in Japanese Laid-Open patent Application 63-149669, is employed. More specifically, referring to FIG. 10, the charge roller 8 is rotationally disposed within the cleaning means holding frame 14. This charge roller 8 comprises a metallic roller shaft 8*a*, an electrically conductive elastic layer placed on the peripheral surface of the shaft 8*a*, an elastic layer with a higher electrical resistance placed layered on the electrically conductive elastic layer, and a protective film layered on the elastic layer with a higher electrical resistance. The electrically conductive elastic layer is formed of elastic rubber such as EPPDM or NBR in which carbon particles are dispersed, and it guides the bias voltage to be applied to the roller shaft 8*a*. The elastic layer with a higher electrical resistance is formed of urethane rubber or the like, and it may contain an extremely small amount of electrically conductive microscopic particles (for example, carbon particles). It limits the amount of the leak current to the photosensitive drum 7 so that even if the charge roller 8 comes into contact with a pin hole or the like on the photosensitive drum 7, which is high in electrical conductivity, the bias voltage will not quickly drop. The protective layer is formed of N-methyl-methoxyl-nylon, and prevents the plastic substance in the electrically conductive layer and elastic layer with a high electrical resistance from changing the properties of the peripheral surface of the photosensitive drum 7 by coming into contact with the peripheral surface of the photosensitive drum 7. The roller shaft 8*a* is attached to the cleaning means holding frame 14, with the interposition of the bearings 23 and 24 which are slightly slidable toward the photosensitive drum 7. The bearings 23 and 24 are kept under the pressure generated by a pair of compression springs 25 in the direction to press the bearings 23 and 24, and therefore, the charge roller 8 is kept in contact with the photosensitive drum 7. Thus, in an image forming operation, the charge roller 8 is rotated by the rotation of the photosensitive drum 7, and as the charge roller 8 rotates, a combination of DC and AC voltages is applied to the charge roller 8 to uniformly charge the peripheral surface of the photosensitive drum 7 as described above. In order to apply the combination of DC and AC voltages to the charge roller 8, a resilient metallic electrical contacting member 26 is placed in contact with one end of the metallic roller shaft 8*a* in terms of the axial direction of the roller shaft 8*a*, so that the combination of the voltages is applied to the charge roller 8 from the apparatus main assembly side through the electrical contacting member 26.

The cleaning means holding frame 14 is provided with a regulating member 14*b* for preventing the electrical contacting member 26 from deforming. With the provision of the regulating member 14*b*, even if force is exerted upon the roller shaft 8*a* in the leftward direction in FIG. 10 as the process cartridge B is accidentally dropped or in the like situations, the electrical contacting member 26 comes into contact with the regulating member 14*b*, which prevents the deformation of the electrical contacting member 26. Further, in order for the regulating member 14*b* to regulate the leftward movement (leftward movement in FIG. 10) of the charge roller 8 in terms of the axial direction of the charge roller 8, the charge roller 8 must always remains on the top side of the photosensitive drum 7.

On the other hand, the position of the other end of the charge roller 8 in terms of the axial direction of the charge roller 8 is fixed by the bearing 24. More specifically, referring to FIG. 10, the bearing 24 has a key-shaped projection 24*a*, which is an integrally formed part of the bearing 24 and projects from the main structure of the bearing 24. The end of the charge roller 8 in terms of the axial direction of the roller shaft 8*a* is placed in contact with this projection 24*a* to prevent the rightward movement of the roller shaft 8*a* in terms of the axial direction of the roller shaft 8*a* in FIG. 10. This bearing 24 is formed of polyacetal (POM), allowing the metallic roller shaft 8*a* to smoothly slide thereon, and being superior in abrasion resistance.

As described above, the movement of the roller shaft 8*a* in the axial direction is regulated by the contacts between one end of the roller shaft 8*a* in terms of the axial direction of the roller shaft 8*a* and the abrasion resistant bearing 24, and between the other end of the roller shaft 8*a* and the electrical contacting member 26, and therefore, the roller shaft 8*a* does not come into contact with the cleaning means holding frame 14. Although it is possible to regulate the movement of the roller shaft 8*a* in the axial direction by placing the ends of the roller shaft 8*a* in contact with the cleaning means holding frame 14, such a structural arrangement requires that the cleaning means holding frame 14 be formed of such material as polyphenylene oxide (PPO) that is resistant to the abrasion which occurs to the cleaning means holding frame 14 as the result of the contact between the metallic roller shaft 8*a* and cleaning means holding frame 14. In comparison, in a structural arrangement such as the one in this embodiment in which there is no friction between the roller shaft 8*a* and cleaning means holding frame 14, there is no need for strengthening the cleaning means holding frame 14 in terms of abrasion resistance. Thus, in this embodiment, the cleaning means holding frame 14 may be formed of such material as polystyrene (PS) that is inexpensive relative to PPO, to reduce the cost of the process cartridge B. The selection of the material for the bearing 24 does not need to be limited to polyacetal. Any material will suffice as long as it resistant to the abrasion which results from its contact with the metallic roller shaft 8*a*. For example, the bearing 24 may be formed of Nylon or the like.

Incidentally, the voltage applied to the charge roller 8 to charge the photosensitive drum 7 in this embodiment is a combination of an AC voltage with a peak-to-peak voltage of approximately 1,800 V (Vpp=1800 V) and a DC voltage of approximately −670 V (Vdc1 '−670 V), and constant current control is carried out.

(Exposing Portion)

The exposing portion 9 is a portion for forming an electrostatic latent image on the peripheral surface of the photosensitive drum 7 by exposing the peripheral surface of the photosensitive drum 7 uniformly charged by the charge roller 8, to an optical image projected from the optical system 1. More specifically, referring to FIG. 4, which is an external perspective view of the process cartridge B, the exposing portion is an opening 9 provided in the top surface of the process cartridge B, between the developing means holding frame 13 and cleaning means holding frame 14, to allow image light to enter the process cartridge B; the top wall 13*r* of the developing means holding frame 13 is provided with a rectangular opening 9*a*, and the top wall 14*n* of the cleaning means holding frame 14 is designed so that it partially covers the rectangular opening 9*a* as the developing means holding frame 13 and cleaning means holding frame 14 are connected to each other.

(Developing Means)

Next, the developing means 10 will be described. The developing means 10 is a means for visualizing an electrostatic latent image formed on the photosensitive drum 7 through exposure, with the use of toner. In this embodiment, the process cartridge B which contains single component magnetic toner as developer is mounted in the image forming apparatus A, although the image forming apparatus A can use both magnetic and nonmagnetic toner for development.

The aforementioned magnetic toner to be used for development uses polystyrene resin, in particular, styrene-acrylic resin, as bonding resin. As for coloring agent for the magnetic toner, well-known conventional agents, for example, carbon black, copper phthalocyanine, black iron oxide, and the like can be used. As for the microscopic magnetic particles to be contained in the magnetic toner, a substance which is magnetized as it is placed in a magnetic field, for example, particles of ferromagnetic metal such as iron, cobalt, or nickel, and metallic alloy or compound such as magnetite or ferrite, can be used.

Referring to FIG. 3, which is a sectional view of the process cartridge B, the developing means 10 for forming a toner image with the use of the aforementioned magnetic toner, has a toner storing bin 10*a* for storing toner. In the toner storing bin 10*a*, a toner sending member 10*b*, which rotates in the direction indicated by an arrow mark for sending the toner out of the toner storing bin 10*a*, is disposed. After being sent out of the toner storing bin 10*a*, the toner is coated in a thin layer on the peripheral surface of the development roller 10*d* (which hereinafter will be referred to as development sleeve), which contains a magnet 10*c*, as the development sleeve 10*d* is rotated. While the toner layer is formed on the development sleeve 10*d*, the toner is charged due to the friction between the toner and development sleeve 10*d*, sufficiently to develop the electrostatic latent image on the photosensitive drum 7. There is a development blade 10*e*, a piece of plate, which is formed of urethane rubber or silicone rubber and is placed in contact with the peripheral surface of the development sleeve 10*d*, with the application of a predetermined amount of pressure; the elasticity of the rubber is used to generate the predetermined amount of pressure. In this embodiment, a combination of an AC voltage of approximately 1,600 V (Vpp=1600 V) and a DC voltage of approximately −500 V (Vdc2=−500 V) is applied as development bias. Regarding the relationship between the DC component Vdc2 of this development bias and the aforementioned DC component Vdc1 (approximately −670 V) of the charge bias, if the difference between Vdc1 and Vdc2 exceeds −50 V (increases toward+ side), it is possible that a foggy image will be produced. Incidentally, the toner storing bin 10*a* and toner sending member 10*b* belong to the toner holding frame 12, and the development sleeve 10*d* and development blade 10*e* are attached to the developing means holding frame 13. The two frames 12 and 13 are welded along the edges D, in FIG. 3, at both ends of the process cartridge B in terms of the width direction, by ultrasonic welding.

Figure 11:
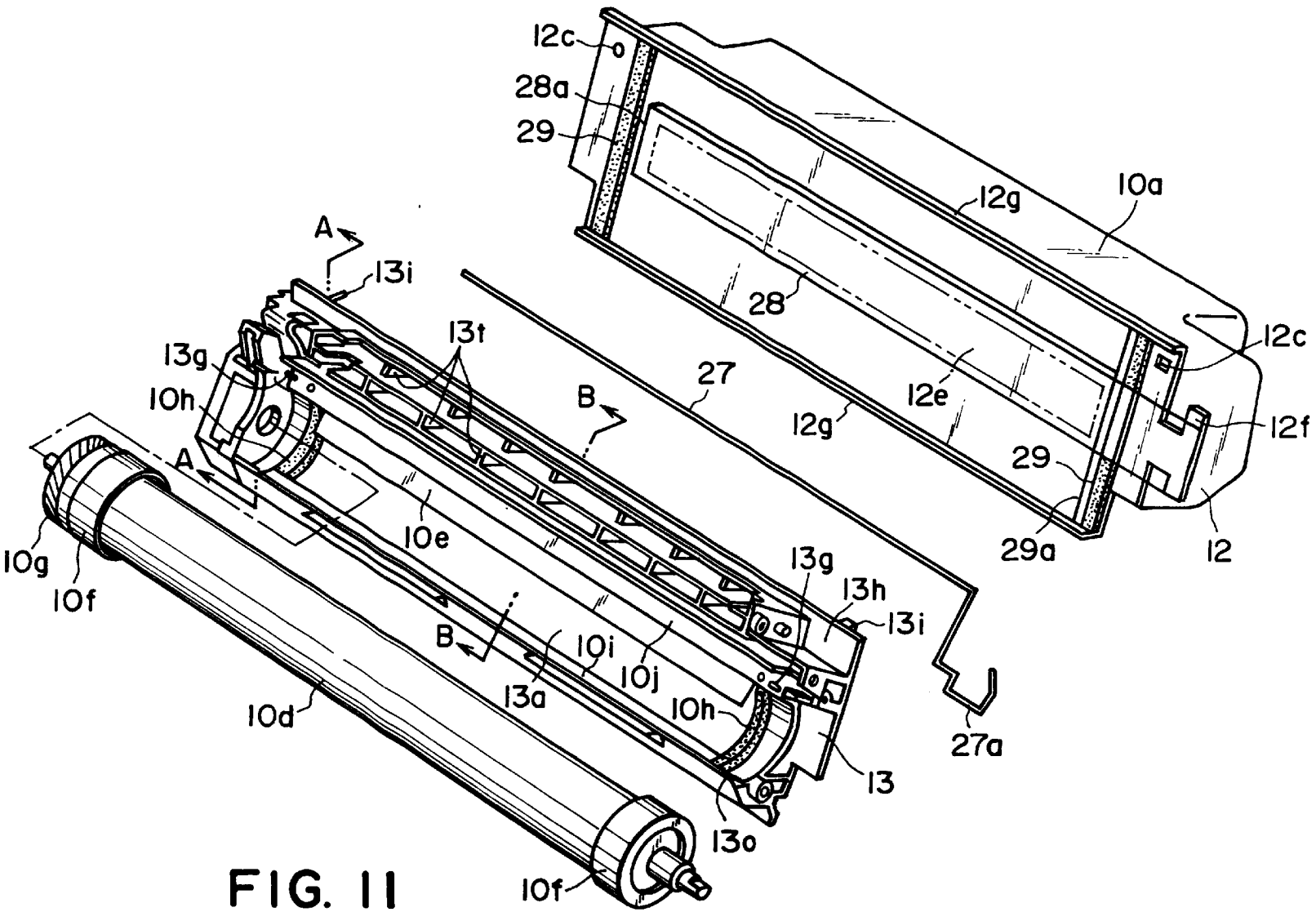
FIG. 11 is a front view of a blowout prevention sheet and a toner leakage prevention seal, for showing the manner in which they overlap with each other.
Figure 12:
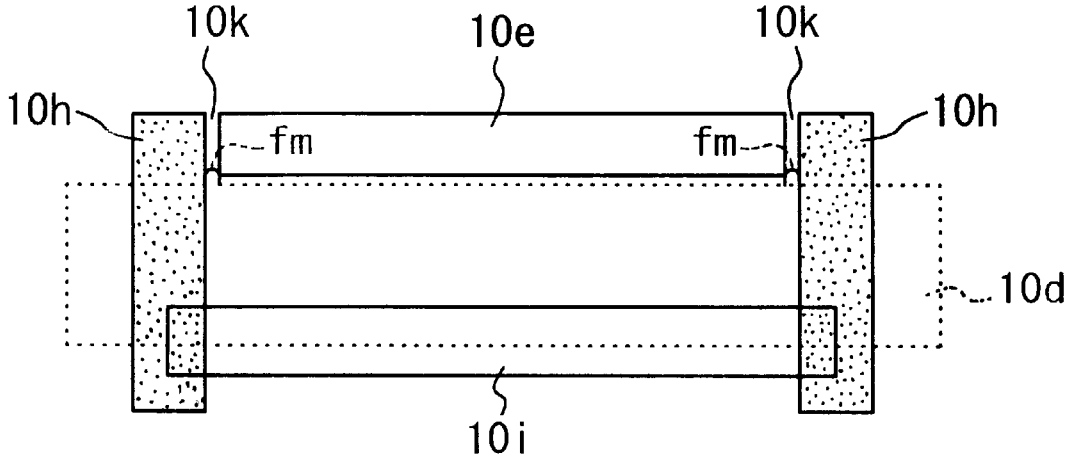
FIG. 12 is a perspective view of a development blade, a toner leakage prevention seal, and a blowout prevention sheet, for showing their positional relationship.
Figure 42:
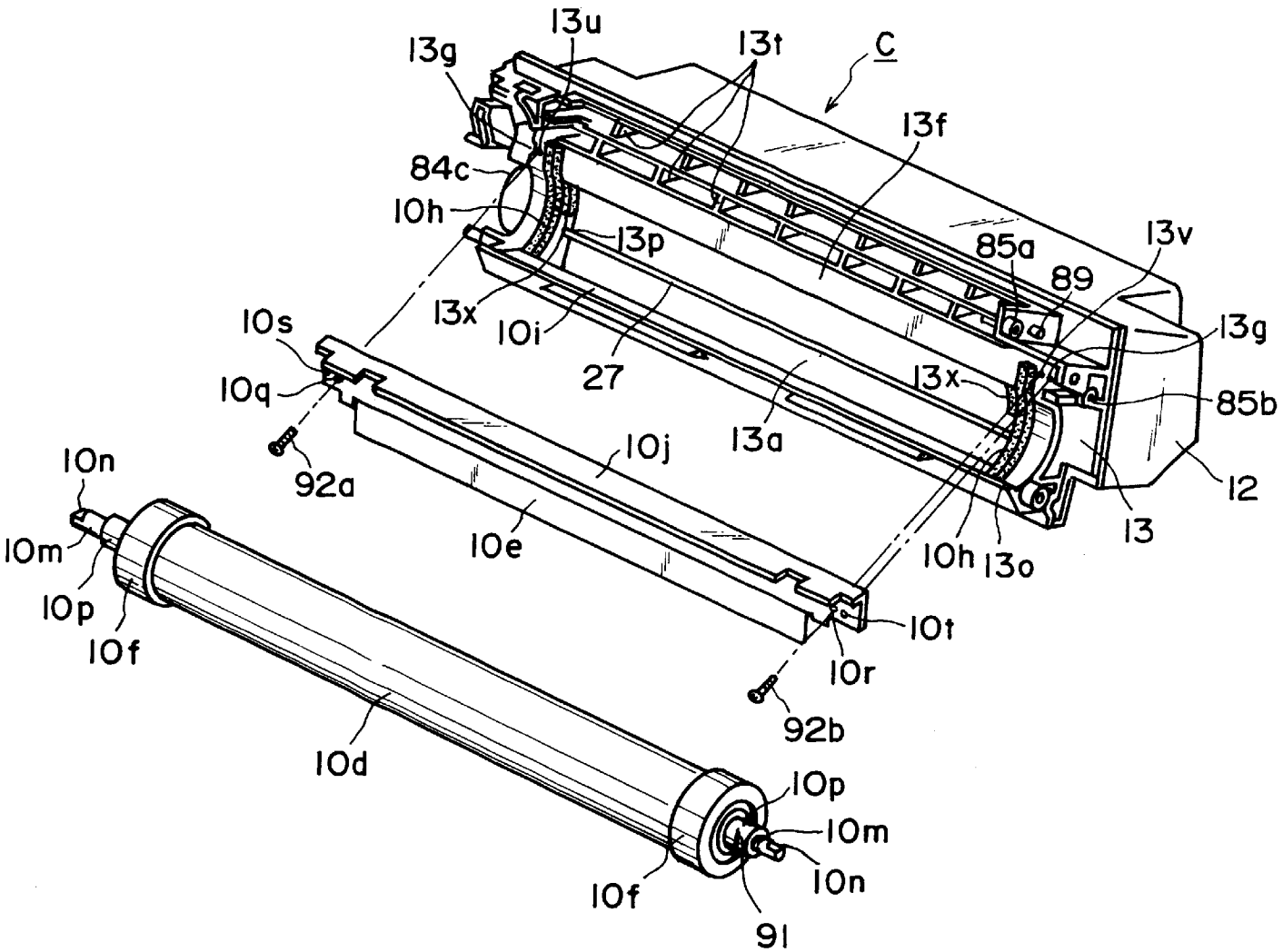
FIG. 42 is a perspective view of the developing means holding frame, the development sleeve, and the development blade, in which the development sleeve and the development blade have been removed from the developing means holding frame.
Figure 45:
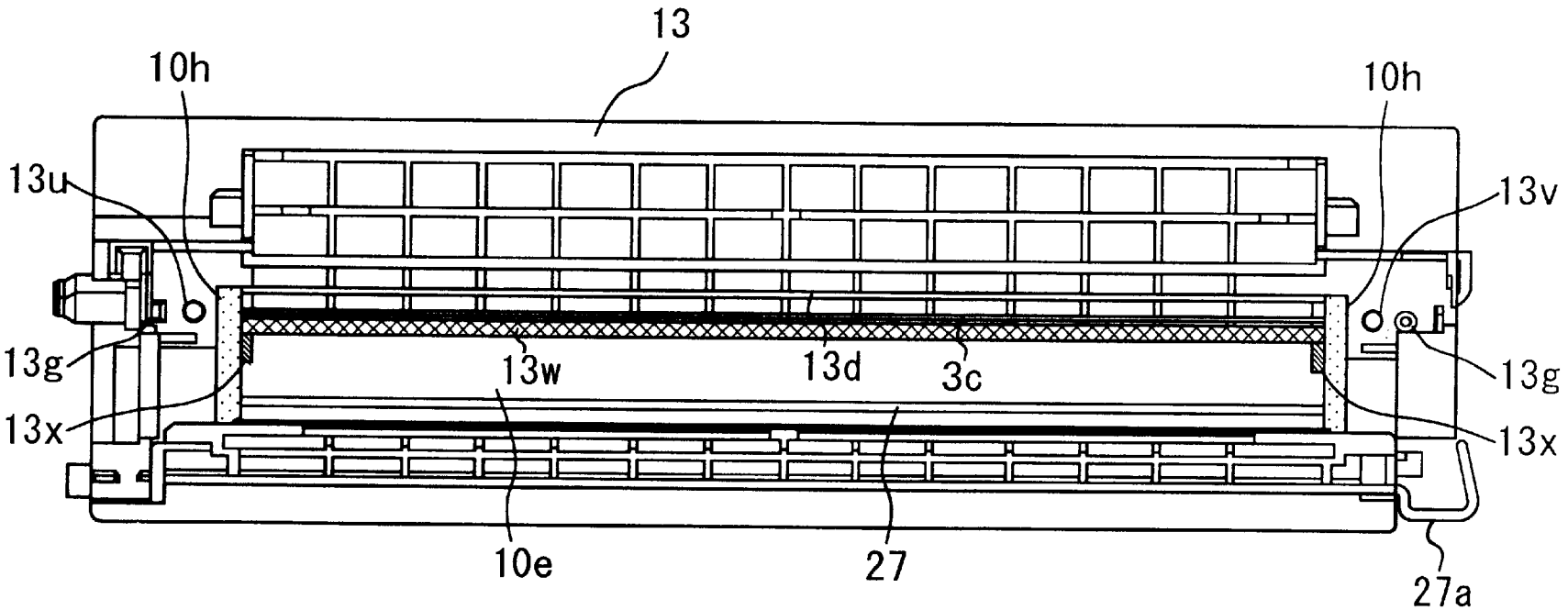
FIG. 45 is a front view of the toner/developing means holding frame and a sealing member, after the pasting of the sealing member to the frame.

The development sleeve 10*d* on which the aforementioned toner layer is formed, and the photosensitive drum 7, are positioned in a manner to oppose to each other so that a small gap (approximately 250 $\mu$m) is kept between the peripheral surfaces of the two components. In this embodiment, in order to keep this gap, both end portions of the development sleeve 10*d* in terms of its axial direction are fitted with a contact ring 10*f*, the radius of which is greater by the aforementioned small gap than the external radius of the development sleeve 10*d*, as shown in FIG. 11, which is a perspective view of the partially disassembled developing means holding frame 13 and cleaning means holding frame 14. More precisely, the position of the contact ring 10*f* is outside the area of the development sleeve 10*d* to be covered with toner, in terms of the length direction. These contact rings 10*f* contact the photosensitive drum 7 outside the latent image area of the photosensitive drum 7. The development sleeve 10*d* is provided with a gear 10*g*, which is attached to one end of the development sleeve 10*d* in terms of its axial direction. This gear 10*g* and the development sleeve 10*d* rotate together. As the developing means holding frame 13 is connected to the cleaning means holding frame 14, the gear 10*g* meshes with the helical gear 7*c* of the photosensitive drum 7. Thus, as the photosensitive drum 7 rotates, the gear 10*g* rotates the development sleeve 10*d*. The gear 10*g* also meshes with an unshown gear connected to the toner sending member 10*b*, and transmits the rotational force of the photosensitive drum 7 to the toner sending member 10*b*. Thus, in an image forming operation, the toner sending member 10*b* rotates, sending the toner within the toner storing bin 10*a* to the development sleeve 10*d*, and a toner layer with a predetermined thickness is formed on the peripheral surface of the development sleeve 10*d* by the development blade 10*e*. The toner particles in the thus formed toner layer are transferred onto the photosensitive drum 7 in accordance with the electrostatic latent image on the photosensitive drum 7. It should noted here that the toner layer is formed on only the carbon coated portion of the development sleeve 10*d*, and the photosensitive layer range, charging range of the charge roller 8, and toner layer range (development range) of the development sleeve 10*d*, in terms of the length direction (axial direction) of the photosensitive drum 7, have the following relationship: photosensitive layer range>charging range>development range. The toner within the toner storing bin 10*a* must be prevented from leaking out from between the development sleeve 10*d* and developing means holding frame 13. Thus, in this embodiment, a toner leakage prevention seal 10*h* formed of elastic material such as felt is pasted to the developing means holding frame 13 at both ends of the opening 13*a* in terms of the length direction, and one end, in terms of the width direction, of a blowout prevention sheet 10*i* formed of flexible thin plate of PET or the like is pasted to the bottom edge of the opening 13*a*, and the other end is placed in contact with the development sleeve 10*d*, across the entire range of the development sleeve 10*d* in terms of the length direction, to seal between the development sleeve 10*d* and developing means holding frame 13. Thus it is assured that the toner leakage prevention seal 10*h* seals between the development sleeve 10*d* and developing means holding frame 13 by being compressively deformed by the development sleeve 10*d* and developing means holding frame 13, and the blowout prevention sheet 10*i* seals between the development sleeve 10*d* and developing means holding frame 13 by its reactive force generated in the sheet 10*i* as it is bent in terms of the short dimension direction as it is placed in contact with the development sleeve 10*d*. The thickness of the toner leakage prevention seal 10*h* is approximately equal to the riser portion of the stepped portion formed along the bottom edge 13*o* of the developing means holding frame 13, and therefore, after the pasting of the seal 10*h* to the developing means holding frame 13, the top surface of the seal 10*h* is approximately level with the surface of the bottom edge 13*o*. The blowout prevention sheet 10*i* is pasted to the upwardly facing surface of the bottom edge 13*o* with the use of a double-sided adhesive tape (unshown). In terms of the length direction, the blowout prevention sheet 10*i* is longer than the opening 13*a*, overlapping with the toner leakage prevention seal 10*h* at both ends, and one of the long edges of the blowout prevention sheet 10*i*, that is, the edges at the ends of the sheet 10*i* in terms of the short dimension direction, is kept in contact with the peripheral surface of the development sleeve 10*d* across the entire range of the development sleeve 10*d* in terms of the length direction, with the application of a proper amount of pressure. At this time, the above described overlapping of the blowout prevention sheet 10*i* and toner leakage prevention seal 10*h* will be described in more detail. Referring to FIG. 12, since the thickness of the development blade 10*e* is approximately 1.3 mm, the end portions of the development blade 10*e* in terms of the length direction must not be overlapped with the corresponding toner leakage prevention seals 10*h*. Therefore, there are small gaps 10*k* between the end portions of the development blade 10*e* and the corresponding toner leakage prevention seals 10*h*. Thus, unless these gaps 10*k* are plugged, toner enters the gaps 10*k* when forming a toner layer on the development sleeve 10*d*. Then, the toner in the gaps 10*k* adheres to the development sleeve 10*d*, making the portions (portion tm) of the toner layer corresponding to the gaps 10*k* thicker than the rest of the toner layer. Therefore, in order to plug the gaps 10*k*, a pair of auxiliary seals 13*x* are pasted to the unshown seal seating surfaces of the developing means holding frame 13, which are on the inward side of the left and right toner leakage prevention seals 10*h*, and on the reverse side of the development blade 10*e*, as shown in FIGS. 42 and 45. The toner leakage prevention seals 10*h* and blowout prevention sheet 10*i* overlap with each other, on the outward side of the corresponding gaps 10*k* in terms of the axial direction of the development sleeve 10*d*.

Figure 13:
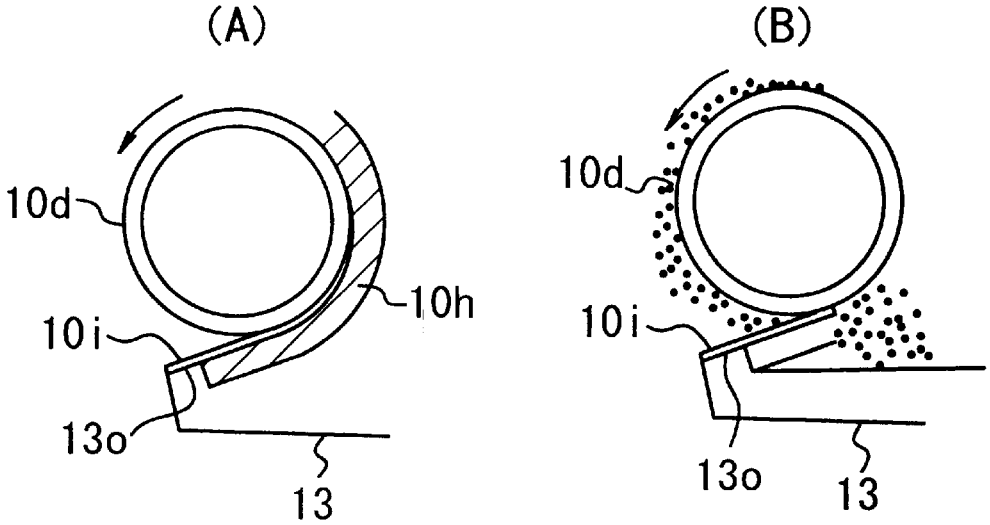
FIG. 13(A) is a sectional view of a development sleeve 10*d*, a toner leakage prevention seal 10*h*, and a blowout prevention sheet 10*i*, at a plane A—A in FIG. 11.
FIG. 13(B) is a sectional view of the development sleeve 10*d* and blowout prevention sheet 10*i*, at a plane B—B in FIG. 11.
Figure 14:
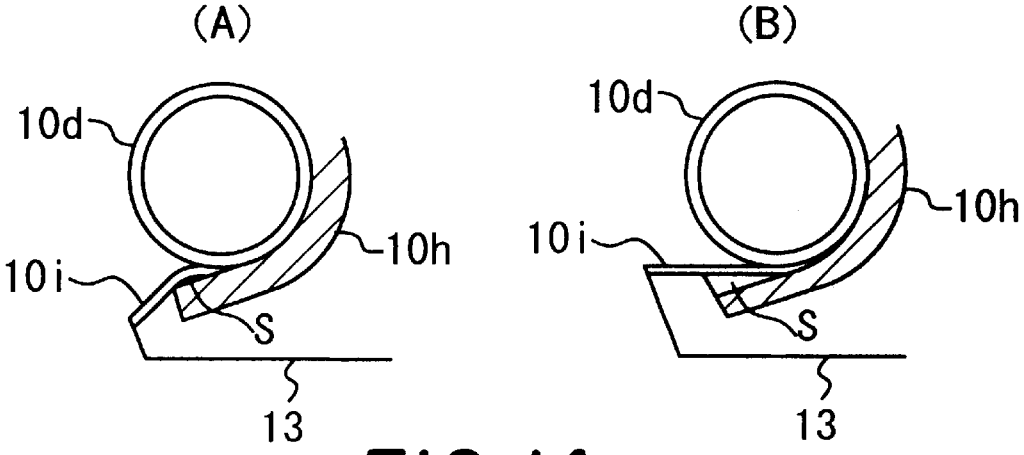
FIGS. 14(A) and 14(B) are sectional views of the development sleeve 10*d* and blowout prevention sheet, in which the blowout prevention sheet is bent.

FIGS. 13(A) and 13(B) are sectional views of the development sleeve 10*d* and its adjacencies, at planes A—A and B—B, respectively, in FIG. 11. Referring to FIG. 13(A), the blowout prevention sheet 10*i* and toner leakage prevention seal 10*h* are attached to the developing means holding frame 13, being airtightly in contact with each other, approximately parallel to each other, and without bending in the range in which they overlap with each other. Next, referring to FIGS. 14(A) and 14(B), if the blowout prevention sheet 10*i* is bent, it fails to be airtightly in contact with the toner leakage prevention seal 10*h*, making it possible for toner to leak out through a gap S between the two. In this embodiment, however, the blowout prevention sheet is not bent, and is airtightly in contact with the toner leakage prevention seal 10*h*, and therefore, there is no possibility that the aforementioned toner leakage will occur. Also in this embodiment, a structural arrangement is made so that the contact angle between the blowout prevention sheets 10*i* and the development sleeve 10*d*, that is, the angle at which the long edge portion of the blowout prevention sheet 10*i* is placed in contact with the peripheral surface of the development sleeve 10*d*, is determined by the state of the top surface of the toner leakage prevention seal 10*h*. Since the state of this top surface does not fluctuate, the contact angle seldom fluctuates from the initial contact angle. Further, if the blowout prevention sheet 10*i* is not bent, the contact angle of the sheet 10*i* is not likely to change with the elapse of time. Therefore, the toner stored in the toner holding frame 12 is not likely to leak out from between the blowout prevention sheet 10*i* and development sleeve 10*d*. Next, referring to FIG. 3, which is a sectional view of the process cartridge B, and FIG. 15, which is an enlarged sectional view of a portion of the process cartridge B, it is also possible that the toner will leak out from between the development blade 10*e* and developing means holding frame 13. Thus, in this embodiment, the developing means holding frame 13 is provided with three long ribs 13*b*, 13*c*, and 13*d*, which contact the development blade le across the entire range of the development blade 10*e* in terms of the length direction. More specifically, the first and second ribs 13*b* and 13*c* are placed in contact with the development blade 10*e* in a manner to maintain a predetermined amount of contact pressure, and the third rib 13*d* is placed in contact with a blade anchoring member 10*j* in a manner to maintain a predetermined amount of contact pressure. The blade anchoring member 10*j* is formed of metallic plate or the like, and is used to attach the development blade 10*e* to the developing means holding frame 13. The edge of the second rib 13*c*, which is kept pressed upon the development blade 10*e*, is rendered sharp, so that as the first and third ribs 13*b* and 13*d* are placed in contact with the development blade 10*e* and blade anchoring member 10*j*, respectively, the sharp edge of the second rib 13*c* slightly bites into the development blade 10*e*, which is formed of rubber and is approximately 1.3 mm in thickness.

Further, the second rib 13*c* is shaped so that its sharp edge slightly bows outward for the following reason. That is, when attaching the development blade 10*e* to the developing means holding frame 13, both ends of the blade anchoring member 10*j* in terms of the length direction are screwed to the developing means holding frame 13, sometimes causing the blade anchoring member 10*j* to deform across the center portion in terms of the length direction, and creating therefore a gap between the developing means holding frame 13 and development blade 10*e*, which must be plugged. Thus, the second rib 13 is shaped so that its sharp edge slightly bows outward. The provision of this shape (preferably, the center portion bows out approximately 0.1–0.5 mm) assures that the rib 13*c* remains in the condition in which the rib 13*c* is biting into the development blade 10*e* across the entire range in terms of the length direction, plugging the gap between the developing means holding frame 13 and development blade 10*e* if there is any gap, and therefore, the toner is prevented from leaking. In addition, the third rib 13*d* is kept pressed upon the blade anchoring member 10*j*. Therefore, even if a gap occurs between the sharp edge of the second rib 13*c* and the development blade 10*e*, and the toner leaks through this gap, the leaked toner does not leak out beyond this point. It should be noted here that the contact portion between the second rib 13*c* and development blade 10*e*, and the contact portion between the third rib 13*d* and blade anchoring member 10*j*, are not level with each other in terms of the vertical direction of the process cartridge, that is, they are apart from each other by a distance equivalent to the thickness of the development blade 10*e* in terms of the horizontal direction of the process cartridge. Therefore, even if there are gaps between the second rib 13*c* and blade 10*e*, and between the third rib 13*d* and blade anchoring member 10*j*, it is very difficult for the toner to leak out through these gaps.

Figure 15:
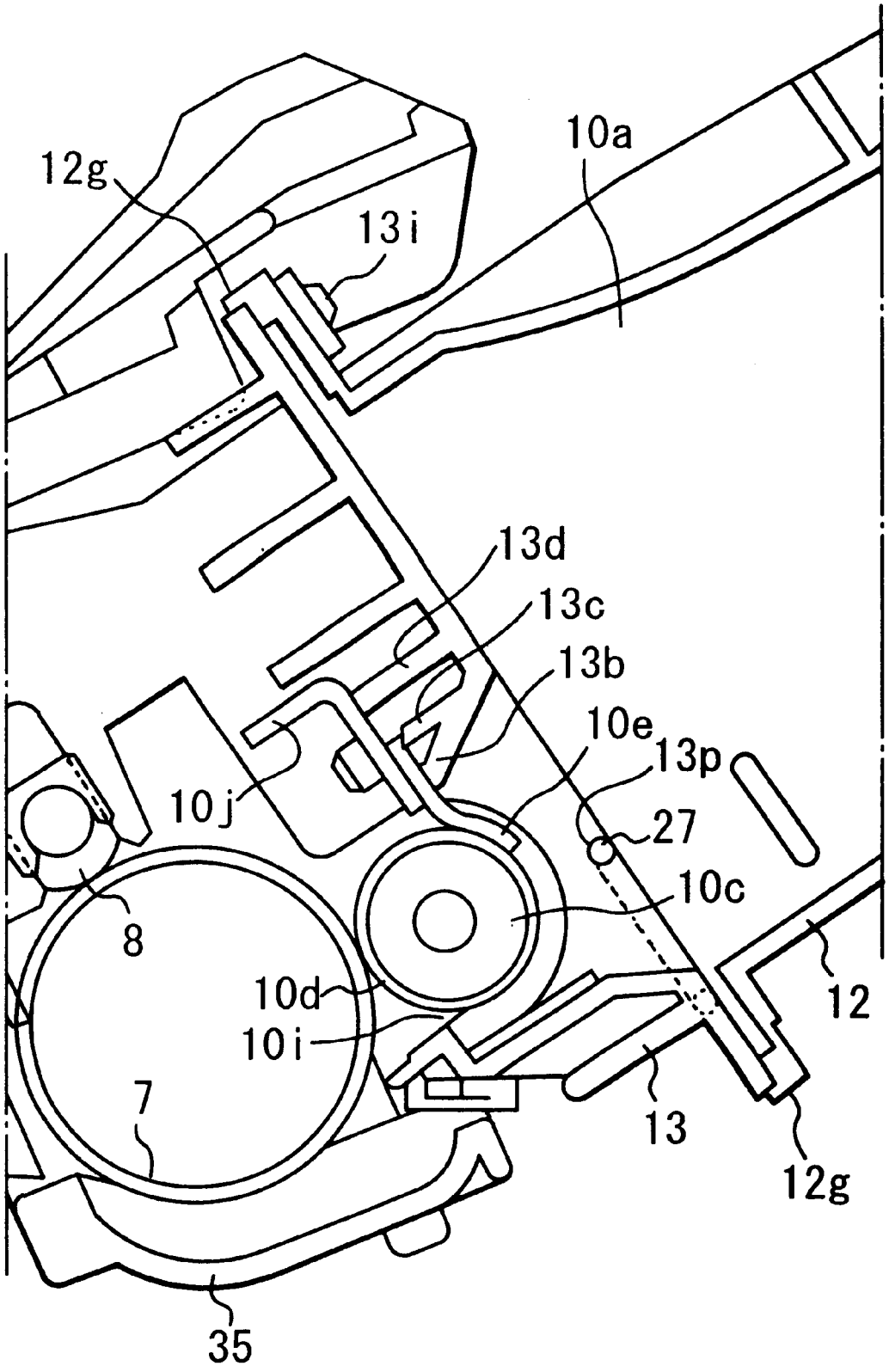
FIG. 15 is an enlarged vertical sectional view of a portion of the process cartridge, in which a rib having a sharp edge has bitten into the development blade.

Referring to FIGS. 11 and 15, the developing means 10 in this embodiment is provided with a toner remainder detection mechanism for detecting the amount of the toner remaining in the toner storing bin 10*a*. The toner remainder detection mechanism comprises a metallic wire antenna 27, which is disposed at the joint between the toner holding frame 12 and developing means holding frame 13, being in the toner passage from the toner storing bin 10*a* to the development sleeve 10*d*. In order to detect the presence or absence of toner, this wire antenna 27 and the development sleeve 10*d* are used as first and second electrodes, and voltage is applied between the two electrodes. When toner is present between the two electrodes, the amount of electrostatic capacity between the two electrodes is greater than when it is not; the amount of this electrostatic capacity decreases as the amount of toner between the two electrodes decreases. Thus, an unshown control portion can detect the amount of the toner remainder by detecting the change in this electrostatic capacity. More specifically, it can detect a state of "no toner" by comparing the value of an electrical signal generated in accordance with the electrostatic capacity, with a predetermined reference value. As the control portion detects the "no toner" state, it turns on and off a lamp or the like (process cartridge replacement warning lamp) to warn a user of the need for process cartridge replacement.

The toner holding frame 12 and developing means holding frame 13 are welded to each other along their long edges, that is, the edges at the ends of the process cartridge B in terms of the width direction, and therefore, toner does not leak from the long edges of the process cartridge B. However, the toner holding frame 12 and developing means holding frame 13 cannot be welded to each other along their short edges, at one end of the process cartridge B in terms of the length direction, for the following reason. That is, referring to FIG. 11, when the process cartridge B is manufactured, the opening 12*e* of the toner holding frame 12 is sealed with a cover film 28 to prevent the toner within the toner storing bin 10*a* of the process cartridge B from leaking. This cover film 28 must be removed before the process cartridge B is used for the first time. Thus, one of the end portions of the cover film 28 is extended outward from one of the short edges of the process cartridge B so that the cover film 28 can be pulled out of the process cartridge B when the process cartridge B is used for the first time. Therefore, at both short edges of the process cartridge B, a toner leakage prevention seal 29 is disposed between the toner holding frame 12 and developing means holding frame 13, being pasted to toner holding frame 12, to prevent the toner from leaking from the short edges of the process cartridge B.

Also referring to FIG. 11, the cover film 28 is in the form of a belt having a length of more than twice the length of the opening 12*e*. It is pasted to the fringe of the opening 12*e* and folded back 180 deg. at a line 28*a*, is doubled back to the opposite end, and further extended outward of the process cartridge B. The end of the cover film 28 exposed from the process cartridge B is pasted to a cover film tab 12*f*.

The cover film tab 12*f* is an integrally formed part of the toner holding frame 12, being connected to the main structure of the toner holding frame 12 by a thin strip. Thus, when using the process cartridge B for the first time, the tab 12*f* must be separated from the main structure of the toner holding frame 12 by breaking the thin strip so that the cover film tab 12*f* can be pulled out of the process cartridge B. As a user pulls the cover film 28 outward of the process cartridge B by grasping the tab 12*f*, the cover film 28 is peeled away from the toner holding frame 12 starting from the line 28*a*, exposing the opening 12*e*. As a result, it becomes possible for the toner within the toner storing bin 10*a* to be supplied to the development sleeve 10*d*.

(Toner Leakage Prevention Seal)

Figure 16:
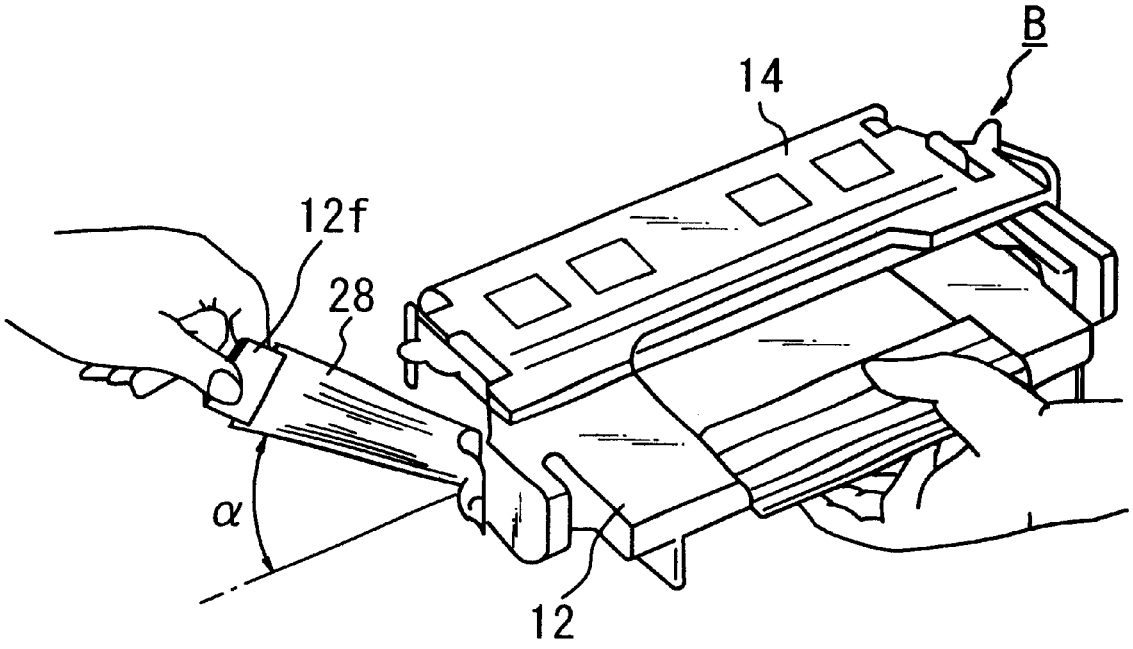
FIG. 16 is a perspective view of the process cartridge, for showing the manner in which the cover film is pulled out in the diagonal direction.
Figure 17:
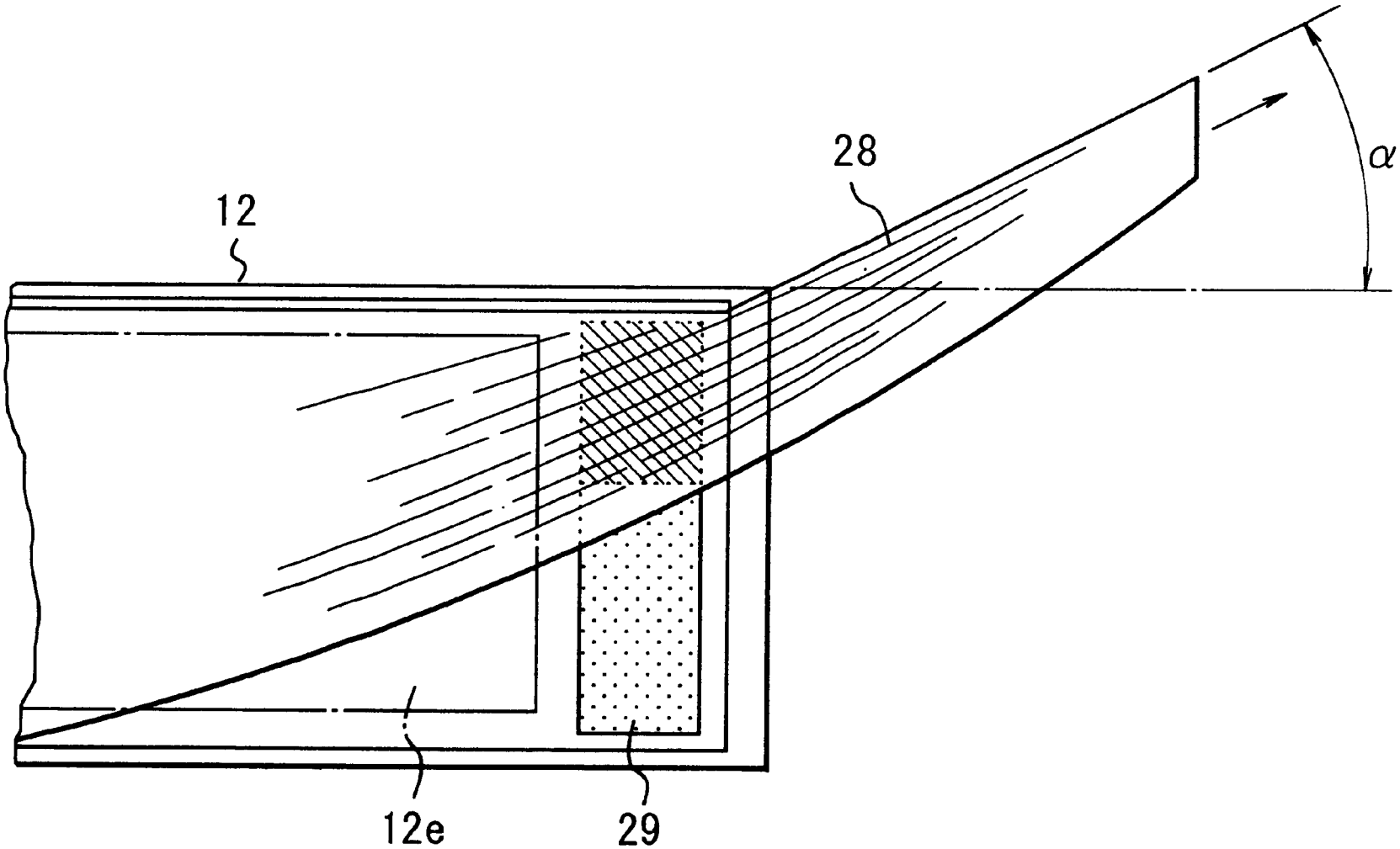
FIG. 17 is a drawing for depicting the relationship between the cover film, which is being diagonally pulled out, and the toner leakage prevention seal.

Next, the toner leakage prevention seal 29 will be described. It is formed of foamed rubber such as foamed urethane, and is pasted to the toner holding frame 12, in the adjacencies of both edges of the opening 12*e* in terms of the length direction, with the use of double-sided adhesive tape. Referring to FIG. 11, to the surface of the seal 29, on the side from which the cover film 28 is pulled out, which faces the cover film 28, a tearing prevention sheet 29*a*, which is smaller in the dimension in the length direction of the process cartridge B than the seal 29 and is approximately 0.1 mm–1.0 mm in thickness, is pasted. This tearing prevention sheet 29*a* is provided for the following reason. That is, when the process cartridge B is used for the first time, an operator must remove the cover film 28, which is sealing the opening 12*e*, by pulling it by hand. As long as the operator pulls the cover film 28 in the direction parallel to the direction in which the operator is supposed to pull the cover film 28 (the same direction as the length direction of the opening 12*e*), there will be no problem. However, if the cover film 28 is pulled at an angle of a relative to the normal direction in which the cover film 28 should be pulled, as shown in FIG. 16, the cover film 28 is drawn to one side as shown in FIG. 17 (upward of FIG. 17), being irregularly folded. If the cover film 28 is pulled further in this condition, it is possible that the irregular folds of the cover film 28 will rub against the toner leakage prevention seal 29, and tear the toner leakage prevention seal 29 (hatched portion in FIG. 17). If the toner leakage prevention seal 29 is torn, it is possible that the toner will leak through the gaps resulting from the tearing of the toner leakage prevention seal 29, and will soil the hands of the operator, and/or will scatter within the apparatus main assembly and soil the recording media on which recording has been made. In comparison, when the toner leakage prevention seal 29, on the side from which the cover film 28 is pulled out, is provided with the tearing prevention sheet 29*a* as it is in this embodiment, even if irregular folds occur to the cover film 28 as described above when the cover film 28 is pulled out, the tearing prevention sheet 29*a* protects the seal 29, preventing the seal 29 from being torn. Therefore, there is no possibility, regardless of the direction in which the cover film 28 is pulled, that the toner will leak.

Further, the placement of the tearing prevention sheet 29*a* on the opening 12*e* side of the seal 29 in terms of the short dimension direction of the seal 29 causes the tearing prevention sheet 29*a* to scrape away the toner adhering to the cover film 28 as the cover film 28 is pulled out. Therefore, it does not occur that the hands of the operator are soiled by the extracted cover film 28.

Incidentally, as the toner holding frame 12 and developing means holding frame 13 are joined by welding, the toner leakage prevention seal 29 and tearing prevention sheet 29*a* are pinched by the frames 12 and 13, at their top and bottom ends (ends in terms of vertical direction in FIG. 11), in terms of the direction perpendicular to the direction in which the cover film 28 is pulled out, being thereby firmly secured. Therefore, it does not occur that the sheet 29*a* becomes dislodged from the seal 29.

Figure 18:
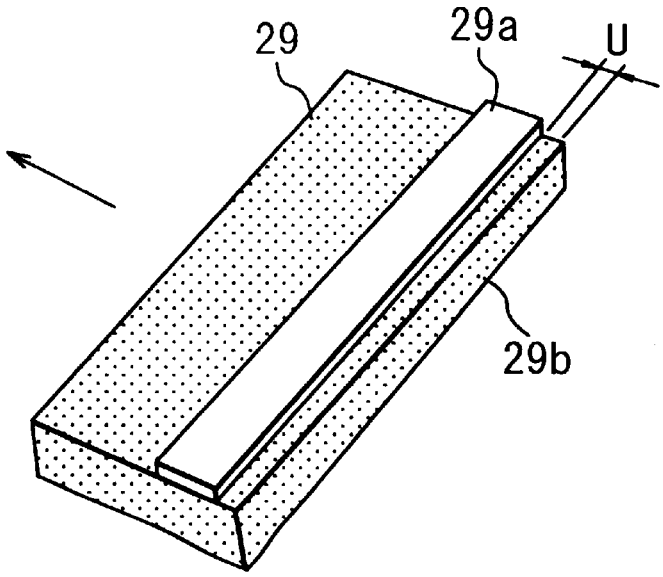
FIG. 18 is a perspective view of a tearing prevention sheet 29*a* and a toner leakage prevention seal 29, for showing that the tearing prevention sheet 29*a* is pasted on the toner leakage prevention sheet 29, a predetermined distance inward of the edge of the seal 29.

The material for the tearing prevention sheet 29*a* is desired to be highly resistant to the abrasion which is associated with the rubbing of the tearing prevention sheet 29*a* by the cover film 28. For example, polyethylene terephthalate, high density polyethylene sheet, and the like are suitable. Referring to FIG. 18, it is recommended that the tearing prevention sheet 29*a*, which is narrower in its short dimension direction than the toner leakage prevention seal 29, is pasted to the toner leakage prevention seal 29, a predetermined distance U inward of the edge 29*b* of the toner leakage prevention seal 29, on the side from which the cover film 28 is pulled out. Such a positional arrangement enables the edge 29*b* to more effectively scrape away the toner adhering to the cover film 28, when the cover film 28 is pulled out. Further, as long as the predetermined distance U is set to be no more than approximately 5 mm, the effectiveness of the tearing prevention sheet 29*a* in preventing the toner leakage prevention seal 29 from tearing when pulling out the cover film 28 does not decrease. The tearing prevention sheet 29*a* does not need to be narrower in its short dimension direction than the toner leakage prevention seal 29 as described above; it may be wide enough to cover the entire surface of the seal 29.

(Cleaning Means)

The cleaning means 11 is a means for removing the toner remaining on the photosensitive drum 7 after the toner image on the photosensitive drum 7 is transferred onto the recording medium 2 by the transferring means 4. Referring to FIG. 3, the cleaning means 11 comprises: a cleaning blade 11*a*, which is placed in contact with the peripheral surface of the photosensitive drum 7 to scrape away the toner remaining on the photosensitive drum 7, or the residual toner; a receptor sheet 11*b*, which is located below the blade 11*a* and is placed in contact with the peripheral surface of the photosensitive drum 7 to catch the residual toner scraped away from the photosensitive drum 7; and a removed residual toner bin 11*c* in which the removed residual toner is collected. The receptor sheet 11*b* is placed in contact with the peripheral surface of the photosensitive drum 7 with the application of only a slight pressure, so that the residual toner adhering to the peripheral surface of the photosensitive drum 7 is allowed to pass by the receptor sheet 11*b*, but the residual toner, which has been removed from the peripheral surface of the photosensitive drum 7 by the blade 11*a*, can be caught and guided away from the peripheral surface of the photosensitive drum 7, by the receptor sheet 11*b*. The cleaning blade 11*a* comprises a blade 11*a* formed of rubber or the like, and a blade anchoring member 11*d* formed of metallic plate or the like, to which the blade 11*a* is pasted with the use of double-sided adhesive tape or the like, as does the development blade 10*e*. The cleaning blade 11*a* is attached to the cleaning means holding frame 14 by screwing the blade anchoring member 11*d* to the cleaning means holding frame 14. The receptor sheet 11*b* is pasted to a receptor sheet pasting surface (edge portion) 11*c*1 with the double-sided adhesive tape or the like.

Figure 19:
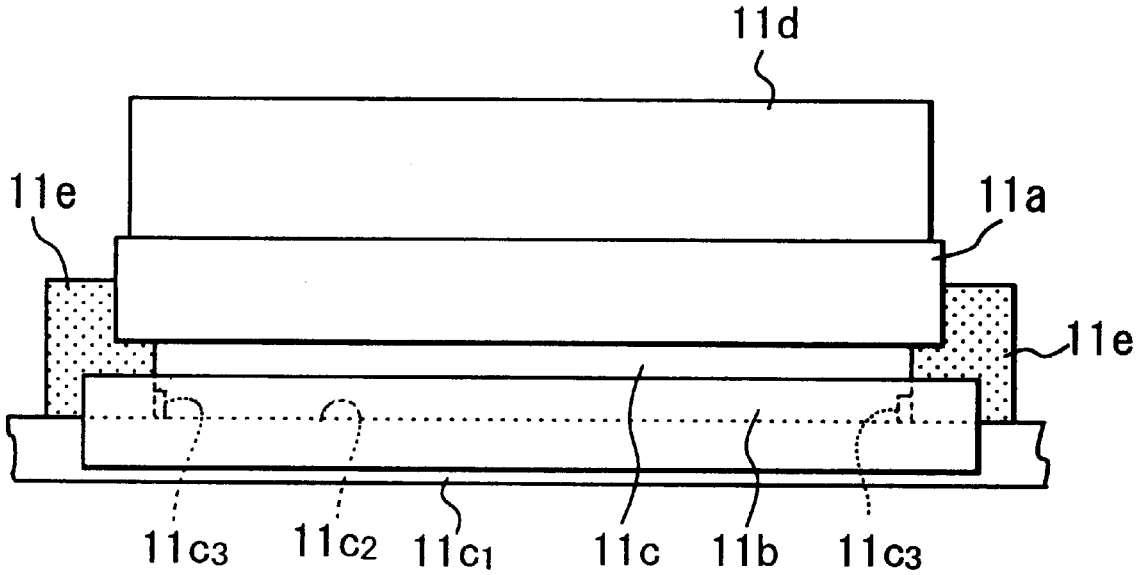
FIG. 19 is a front view of the toner leakage prevention seals and a partition-like member 11*c*3, which are located at both ends of the cleaning blade in terms of the length direction.
Figure 20:
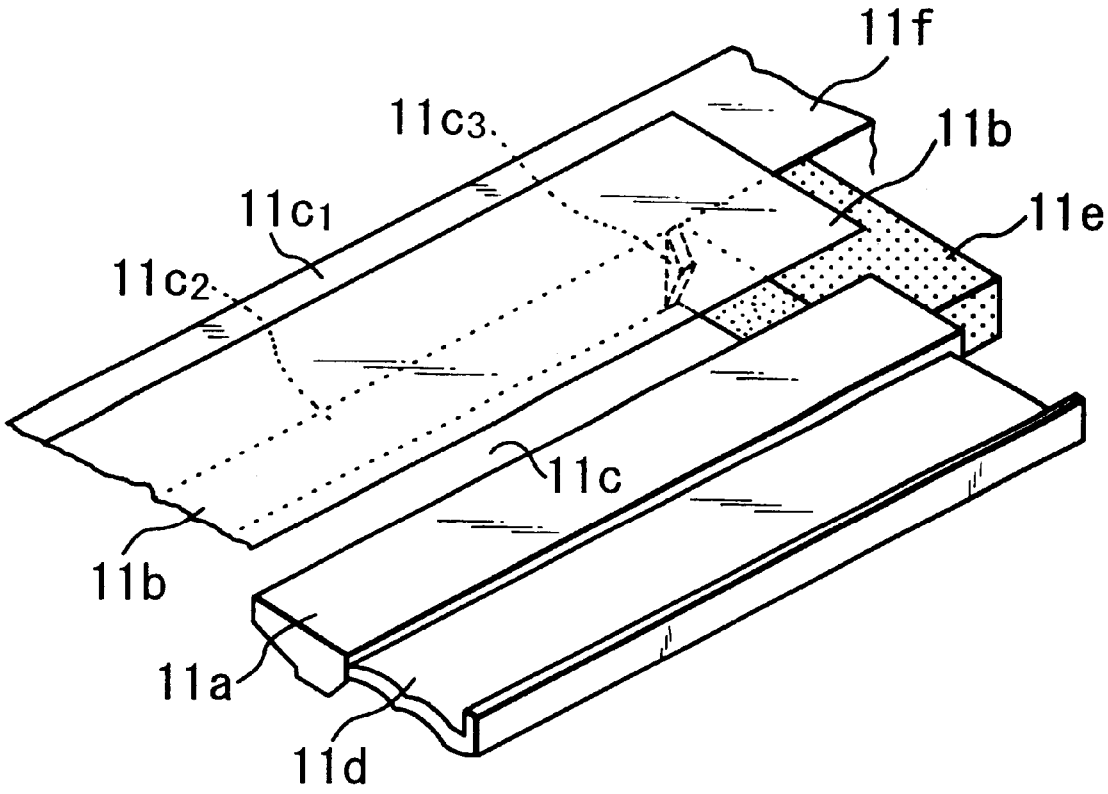
FIG. 20 is a perspective view of the toner leakage prevention seals and partition-like member 11*c*3, which are located at both ends of the cleaning blade in terms of the length direction.

The residual toner in the removed residual toner bin 11*c* must be prevented from leaking from the ends of the cleaning blade 11*a* in terms of the length direction, and the portions of the cleaning means holding frame 14, which oppose the ends of the cleaning blade 11*a*. Thus, a toner leakage prevention seal is pasted to the both ends of the cleaning blade 11*a* in terms of the length direction. The blade 11*a* and toner leakage prevention seal must be absolutely airtightly in contact with each other. Otherwise, the toner will leak through the gaps between the blade 11*a* and toner leakage prevention seal. Similarly, the toner leakage prevention seal and the receptor sheet pasting surface 11*c*1 of the removed residual toner bin 11*c*, to which the receptor sheet 11*b* is pasted, must be absolutely airtightly in contact with each other. Otherwise, the toner will leak through the gaps between them. Thus, in this embodiment, a toner leakage prevention seal 11*e* is provided at both ends of the cleaning blade 11*a* in terms of the length direction, as shown in FIG. 19. To describe in more detail the structures of this seal 11*e* and its adjacencies, referring to FIGS. 19 and 20, the seals 11*c* are pasted to both fringe portions, one for one, of the removed residual toner bin 11*c* in terms of the length direction, and to these seals 11*e*, the corresponding end portions of the cleaning blade 11*a* in terms of the length direction are pasted. Further, the removed residual toner bin 11*c* is provided with partition-like members 11*c*3, which project from the top edge 11*c*2 of the removed residual toner bin 11*c* so that the inward surfaces of the seals 11*e* contacts them.

(Frame)

Next, the frame of the process cartridge B, which constitutes the housing portion of the process cartridge B, will be described. Referring to FIG. 7, the frame of the process cartridge B comprises three frames: the toner holding frame 12, developing means holding frame 13, and cleaning means holding frame 14. The toner holding frame 12 and developing means holding frame 13 are united by welding, forming a toner/developing means holding unit C, which is connected to the cleaning means holding frame 14, as described later, to form the compound frame of the process cartridge B. The frames 12, 13, and 14 in this embodiment each are formed as a single piece component of polystyrene resin by injection molding. As for the material for the frames 12, 13, and 14, those which are close to toner components in chargeability are recommendable. The usage of such material eliminates the possibility that the toner will be charged to abnormal polarity by the friction between the toner and the internal surfaces of the frames during image formation, and therefore, eliminates the possibility that image quality will be reduced by the toner charged to the abnormal polarity.

Figure 21:
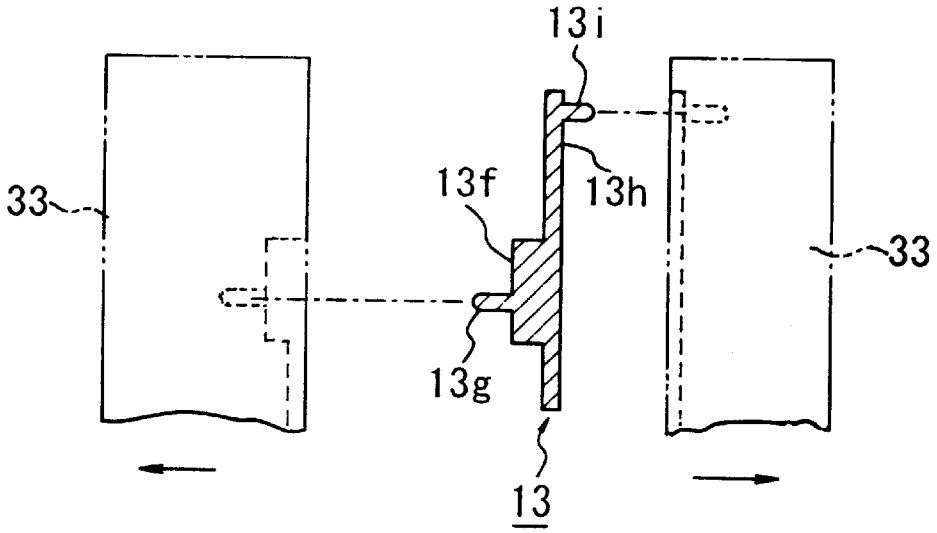
FIG. 21 is a drawing for depicting the manner in which the developing means holding frame is removed from its mold.

Next, referring to FIG. 7, the toner holding frame 12 is provided with the toner storing bin 10*a* and toner sending member 10*b*. Referring to FIGS. 3 and 4, the external surface of the toner holding frame 12 is provided with a plurality of cross ribs 12*d* which extend in the length direction of the toner holding frame 12, constituting a handhold portion. Those cross ribs 12*d* on the downwardly facing external surface of the toner holding frame 12 are made slightly different in dimension in terms of its shorter dimension direction from the adjacent ones, so that the line connecting the tips of those cross ribs 12*d* in FIG. 13 forms an R-shaped curvature. Thus, the hand which holds the process cartridge B by the toner holding frame 12 is not likely to slip from the toner holding frame 12 when mounting or dismounting the process cartridge B into or from the image forming apparatus A. Further, the downwardly facing portion of the toner holding frame 12 is easy to grasp by hand. Therefore, the process cartridge B can be more efficiently mounted into or dismounted from the image forming apparatus A. Also referring to FIG. 7, the developing means holding frame 13 is provided with the development sleeve 10*d* and development blade 10*e*. Next, referring to FIG. 11, the development blade 10*e* is attached to the developing means holding frame 13 by screwing the blade anchoring member 10*j* to the developing means holding frame 13 by both end portions in terms of the length direction. In this embodiment, the blade anchoring member 10*j* is accurately positioned relative to the developing means holding frame 13 before the screwing. For this purpose, the blade anchoring surface 13*f* of the developing means holding frame 13 is provided with a pair of positioning joggles 13*g*, which project perpendicular to the surface 13*f* and are fitted into a pair of holes with which the blade anchoring member 10*j* is provided, to accurately position the blade anchoring member 10*j*. Next, referring to FIGS. 7 and 11, the surface 13*h* of the developing means holding frame 13, which is joined with the corresponding surface of the toner holding frame 12, is provided with a pair of positioning joggles 13*i* (which are located at both ends of the developing means holding frame 13, one for one, in terms of the length direction, as shown in FIG. 11), which are fitted into a pair of holes 12*c* on the toner holding frame 12 side to accurately position the developing means holding frame 13 and toner holding frame 12 relative to each other. In this embodiment, the developing means holding frame 13 is structured so that the aforementioned blade anchoring surface 13*f* and the surface 13*h* of the developing means holding frame 13, which is joined with the corresponding surface of the toner holding frame 12, become parallel to each other, and therefore, the blade positioning joggles 13*g* and toner holding frame positioning joggles 13*i* become parallel to each other, as shown in FIG. 21. Thus, a mold 33 for the developing means holding frame 13 can be simplified in structure; the mold 33 may be structured in two pieces which can be simply separated in the left and right directions in FIG. 21 after the molding of the developing means holding frame 13.

Figure 22:
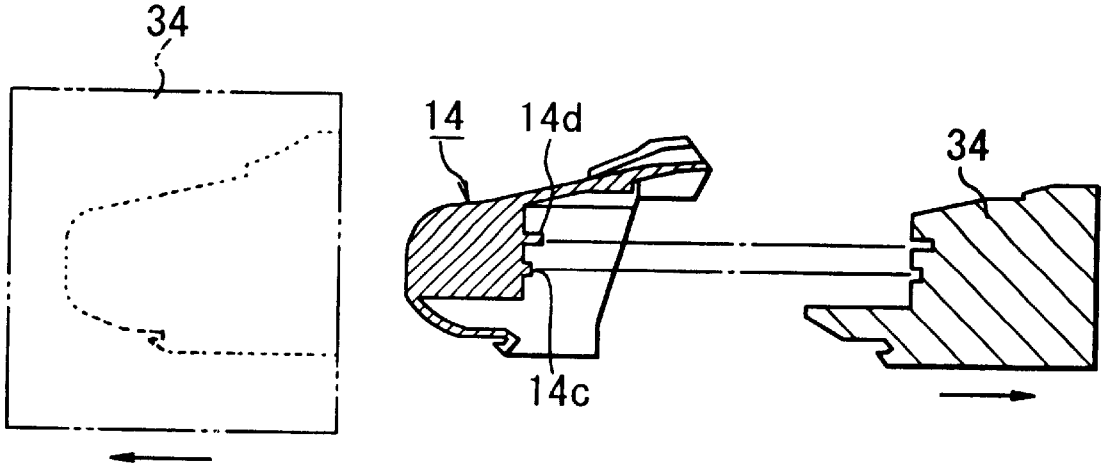
FIG. 22 is a rough vertical sectional view of the cleaning means holding frame and its mold, for showing the manner in which the cleaning means holding frame is removed from the mold.

Next, referring to FIG. 7, the cleaning means holding frame 14 is provided with the photosensitive drum 7, the charge roller 8, the cleaning blade 11*a* as the cleaning means 11, the receptor sheet 11*b*, and the removed residual toner bin 10*a*. The cleaning blade 11*a* is attached to the cleaning means holding frame 14 by screwing the blade anchoring member 11*d* to the cleaning means holding frame 14 by the portions adjacent to the ends in terms of the length direction, as is the development blade 10*e*. Also, as is the development blade 10*e*, the blade anchoring member 11*d* is accurately positioned relative to the cleaning means holding frame 14 before the former is screwed to the latter. Thus, the blade anchoring surface 14*c* of the cleaning means holding frame 14 is provided with a pair of positioning joggles 14*d*, which project from the surface 14*c* perpendicular to the surface 14*c*, and are fitted into a pair of holes (unshown) with which the blade anchoring member 11*d* is provide for the aforementioned positioning. The cleaning means holding frame 14 is configured so that the blade anchoring surface 14*c* becomes perpendicular to the direction in which the mold 34 is moved to release the molded cleaning means holding frame 14, as shown in FIG. 22. This arrangement makes the direction in which the positioning joggles 14*d* project from the blade anchoring surface 14*c* coincide with the direction in which the mold 34 is moved to release the molded cleaning means holding frame 14 from the mold, simplifying the structure of the mold 34.

To the cleaning means holding frame 14, the drum shutter 35 shown in FIG. 3 is rotationally attached. The drum shutter 35 is a shutter for covering or exposing the opening provided for allowing the photosensitive drum 7 and transfer roller 4 to directly oppose each other. It automatically opens as the process cartridge B is mounted into the image forming apparatus A, and automatically closes as the process cartridge B is dismounted from the image forming apparatus A, as will be described later.

(Welding of Toner Holding Frame to Developing Means Holding Frame)

At this time, the joining of the toner holding frame 12 and developing means holding frame 13 will be described. The two frames are joined by ultrasonic welding. More specifically, first, the cover film 28 is pasted to the toner holding frame 12 in a manner to seal the opening 12*e*. Then, the toner holding frame 12 is set in the recess 75*a* of a holding jig 75, and the cover film tab 12*f*, which is an integrally formed part of the toner holding frame 12 and can be severed from the toner holding frame 12, is bent downward. Next, the developing means holding frame 13 is placed on top of the toner holding frame 12, and is held down from above by a pressing jig 76. In this state, the ultrasonic waves are applied to the toner holding frame 12 and developing means holding frame 13. As a result, ribs 13*s* (FIG. 7) extending on the surface of the developing means holding frame 13, which is to be joined with the corresponding surface of the toner holding frame 12, in the length direction, melt and weld to the corresponding surface of the toner holding frame 12, permanently joining the two frames 12 and 13.

Figure 23:
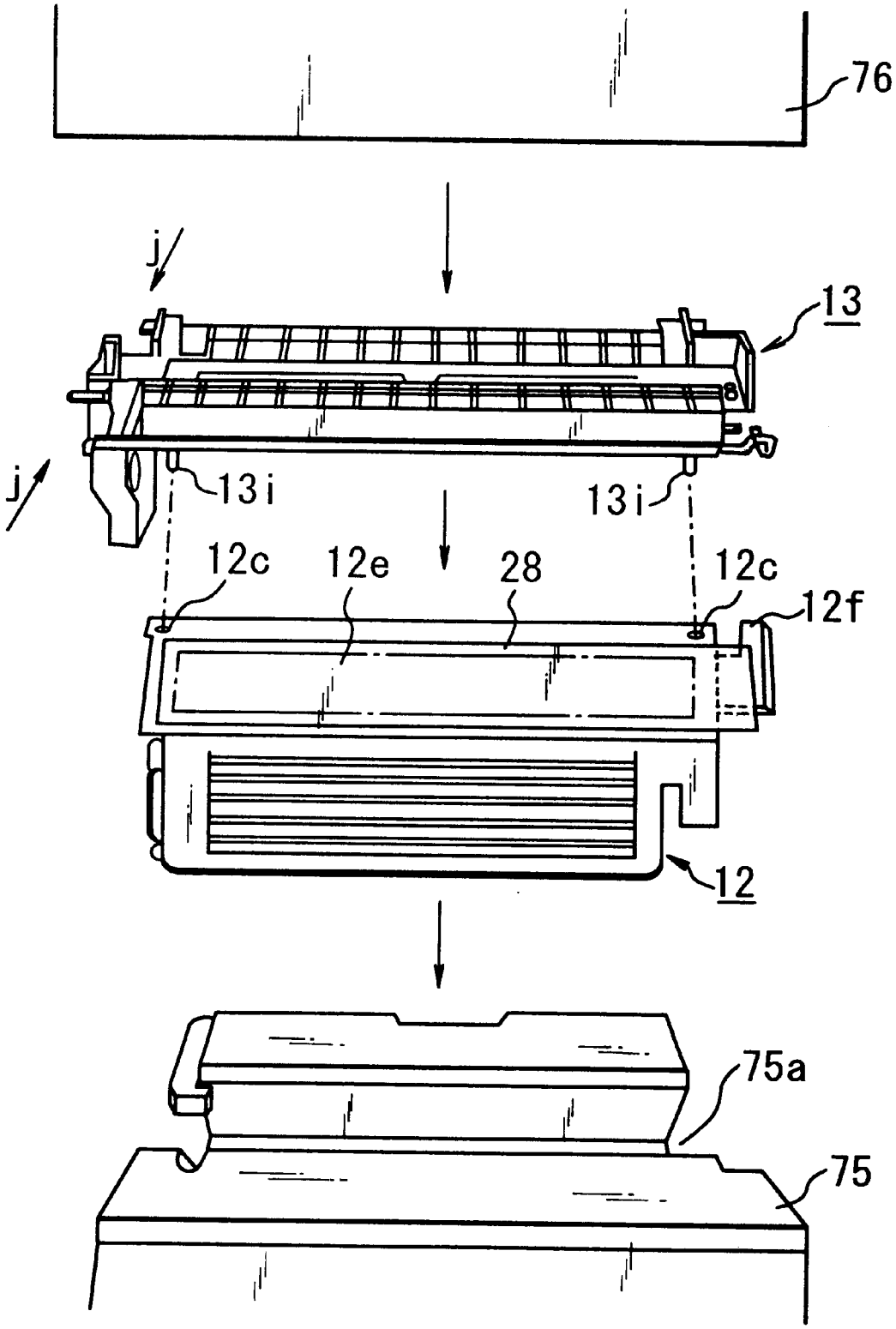
FIG. 23 is a perspective view of the toner holding frame and developing means holding frame, for describing the process in which the two frames are welded to each other by ultrasonic welding.

While ultrasonic waves are applied, the two frames 12 and 13 are likely to deform in their width direction (which is indicated by an arrow mark J in FIG. 23). In this embodiment, however, the developing means holding frame 13 is provided with reinforcement ribs 13*t* which extend in the width direction in parallel to each other, and are positioned at intervals in the length direction, as shown in FIG. 11. Further, the blade anchoring member 10*j* formed of metallic plate or the like is attached to the developing means holding frame 13. Therefore, the developing means holding frame 13 is well reinforced and is not likely to deform. On the other hand, the toner holding frame 12 is not provided with the aforementioned reinforcement ribs or the like. Therefore, it is structurally weak, and generally, it is likely to deform. In this embodiment, however, the toner holding frame 12 is provided with a pair of brims 12*g*, which are located, one for one, at the ends, in terms of the width direction, of the surface of the toner holding frame 12, which faces the developing means holding frame 13, as shown in FIGS. 7 and 11. The distance L12 between the two brims 12*g* is approximately equal to the length L13, in terms of the width direction, of the surface 13*h* of the developing means holding frame 13, which is to be joined with the counterpart of the toner holding frame 12, and the surface 13*h* of the developing means holding frame 13 fits between the two brims 12*g*. Further, when the frames 12 and 13 are joined by ultrasonic welding, the surface 13*h* of the developing means holding frame 13 is between the two brims 12*g* of the toner holding frame 12, and the positioning joggles 13*i* of the developing means holding frame 13 are in the holes 12*c* of the toner holding frame 12. Therefore, the toner holding frame 12 is also not likely to deform, and the two frames 12 and 13 are not likely to dislodge from each other.

Further, in this embodiment, the frames 12, 13, and 14 are all formed of the same material, or polyethylene resin. Therefore, the welding seam between the frames 12 and 13 is very high in bonding strength. The developing means holding frame 13 and cleaning means holding frame 14 are not welded to each other. Therefore, from the standpoint of increasing the bonding strength, it is not always necessary that cleaning mean holding frame 14 is formed of the same material as the material for the toner holding frame 12 and developing means holding frame 13.

Figure 24:
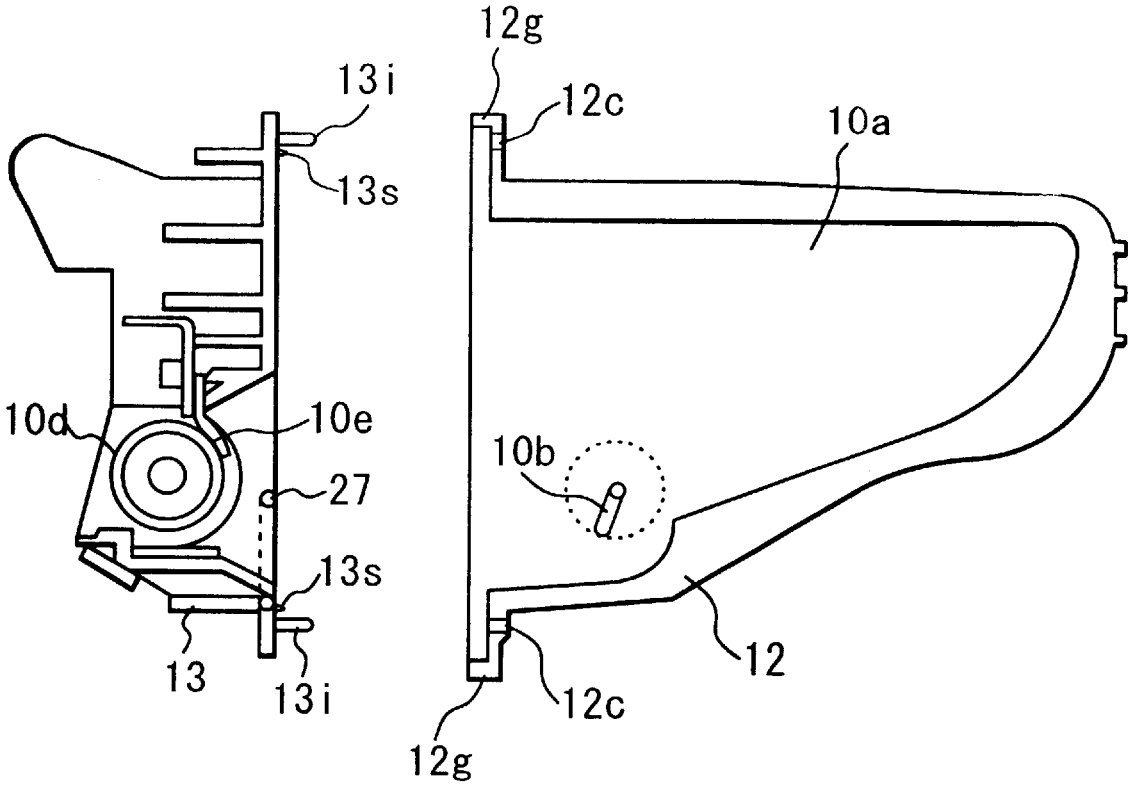
FIG. 24 is a vertical section of the toner holding frame and developing means holding frame which have positioning holes and positioning joggles, respectively, at both ends of them in terms of their width direction.
Figure 25:
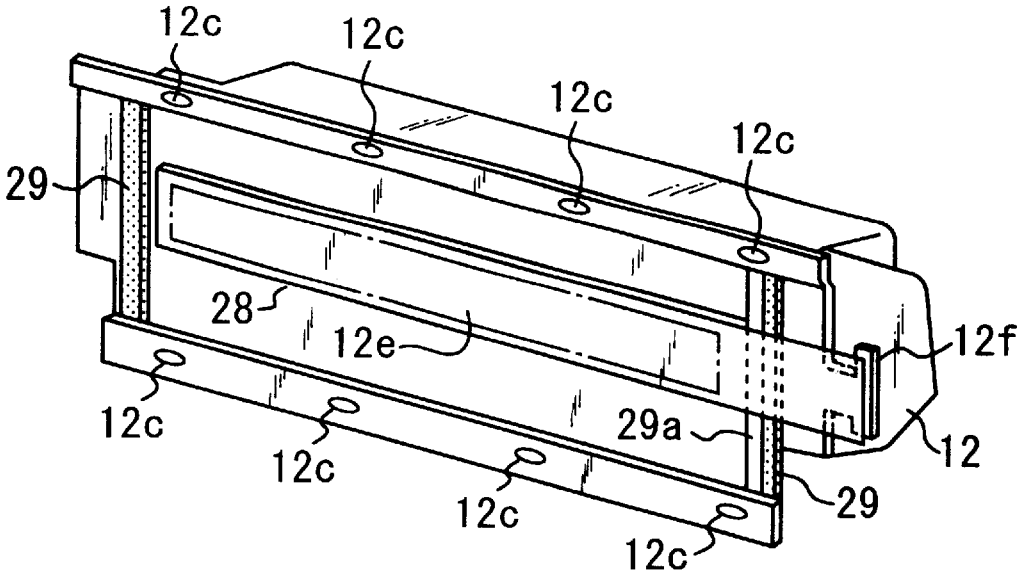
FIG. 25 is a perspective view of the toner holding frame, for depicting a case in which both ends of the toner holding frame and both ends of the developing means holding frame, in terms of the width direction, are provided with a plurality of the positioning holes and positioning joggles, respectively, which are aligned in the length direction.

In this embodiment, the positioning joggles 13*i* are provided at only one end of the developing means holding frame 13 in terms of the width direction as described above. However, the positioning joggles 13*i* may be provided at both ends of the developing means holding frame 13 in terms of the width direction as shown in FIG. 24. Such an arrangement further assures that the toner holding frame 12 and developing means holding frame 13 are prevented from deforming, and also from dislodging from each other, while they are welded to each other. Further, referring to FIG. 25, the developing means holding frame 13 and toner holding frame 12 may be provided with more than two positioning joggles (unshown), and a corresponding number of holes 12*c* into which the positioning joggles fit, respectively, which align in the length direction of the frames. Such an arrangement further assures that the deformation and dislodging of the frames are prevented. In this case, it is unnecessary for the end portions of the toner holding frame 12 to be provided with the aforementioned two brims 12*g*, one for one.

Figure 26:
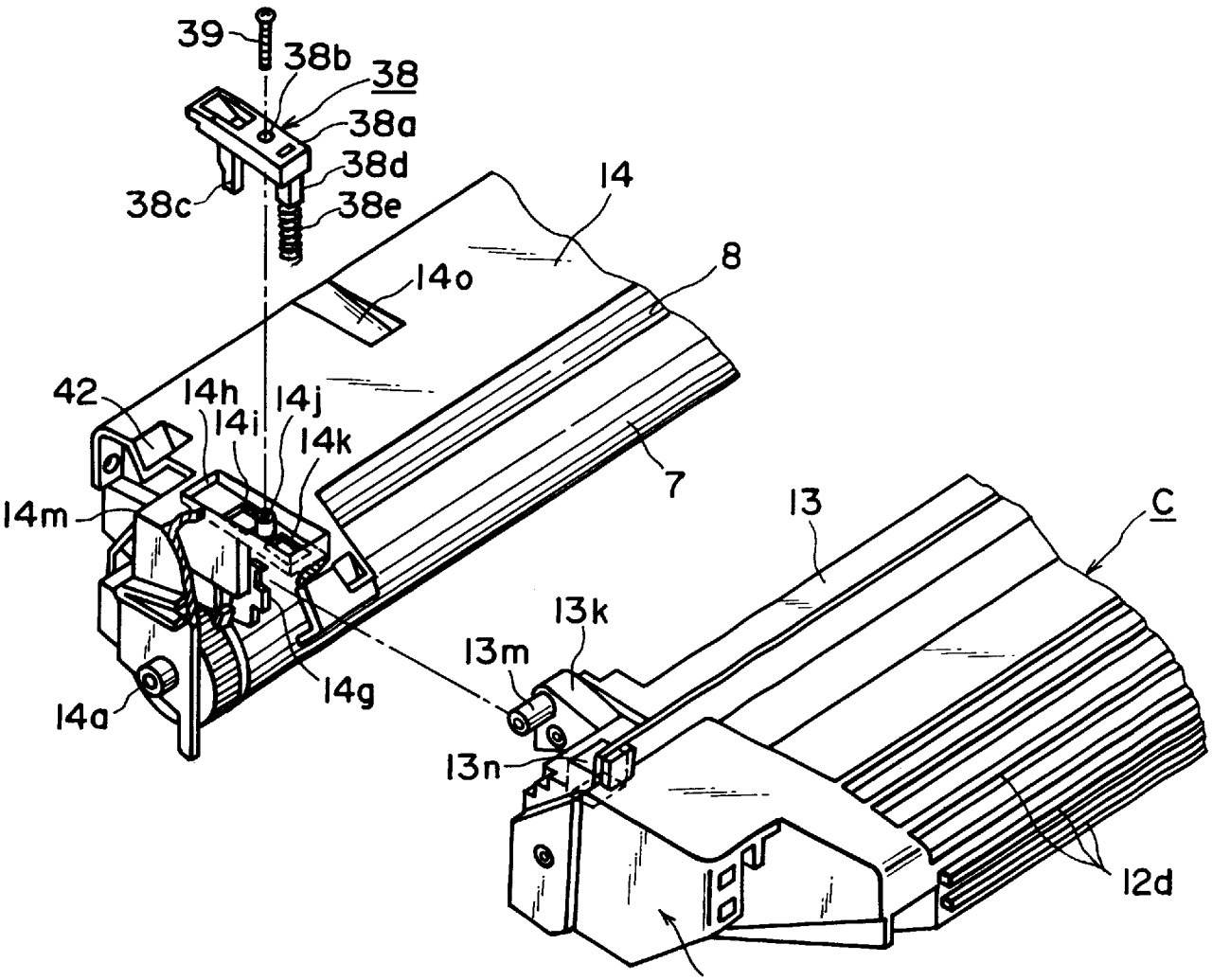
FIG. 26 is a partially exploded perspective view of a connecting member, the toner holding frame, and the cleaning means holding frame, before the two frames are connected by the connecting member.

Next, various components are assembled into the toner holding frame 12 and developing means holding frame 13, which have been welded into a single unit, and the cleaning means holding unit. Then, the combination of the toner holding frame 12 and developing means holding frame 13, that is, the toner/developing means holding unit, is connected to the cleaning means holding frame 14 by the developing means holding frame 13 side to complete the assembly of the process cartridge B. Referring to FIG. 26, the frames 13 and 14 are connected with the use of a pair of connecting members 38. Next, the structural arrangement for connecting the two frames will be described.

Referring to FIG. 26, each connecting member 38 comprises: a main structure 38*a*, a perpendicular portion 38*c*, and a spring mounting portion 38*d*. The main structure 38*a* has a screw hole 38*b* through which a small screw 39 is put, and the perpendicular portion 38*c* and spring mounting portion 38*d* are located on the opposing sides with respect to the screw hole 38*b*. The perpendicular portion 38*c* projects downward from the main structure 38*a* to prevent a connective projection of the developing means holding frame 13, which will be described later, from becoming dislodged. The spring mounting portion 38*d* is parallel to the perpendicular portion 38*c*, and a compression coil spring 38*e* is mounted at the end of the spring mounting portion 38*d* in a manner to extend downward farther than the perpendicular portion 38*c*.

Each end of the developing means holding frame 13 in terms of the length direction is provided with an arm portion 13*k*, which is provided with a connective projection 13*m*, which projects outward in the length direction, and a spring seating recess 13*n*, which is in the upwardly facing surface of the arm portion 13*k*. On the other hand, each end of the cleaning means holding frame 14 is provided with a connective recess 14*g* into which the aforementioned connective projection 13*m* fits, and an anchoring portion 14*h*, which is above the connective recess 14*g*. The anchoring portion 14*h* is provided with a hole 14*i* into which the perpendicular portion 38*c* of the connecting member 38 fits, a female threaded portion 14*j* into which the small screw 39 is screwed, and a through hole 14*k* through which the spring 38*e* is put.

Figure 27:
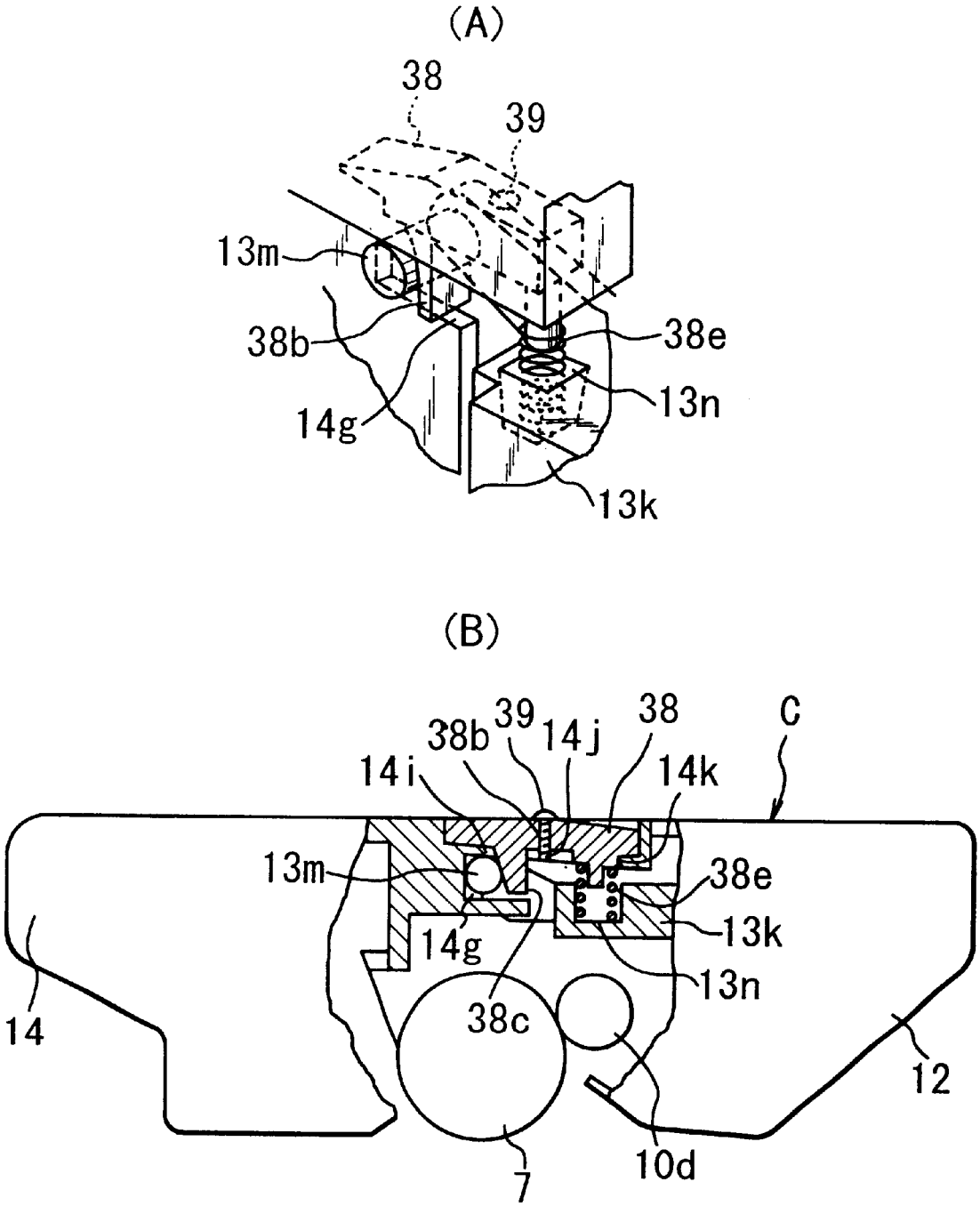
FIGS. 27(A) and 27(B) are a perspective view, and a sectional view, respectively, of the connecting member and its adjacencies after the attachment of the connecting member.

Referring to FIG. 27(A), which is a perspective view of the connecting member 38, and FIG. 27(B), which is a sectional view of the connecting member 38 and its adjacencies, the toner/developing means holding unit C and cleaning means holding frame 14 are connected in the following manner. First, the connective projection 13*m* of the developing means holding frame 13 is fitted all the way into the connective recess 14*g* of the cleaning means holding frame 14. Then, the connecting member 38 is fitted into the anchoring portion 14*h* and secured. More specifically, the perpendicular portion 38*c* of the connecting member 38 is fitted into the hole 14*i*, and the spring 38*e* is put through the through hole 14*k* and fitted into the spring seating recess 13*n*, being thereby compressed. Then, the small screw 39 is put through the screw hole 38*b*, and screwed into the female threaded portion 14*j*. As a result, the toner/developing means holding unit C and cleaning means holding frame 14 are connected to each other in such a manner that they are allowed to pivot about the connective projection 13*m*. This concludes the assembly of the process cartridge B. In this state, that is, with the frames 13 and 14 connected to each other, the contact rings 10*f* are kept in contact with the peripheral surface of the photosensitive drum 7, maintaining a predetermined amount of contact pressure; in other words, the positional relationship between the photosensitive drum 7 and development sleeve 10*d* is accurately maintained. The development sleeve 10*d* is kept pressed toward the photosensitive drum 7 by the resiliency of the compression springs 38*e* (in this embodiment, the strength of the compression spring 38*e* is set at approximately 2 kg so that a force of approximately 1 kg is applied to the development sleeve 10*d*).

As the toner/developing means holding unit C and cleaning means holding frame 14 are connected, the helical gear 7*c* located at one end of the photosensitive drum 7 meshes with the gear 10*g* located at the same end of the development sleeve 10*d*.

In the structural arrangement, in this embodiment, for connecting the toner/developing means holding unit C with the cleaning means holding frame 14, the toner/developing means holding unit C can be engaged with or disengaged from the cleaning means holding frame 14 in the direction in which the connective recess 14*g* opens. Therefore, the connective projections 13*m* can be configured to project outward (or inward) in the length direction. Such configuration of the connective projections 13*m* fixes the positional relationship between the two frames 13 and 14 in terms of the length direction (thrust direction), eliminating the need for a thrust stopper. Further, the connecting members 38 are inserted from above and secured, and therefore, as the connecting members 38 are secured, pressure begins to be applied to the toner/developing means holding unit C. In a conventional process cartridge, however, a pair of tension springs must be attached to the toner/developing means holding unit C and the cleaning means holding frame in a manner to be stretched between the two after the two are connected. Therefore, it is necessary to provide the frames with spaces in which the tension springs are externally mounted. Further, an operation for attaching the tension spring is laborious. In comparison, the structural arrangement in this embodiment eliminates the laborious operation for attaching the tension springs, the need for the tension spring attachment spaces, and the like, in other words, it eliminates the problems of a conventional process cartridge.

Further, as the small screw 39 which is securing the connecting member 38 is loosened when disassembling the process cartridge B, the pressure being applied by the compression coil is gradually reduced. In addition, there is no thrust stopper. Therefore, disassembly is very simple.

(Cartridge Mounting Structure)

Next, the structure for mounting the process cartridge structured as described above into the apparatus main assembly 15 will be described.

Figure 28:
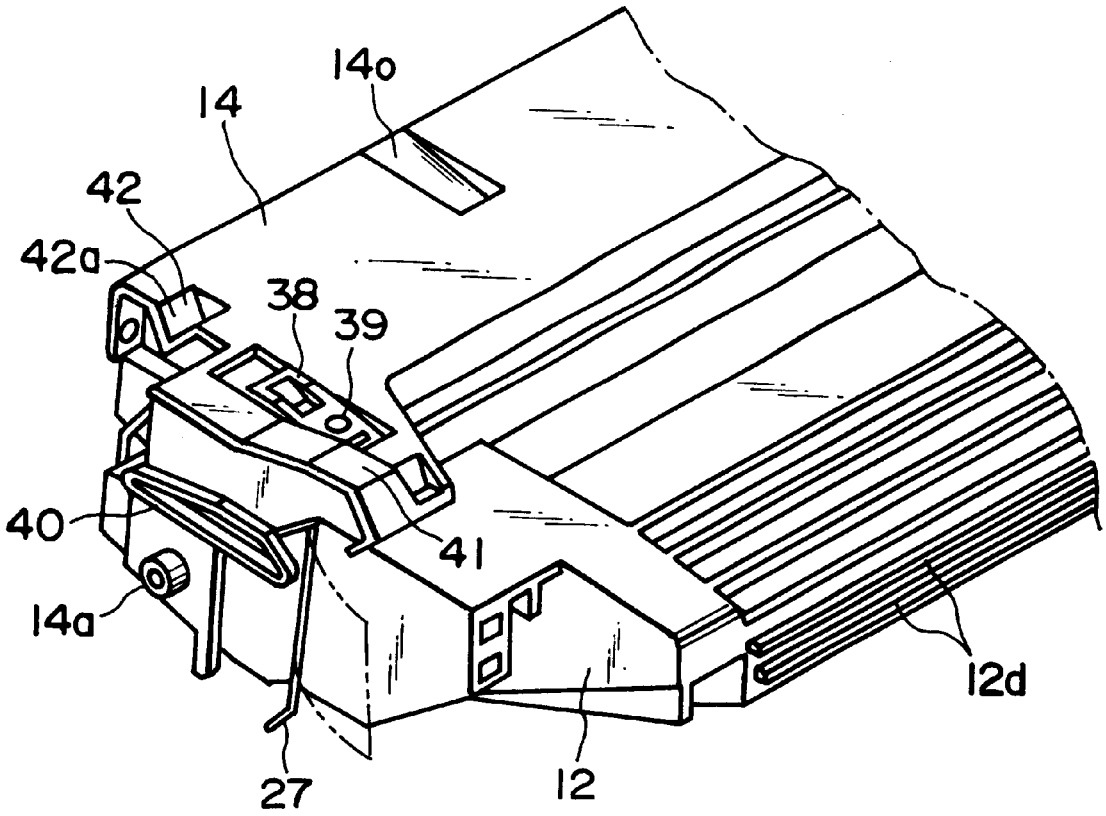
FIG. 28 is a perspective view of the left side of the process cartridge.

Referring to FIGS. 5 and 6, it has been previously described that the apparatus main assembly 15 is provided with left and right guiding members 17 and 18, which comprise first guiding portions 17*a* and 18*a*, second guiding portions 17*b* and 18*b*, and the like. In comparison, referring to FIGS. 4 and 28, which are right and left side views of the process cartridge B, the process cartridge B is provided with a shaft 21, and bearing portions 14*a* which project outward in the length direction from the ends of the process cartridge B in terms of the length direction, and are guided along the guiding portions 18*a* and 17*a*, respectively. The right and left points of the process cartridge B from which the shaft 21 and bearing portion 14*a* project in the length direction are approximately symmetrically located with respect to the center line of the process cartridge B perpendicular to the length direction. Also the process cartridge B is provided with a pair of primary ribs 40, which perpendicularly project outward in the length direction from the ends of the process cartridge B in terms of the length direction, being symmetrical to each other with respect to the aforementioned center line of the process cartridge B, and are guided along the second guiding portions 18*b* and 17*b*. The cleaning means holding frame 14 is provided with a pair of pressure catching surfaces 41, which are located on the top surfaces of the end portions of the cleaning means holding frame 14 in terms of the length direction, and are pressed by a pair of pressing members 19 attached to the apparatus main assembly 15, and a pair of positioning grooves 42, into which the aforementioned process cartridge positioning projections 20 engage; as the process cartridge projections 20 engage into the positioning grooves 42, the position of the process cartridge B relative to the apparatus main assembly 15 is fixed. Referring to FIG. 4, the rightwardly facing surface of the right end of the cleaning means holding frame 14 in terms of the length direction is provided with an auxiliary rib 43, which is above the primary rib 40 and projects outward in the length direction, and a linkage portion 35*a* for opening or closing the drum shutter 35. The linkage portion 35*a* is rotated by the movement of the process cartridge B, opening or closing the drum shutter 35 connected to the linkage portion 35*a*, when the process cartridge B is mounted into or dismounted from the apparatus main assembly 15. The structural arrangement for opening or closing the drum shutter 35 will be described later.

At this time, referring to FIGS. 29–32, the processes in which the process cartridge B is mounted into or dismounted from the apparatus main assembly 15 will be described. When the process cartridge B is mounted or dismounted, both left and right ends of the process cartridge B in terms of the length direction are guided by the guiding members 17 and 18, respectively, in the same manner. However, for the simplification of description, the processes will be described with reference to only the right guiding member 18.

Figure 29:
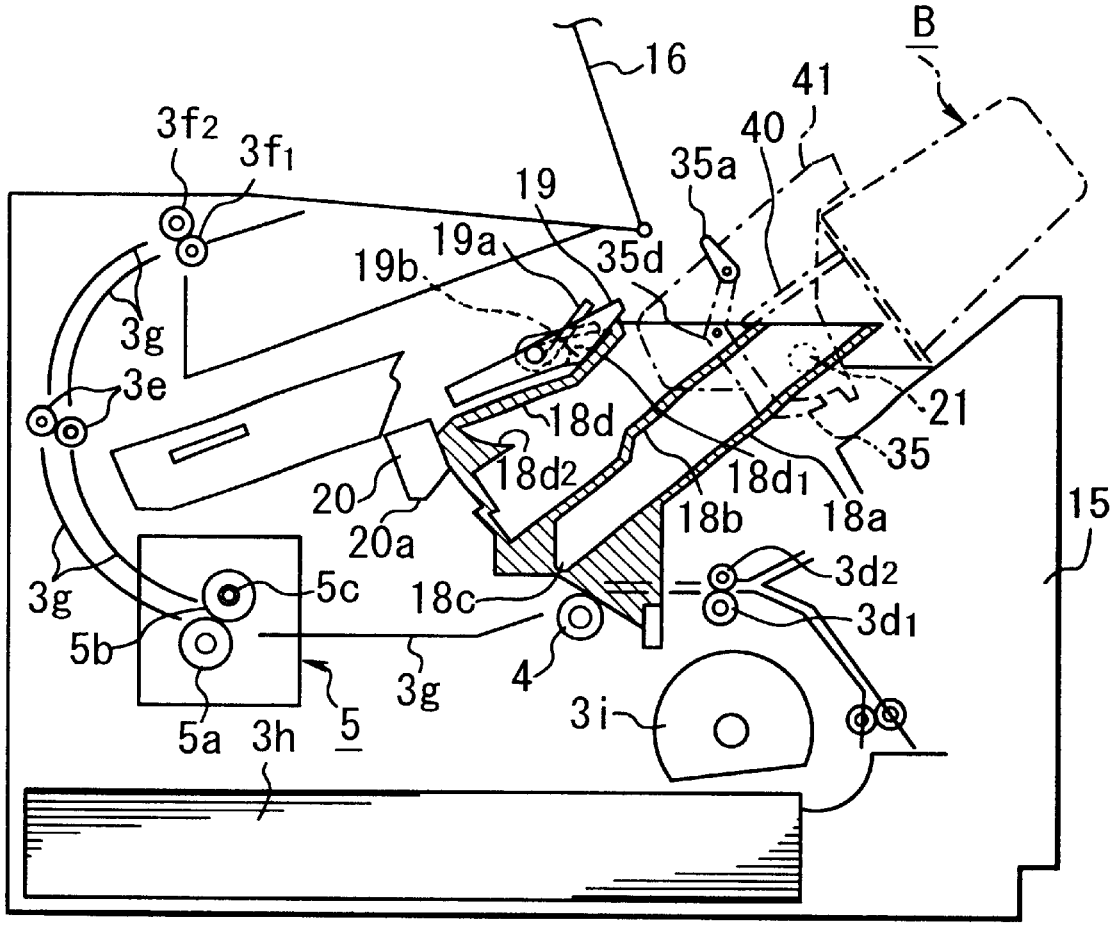
FIG. 29 is a vertical sectional view of the process cartridge and image forming apparatus, the former being mounted into the latter.

Referring to FIG. 29, first, the cover 16 of the apparatus main assembly 15 is opened. Then, the shaft 21 of the process cartridge B is rested on the first guiding portion 18*a*, and at the same time, the primary rib 40 is rested on the guiding portion 18*b*. Next, referring to FIG. 30, the process cartridge B is pushed into the apparatus main assembly 15, with the shaft 21 and primary rib 40 sliding on the guiding portions 18*a* and 18*b*. Then, as the process cartridge is pushed deeper into the apparatus main assembly, the pressing catching surface 41 of the process cartridge B is pressed by the pressing member 19, and therefore, the process cartridge B is pushed downward, with the primary rib 40 being kept pressed upon the second guiding portion 18*b*. Then, as the process cartridge B is pushed deep enough for the primary rib 40 to reach beyond the stepped portion 18*b*1 of the second guiding portion 18*b* as shown in FIG. 31, the process cartridge B is slightly rotated in the counterclockwise direction by the pressure from the pressing member 19, and therefore, the shaft 21 begins to be supported by the first guiding portion 18*a*. As the process cartridge B is pushed farther into the apparatus main assembly 15, it is rotated further in the counterclockwise direction, and therefore, the process cartridge positioning projection 20 of the apparatus main assembly 15 fits into the positioning groove 42 of the process cartridge B as shown in FIG. 32. At this point, the process cartridge B may be released from the hand of the operator. As the process cartridge B is released from the hand of the operator, the shaft 21 of the process cartridge B drops into the bearing portion 18*c*, as shown in FIG. 33. At the same time, the process cartridge positioning projection 20 fits into the positioning groove 42; the process cartridge B is mounted in the apparatus main assembly 15, remaining under the pressure from the pressing member 19. Also at the same time, the helical gear 7*c* attached to one end of the photosensitive drum 7 meshes with the driving gear 45 (FIG. 6) on the apparatus main assembly 15 side, making it possible for a driving force to be transmitted to the process cartridge B. The meshing of the helical gear 7*c* with the driving gear 45 also cushions the downward pressure applied to the process cartridge B by the pressing member 19 during the downward movement of the leading end of the process cartridge B in terms of the cartridge insertion direction which occurs during the mounting of the process cartridge B. With the provision of the above described structural arrangement, the operator who is mounting the process cartridge B can feel "clicking", which enables the operator to easily recognize that the process cartridge B has been mounted in the proper position in the apparatus main assembly 15, the moment the process cartridge B is properly mounted.

The process cartridge positioning projection 20 on the apparatus main assembly side and the positioning groove 42 on the process cartridge side are configured so that the contact surfaces 20*a* and 42*a* become approximately horizontal as the process cartridge B is properly mounted in the apparatus main assembly 15. Thus, the only thing that is important when attaching the process cartridge positioning projection 20 is to make sure that the contact surface 20*a* becomes approximately horizontal. This simplifies the design of the positioning projection 20, and the manner in which the positioning projection 20 is attached to the apparatus main assembly 15, reducing the changes for dimensional errors. In other words, it becomes easy to accurately mount the process cartridge B in the apparatus main assembly 15. Incidentally, the pressing member 19 is provided with a roller 19*b*, that is, the portion which actually contacts the pressure catching surface 41 of the process cartridge B. Therefore, while the process cartridge B is pushed into the apparatus main assembly 15, the pressure catching surface 41 of the process cartridge B is pressed by the pressing member 19 through the interposition of the roller 19*b*, reducing the frictional resistance. In this embodiment, the pressure catching surface 41 of the process cartridge B is rendered flat. However, it does not need to be flat. For example, it may be provided with ribs to reduce the size of the overall contact area between the pressure catching portion of the process cartridge B and pressing member 19 so that the frictional resistance is reduced.

As is evident from FIG. 1, which is a sectional view of the process cartridge B, and FIG. 4, which is an external view of the process cartridge B, the process cartridge B is structured so that the upwardly facing surface of the process cartridge B becomes approximately flat, and approximately parallel to the process cartridge mounting direction. Therefore, the process cartridge mounting space within the apparatus main assembly 15 can be minimized. Further, such a structural arrangement for the process cartridge B improves the process cartridge B in space utilization efficiency with respect to the toner storing bin 10*a* and removed residual toner bin 1*c*.

Figure 34:
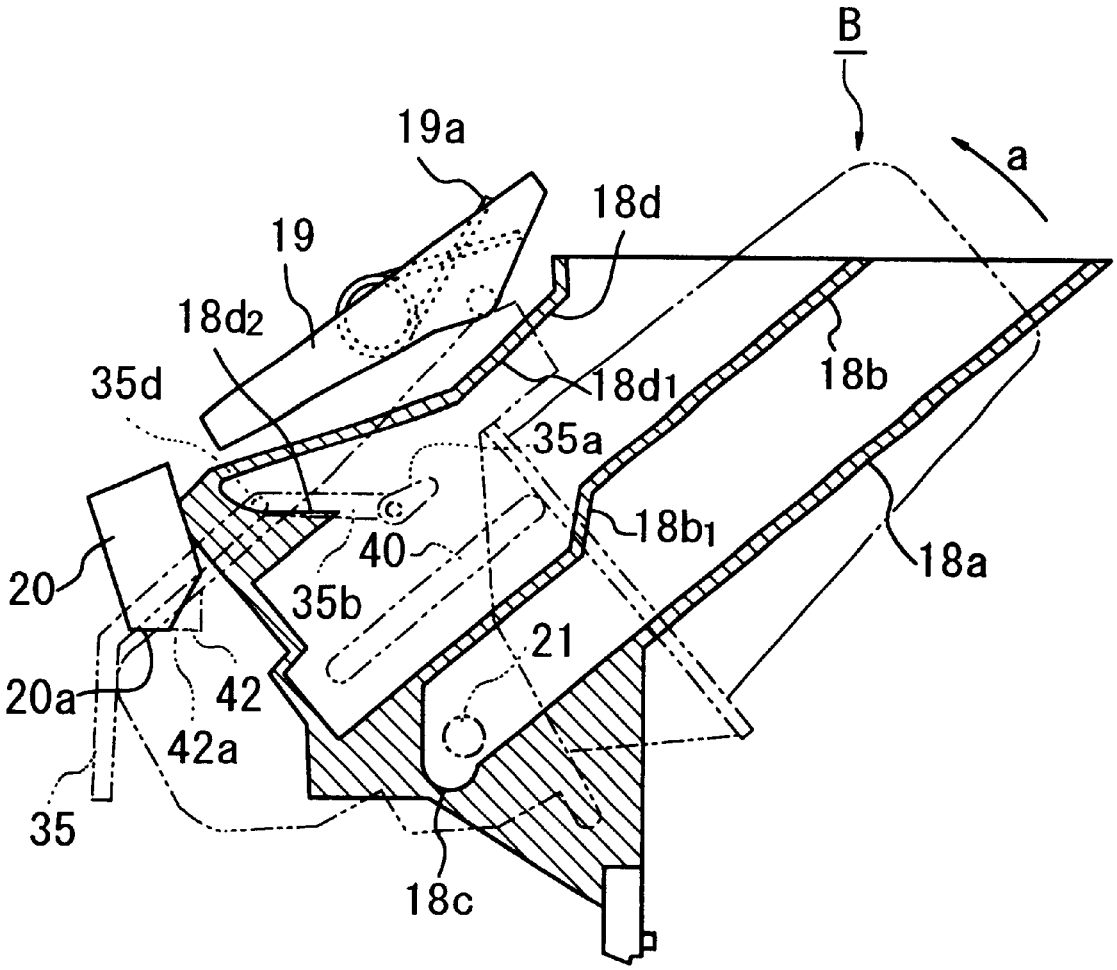
FIG. 34 is a vertical sectional view of the process cartridge and the process cartridge mounting portion of the image forming apparatus, the former being dismounted from the latter.

Next, how the process cartridge B is dismounted will be described. Referring to FIG. 34, first, the process cartridge B is slightly rotated in the counterclockwise direction (direction of arrow mark a) so that the primary rib 40 is lifted high enough to clear the stepped portion 18*b*1 of the guiding portion 18*b*. In this state, the process cartridge B can be simply pulled out of the apparatus main assembly 15. Incidentally, if an attempt is made to rotate the process cartridge B in the counterclockwise direction more than necessary, the auxiliary rib 43 (FIG. 4) comes into contact with the shutter cam portion 18*d*, and also, on the left guiding member 17 side, the primary rib 40 comes into contact with the rotation regulating guiding portion 17*d* (FIG. 5) of the left guiding member 17. As a result, the process cartridge B is prevented from rotating in the counterclockwise direction more than necessary. Further, when mounting the process cartridge B, the auxiliary rib 43 on the rightwardly facing surface of the right end of the process cartridge B enters between the second guiding portion 18*b* and shutter cam portion 18*d*, and the primary ribs 40 on the leftwardly facing surface of the left end of the process cartridge B enters between the second guiding portion 17*b* and rotation regulating guiding portion 17*d*. Therefore, the process cartridge B is further regulated in its locus during the mounting and dismounting of the process cartridge B. As a result, the smoothness with which the process cartridge B is mounted or dismounted is further enhanced.

(Structural Arrangement for Opening or Closing Drum Shutter)

Next, the movement of the drum shutter 35, which opens or closes as the process cartridge B is mounted into or dismounted from the apparatus main assembly 15, will be described.

Referring to FIG. 4, the drum shutter 35 is attached to the cleaning means holding frame 14 so that the arm portions 35*b* of the drum shutter 35 located one for one at both ends of the process cartridge B in terms of the length direction are rotatable about the shaft 35*c* of the drum shutter 35. The drum shutter 35 also comprises the linkage portion 35*a*, which is an integral part of the shaft 35*c*, as is the arm portion 35*b*. Thus, as the linkage portion 35*a* is rotated, the arm portion 35*b* rotates, causing the drum shutter 35 to open or close. The arm portion 35*b* is provided with a linkage boss 35*b* which projects from the arm portion 35*b*. The drum shutter 35 is opened or closed by the engagement of the linkage portion 35*a* and linkage boss 35*b* with the shutter cam portion 18*d*. This movement of the drum shutter 35 will be described with reference to FIGS. 29–33 which represent consecutive steps through which the process cartridge B is mounted into the image forming apparatus A.

Figure 30:
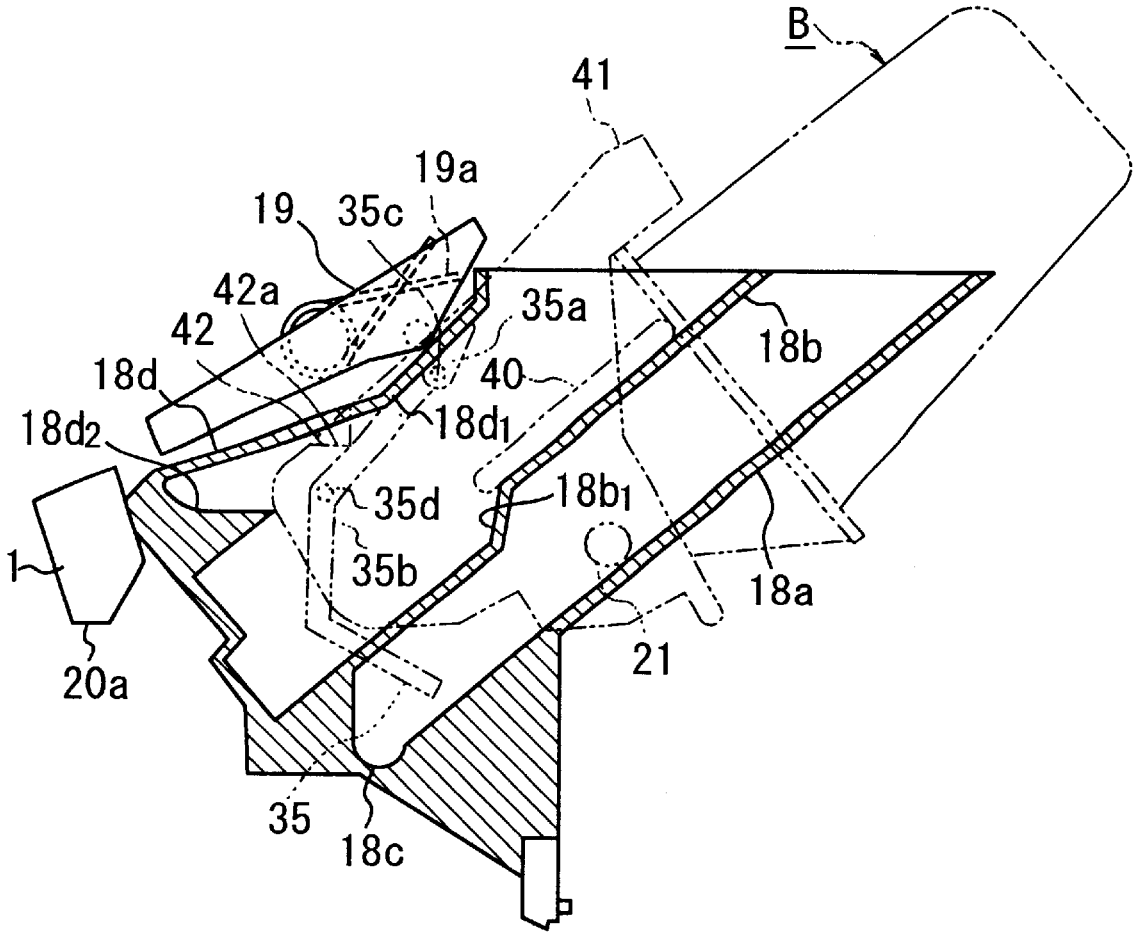
FIG. 30 is a vertical sectional view of the process cartridge and the process cartridge mounting portion of the image forming apparatus, the former being mounted into the latter.
Figure 31:
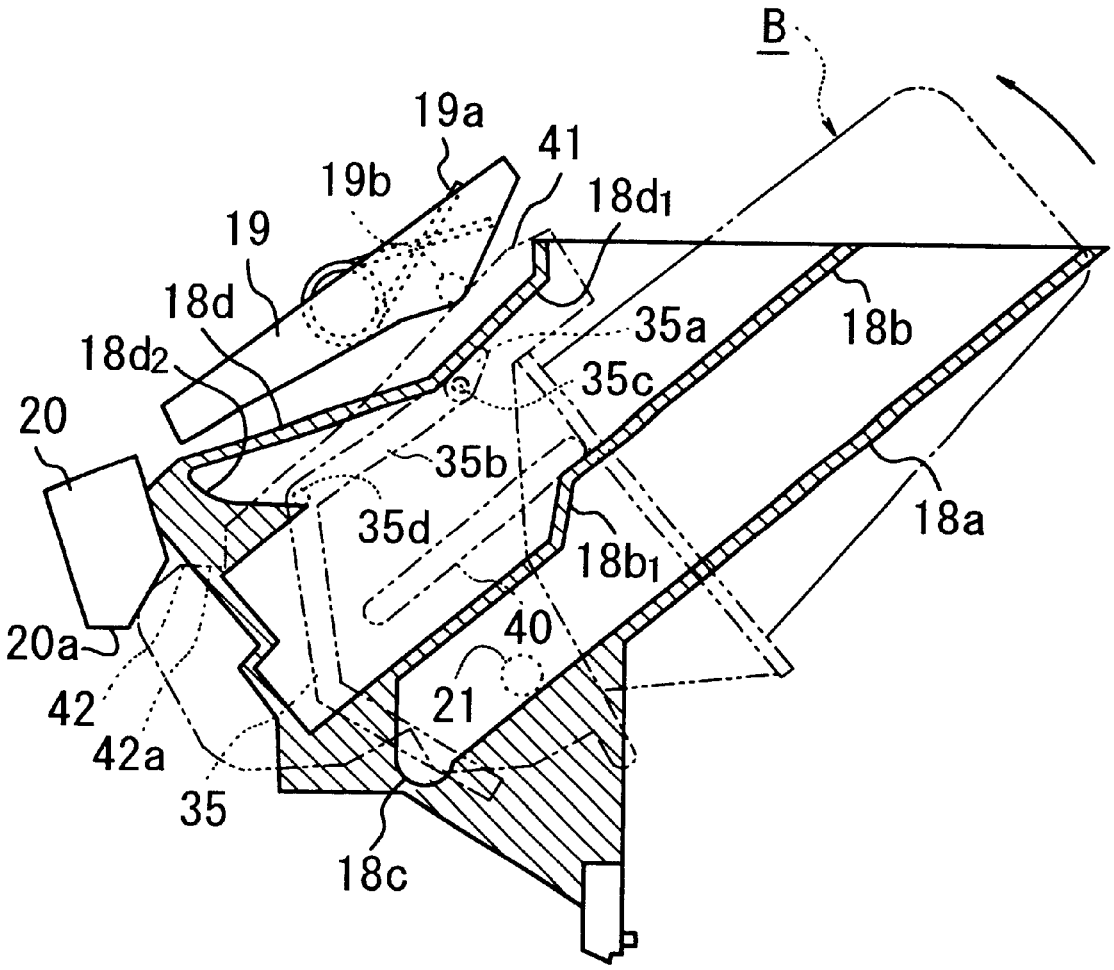
FIG. 31 is a vertical sectional view of the process cartridge and the process cartridge mounting portion of the image forming apparatus, the former being mounted into the latter.
Figure 32:
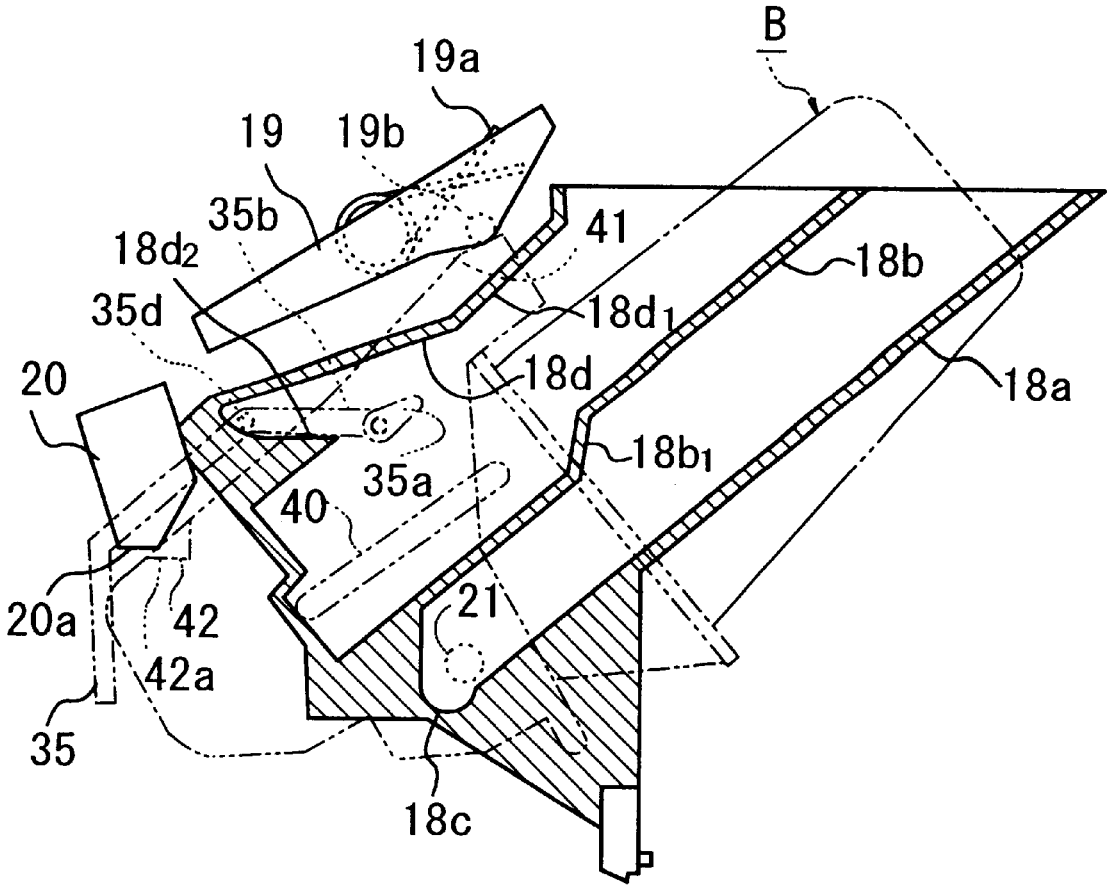
FIG. 32 is a vertical sectional view of the process cartridge and the process cartridge mounting portion of the image forming apparatus, the former being mounted into the latter.
Figure 33:
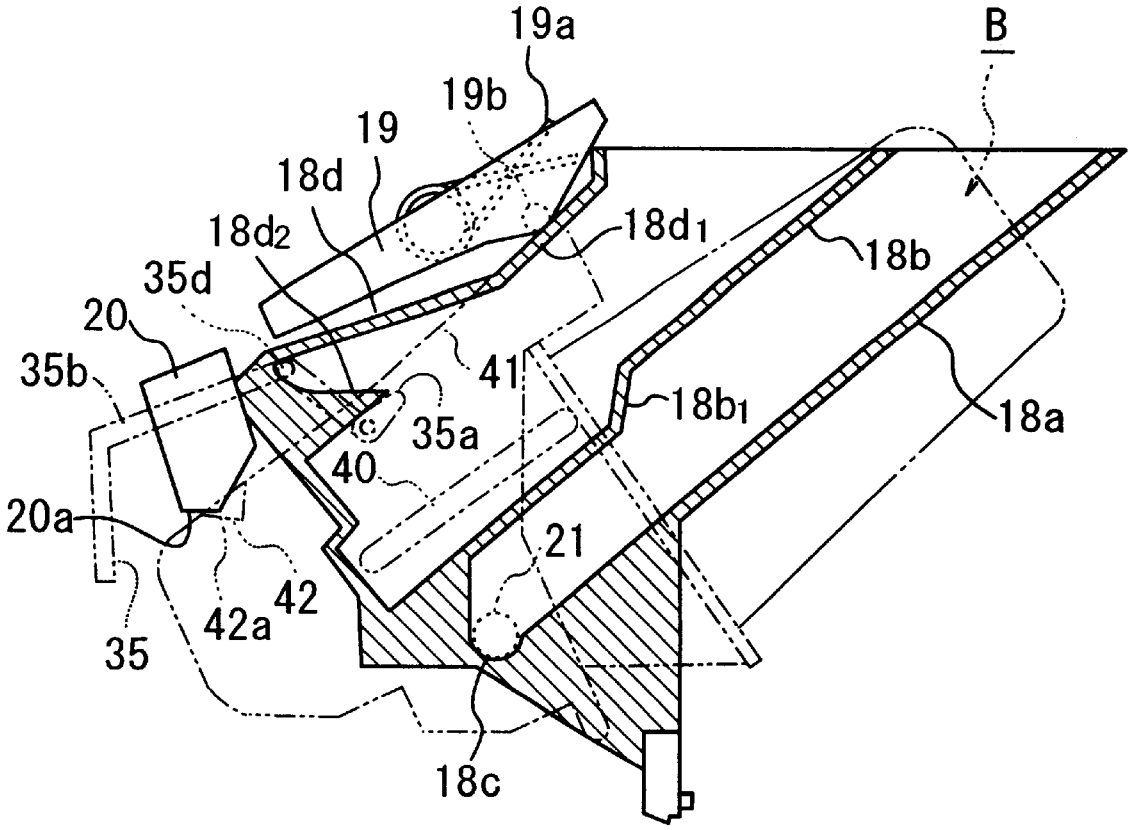
FIG. 33 is a vertical sectional view of the process cartridge and the process cartridge mounting portion of the image forming apparatus, the former being mounted into the latter.

Referring to FIGS. 29–33, the shutter cam portion 18*d* of the right guiding member 18 has a first cam portion 18*d*1 with which the linkage portion 35*a* engages, and a second cam portion 18*d*2 with which the linkage boss 35*d* engages. The angle of the first cam portion 18*d*1 is approximately the same as that of the second guiding portion 18*b* for guiding the primary rib 40 of the process cartridge B. The angle of the second cam portion 18*d*2 relative to the direction in which the process cartridge B is mounted or dismounted is greater than the angle of the first cam portion 18*d*1 relative to the same direction. Referring to FIG. 29, as the process cartridge B is inserted into the apparatus main assembly 15, and is pushed further into the apparatus main assembly 15, the linkage portion 35*a* engages with the first cam portion 18*d*1 of the shutter cam portion 18*d*, being rotated about the shaft 35*c*, as shown in FIG. 30. As a result, the arm portion 35*b* is rotated, opening the drum shutter 35. During this step, the drum shutter 35 does not fully open, remaining in the so-called half-open state. Then, as the process cartridge B is pushed further inward, the linkage boss 35*d* engages with the second cam portion 18*d*2 as shown in FIG. 31. Then, as the process cartridge B is pushed further inward, the role of moving the drum shutter 35 is taken over by the engagement between the linkage boss 35*d* and second cam portion 18*d*2, from the engagement between the linkage portion 35*a* and first cam portion 18*d*1, as shown in FIG. 32. After the completion of the mounting of the process cartridge B, the drum shutter 35 is fully open, so that the recording medium 2 does not collide with the drum shutter 35 while being conveyed below the process cartridge B, as shown in FIG. 33.

As the process cartridge B in the state shown in FIG. 33 is pulled outward to dismount the process cartridge B from the image forming apparatus A, the drum shutter 35 is closed by the resiliency of a torsional coil spring 35*e* (FIG. 4) attached to the arm portion 35, with the linkage boss 35*d* and linkage portion 35*a* engaging with the shutter cam portion 18*d* in the order reverse to the order in which they did during the mounting of the process cartridge B.

The drum shutter 35 is a shutter for protecting the photosensitive drum 7. In this embodiment, however, the image forming apparatus A is provided with a laser shutter in addition to the drum shutter 35. The laser shutter constitutes a laser beam passage blocking means which prevents the laser beam projected onto the photosensitive drum 7 from the optical system 1, from leaking from the optical unit 1*a* (on the apparatus main assembly side) when the apparatus is not in use.

(Description of Electrical Contacts)

Next, the electrical connections which occur between the various components in the process cartridge B and the corresponding components on the apparatus main assembly side during the mounting of the process cartridge B will be described.

Figure 10:
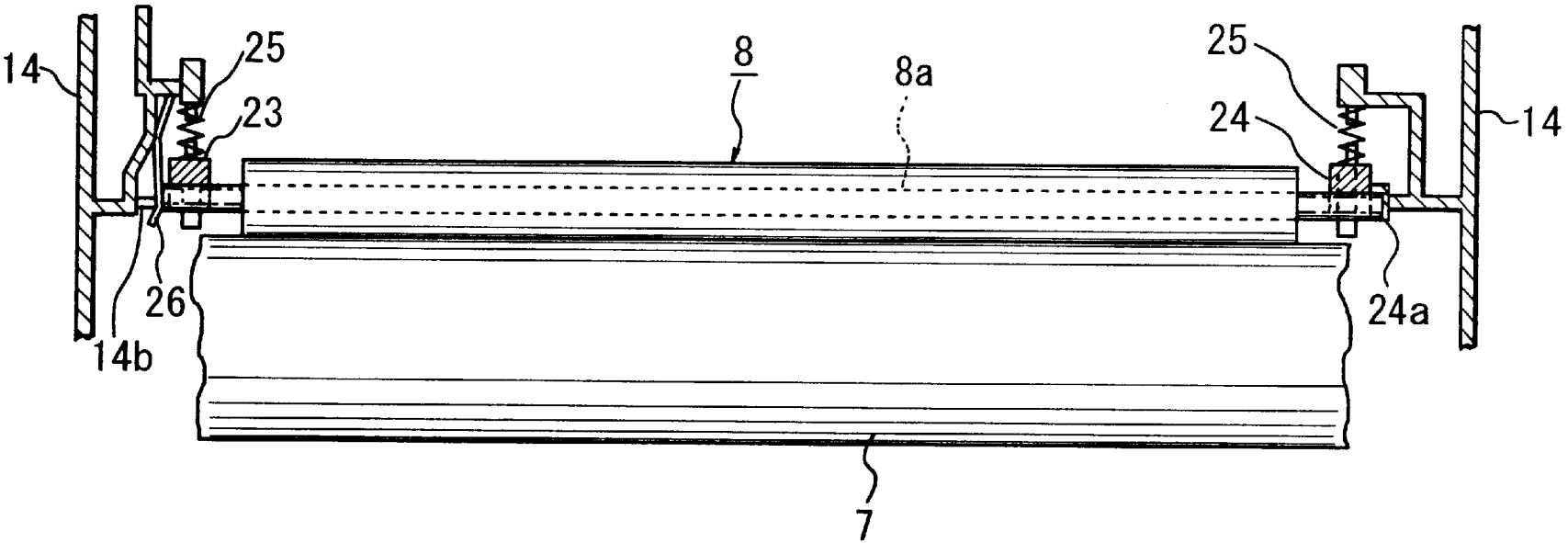
FIG. 10 is a front view of the bearing of a charge roller.

As the process cartridge B is mounted into the image forming apparatus A, the various electrical contacts of the process cartridge B come into contact with the corresponding electrical contacts on the apparatus main assembly 15, establishing electrical connection between the process cartridge B and apparatus main assembly 15. More specifically, referring to FIG. 35, which is a perspective view of the bottom side of the process cartridge B, a contact 27*a*, which is one end of the aforementioned wire antenna 27 for detecting the amount of the toner remainder, is exposed, along with a development bias contact 18 for applying development bias to the development sleeve 10*d*, from the bottom side of the developing means holding frame 13. From the bottom side of the cleaning means holding frame 14, a charge bias contact 49 for applying charge bias to the charge roller 8 is exposed. The contact 27*a* of the wire antenna 27*a* is on one side of the photosensitive drum 7 and the development bias contact 48 is on the other side of the photosensitive drum 7 in terms of the width direction. The charge bias contact 49 is an integral part of the above described electrical contacting member 26 (FIG. 10).

Figure 37:
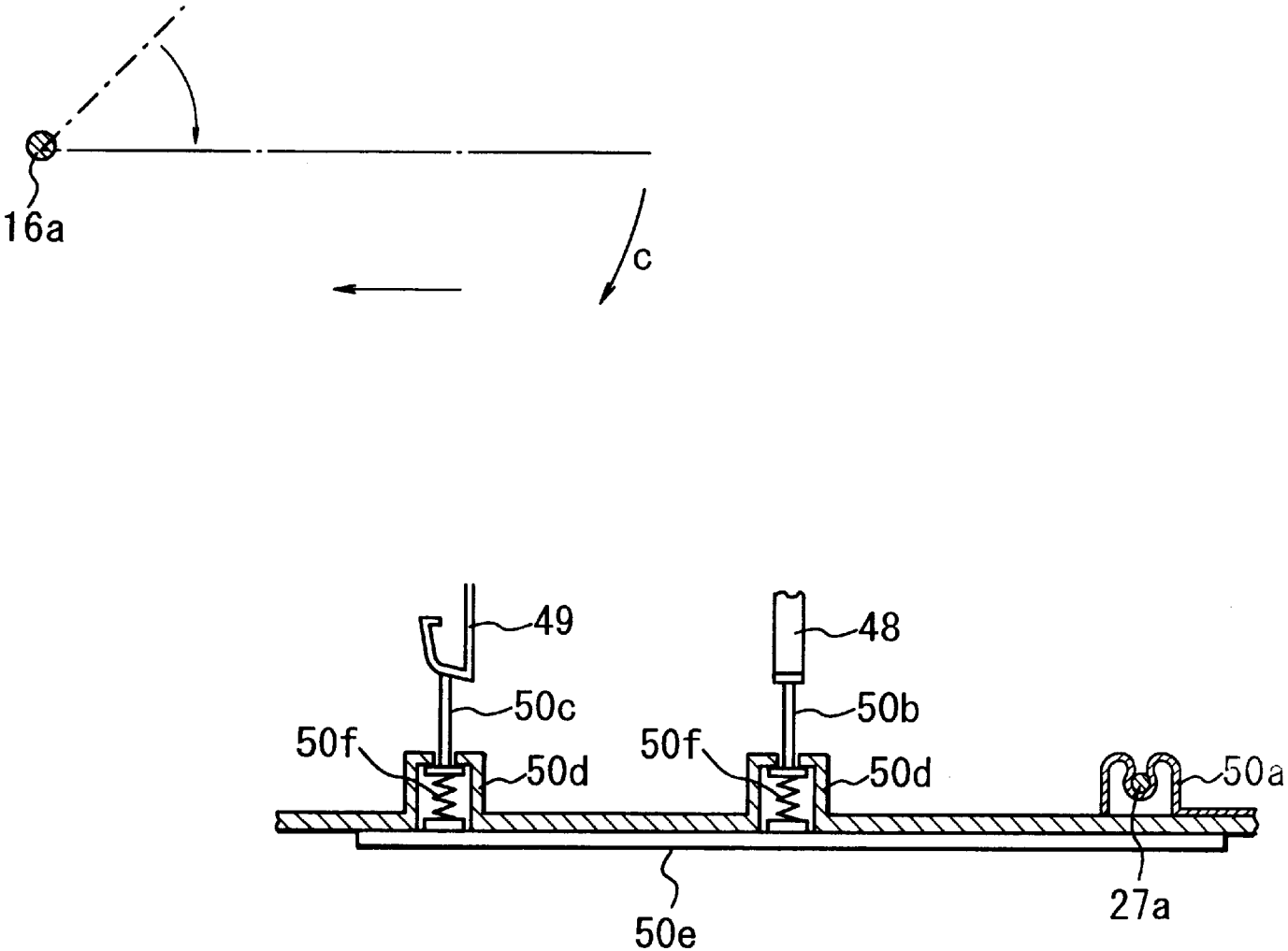
FIG. 37 is a vertical sectional view of the electrical contacts, electrical contact pins, and their adjacencies, for showing their structures.

Correspondingly, the apparatus main assembly 15 is provided with a wire antenna contact 50*a*, a development bias contact pin 50*b*, and charge bias contact pin 50*c*, which come into contact with the contact 27*a* of the wire antenna 27, development bias contact 48, and charge bias contact 49, correspondingly, on the process cartridge side, as the process cartridge B is mounted into the apparatus main assembly 15. The wire antenna contact 50*a* and development bias contact pin 50*b* are on one side of the transfer roller 4, and the charge bias contact pin 50*c* is on the other side of the transfer roller 4, in terms of the direction in which the recording medium 2 is conveyed. Referring to FIG. 37, the contact pins 50*b* and 50*c* are retained by a holder cover 50*d* so that they never dislodge. They are each kept pressed upward by an electrically conductive compression spring 50*f* disposed between them and the printed wire of the electrical circuit board 50*e* to which the holder cover 50*d* is attached, being therefore connected to the printed wire. The charge bias contact 49, with which the contact pin 50*c* is placed in contact, has two flat portions, and a portion with a curvature between the two flat portions, so that the portion of the charge bias contact 49, which faces toward the hinge 16*a* of the cover 16, bows toward the hinge 16*a*. This arrangement is made to assure that the contact between the charge bias contact 49, which is smallest in the radius of the locus followed by an electrical contact on the process cartridge B side when the cover 16 is rotated in the direction of an arrow c about the hinge 16*a* to be closed after the mounting of the process cartridge B, and the contact pin 50*c*, is smooth and excellent in terms of electrical connection.

The shaft 21 for rotationally supporting the photosensitive drum 7 at one end of the photosensitive drum 7 is formed of metallic material, and the photosensitive drum 7 is grounded through this shaft 21. For this purpose, the bearing portion 18*c* of the right guiding member 18, in which the shaft 21 is rested after the mounting of the process cartridge B, is provided with a grounding contact 51, in the form of a plate spring, grounded through the chassis or the like of the apparatus main assembly 15. When the process cartridge B is in the apparatus main assembly 15, the shaft 21 remains in contact with the grounding contact 51, as shown in FIG. 6.

Figure 35:
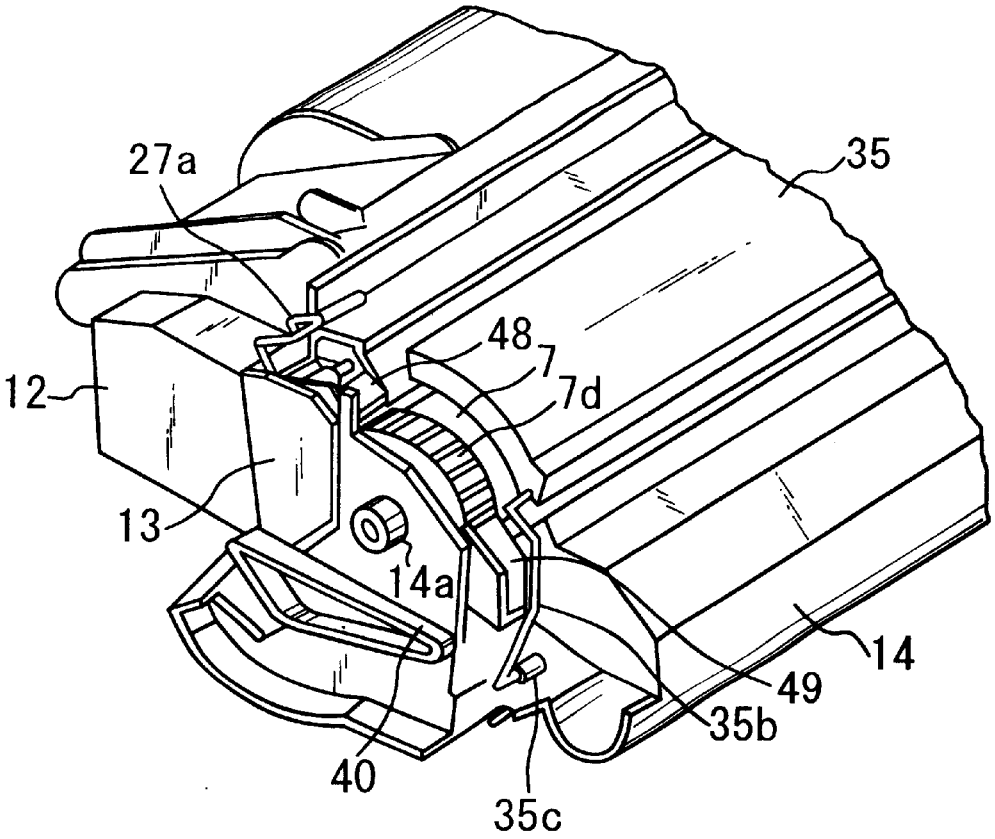
FIG. 35 is a perspective view of one end of the process cartridge in terms of the length direction, for showing the positioning of various electrical contacts of the process cartridge.
Figure 36:
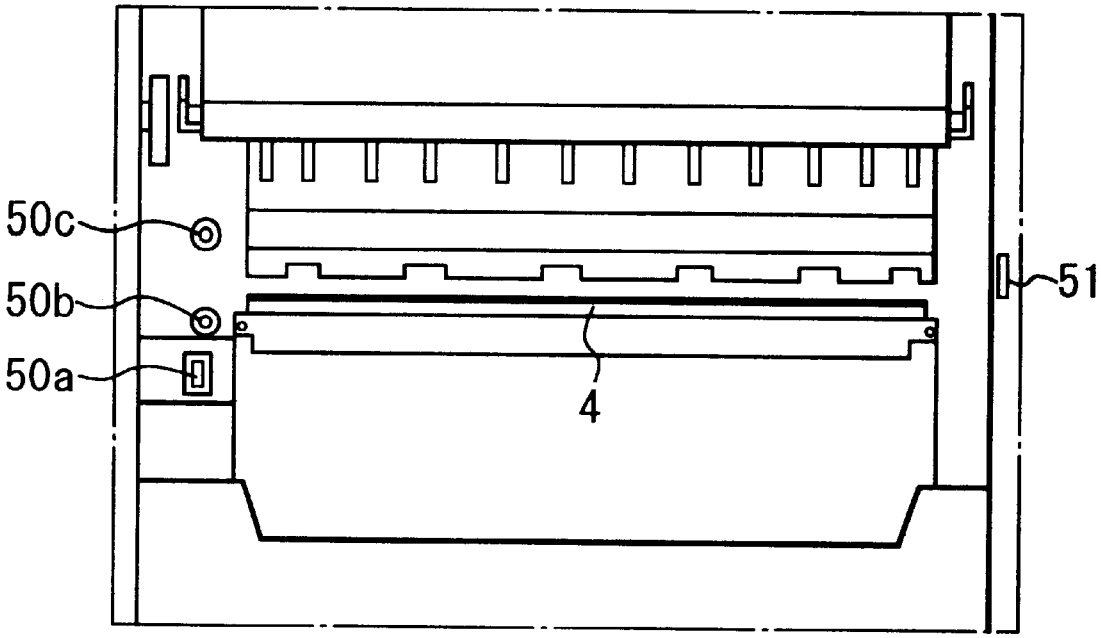
FIG. 36 is a plan view of the main assembly of the image forming apparatus, for showing the positioning of the various electrical contacts of the main assembly.

Referring to FIG. 35, the development bias contact 48 and charge bias contact 49 are located slightly outward of the photosensitive drum 7 in terms of the length direction, and are approximately aligned in the width direction. The development bias contact 48 is on one side of the gear flange 7*d*, that is, a helical gear, of the photosensitive drum 7, and the charge bias contact 49 is on the other side, in terms of the width direction. Further, in terms of the length direction of the photosensitive drum 7, both contacts 48 and 49 are disposed on the inward side, with respect to outward end of the gear flange 7*d* attached to the end of the photosensitive drum 7. With the provision of this arrangement, the process cartridge B can be reduced in size in terms of the length direction of the photosensitive drum 7, which in turn makes it possible to reduce the overall size of the process cartridge B.

As described before, the charge bias contact 49 is bowed outward. More specifically, the portion of the charge bias contact 49, which becomes the leading end of the contact 49 when mounting the process cartridge B into the apparatus main assembly 15, is straight, and the portion which continues rearward from this straight portion bows. Therefore, even if there is a small amount of error in the contact angle between the charge bias contact 49, and the charge bias contact pin 50*c* on the apparatus main assembly side, compensation is automatically made to assure that proper electrical contact is established between the charge bias contact 49 and charge bias contact pin 50*c*. Further, the charge bias contact 49 and charge bias contact pin 50*c* are prevented from being damaged when the process cartridge B is mounted into the image forming apparatus A, even though the contact 49 is disposed so that it will be the first electrical contact which enters the image forming apparatus A when the process cartridge B is mounted into the image forming apparatus A.

The contact portion 27*a* of the wire antenna 27 used by the apparatus main assembly side to determine the amount of the toner remainder in the toner storing bin 10*a* of the developing means 10 is on the same side (developing means 10 side) as the development bias contact 48, with respect to the photosensitive drum 7, in terms of the width direction of the process cartridge B, and is on the outward side, with respect to the development bias contact 48, in terms of the length direction of the photosensitive drum 7.

Since the electrical contacts are disposed as described above, there is no possibility that the charge bias contact 49 becomes separated from the metallic shaft 21 as the drum grounding contact, and induces floating potential between the two contacts. Therefore, charge voltage stabilizes; it does not nonuniformly charge the photosensitive drum 7. To elaborate on this issue, if the drum grounding contact is disposed adjacent to other contacts, floating potential is induced between the wires and the like placed around the drum grounding contact, and the other contacts, and between the drum ground contact and the other contacts, and this floating potential is likely to disturb the AC voltages involved in the development, charging, and toner remainder detection. In particular, in the case in which the photosensitive drum 7 is charged by placing a charge roller in contact with the photosensitive drum 7, a, constant current control is carried out, and therefore, the changes in the AC voltage caused by floating potential result in a seriously disturbed image. Regarding this problem, disposing the aforementioned electrical contacts as in this embodiment prevents the induction of floating potential, making it possible to normally apply AC voltage, and therefore, eliminating the occurrence of nonuniform charging. Further, in this embodiment, the development bias contact 48 and charge bias contact 49 are disposed on the opposing sides with respect to the photosensitive drum 7, providing a sufficient distance between the two contacts for preventing the two contacts from electrically interfering with each other.

(Image Forming Operation)

Next, an image forming operation which is carried out by mounting the process cartridge B into the image forming apparatus A will be described. Referring to FIG. 1, first, a single recording medium 2 or a plurality of recording media 2 are placed in the feeder tray 3*a*, or the cassette 3*h*, in which recording media 2 have been placed in the image forming apparatus A. As the placement of the recording medium 2 is detected by an unshown sensor, or a recording start key is pressed, the pickup roller 3*b* or 3*i* is driven, and the pair of separation rollers 3*c*1 and 3*c*2 and pair of registration rollers 3*d*1 and 3*d*2 are rotated, to convey the recording medium 2 to the image forming portion. Then, in synchronism with the recording medium conveyance timing of the pair of registration rollers 3*d*1 and 3*d*2, the photosensitive drum 7 is rotated in the direction of the arrow in FIG. 1, and the peripheral surface of the photosensitive drum 7 is uniformly charged by the application of charge bias to the charge roller 8. Then, a beam of laser light modulated with image formation signals is projected onto the uniformly charged surface of the photosensitive drum 7, through the exposing portion 9. As a result, a latent image in accordance with the intensity of the beam of the laser light is formed on the peripheral surface of the photosensitive drum 7.

At the same time as the formation of the latent image, the developing means 10 of the process cartridge B is driven; in other words, the toner sending member 10*b* is driven to send the toner within the toner storing bin 10*a* toward the development sleeve 10*d*, and a toner layer is formed on the peripheral surface of the rotating development sleeve 10*d*. To this development sleeve 10*d*, such voltage that is approximately the same in polarity and potential level as the electrical charge on the peripheral surface of the photosensitive drum 7 is applied to develop the latent image on the photosensitive drum 7 into a toner image. At the same time as the development of the latent image, the recording medium 2 is conveyed between the photosensitive drum 7 and transfer roller 4, and such voltage that is opposite in polarity to the toner is applied to the transfer roller 4 to transfer the toner image on the photosensitive drum 7 onto the recording medium 2.

After the toner image transfer, the photosensitive drum 7 is rotated further in the direction of the arrow in FIG. 1. As the photosensitive drum 7 is rotated, the toner remaining on the photosensitive drum 7, or the residual toner, is scraped away, and the removed residual toner is collected in the removed residual toner bin 10*c*.

Meanwhile, the recording medium 2, on which a toner image has been formed as described above, is conveyed to the fixing means 5, in which the toner image is fixed to the recording medium 2 by the application of heat and pressure. Thereafter, the recording medium 2 is discharged into the delivery tray 6 by the discharge roller pair 3*e* and the pair of discharge rollers 3*f*1 and 3*f*2. A desired image is formed on the recording medium 2 in this manner. Incidentally, in this embodiment, a so-called thermal fixing means is used as a fixing means. It is obvious, however, that a so-called pressure type fixing apparatus or the like may be used as the fixing means.

(Remanufacture of Process Cartridge)

Next, the remanufacture of the process cartridge B, that is, a process cartridge in accordance with the present invention, will be described. First, the process cartridge B, or the object to be remanufactured, is placed in an air duct (unshown), and the toner particles and dust particles, which are clinging to the surface of the process cartridge B, are removed by an air blast. Then, the actual remanufacturing operation is started.

(Process for Separating Process Cartridge into Units)

The remanufacturing operation is initiated by separating the process cartridge B into the toner/developing means holding unit C and cleaning means holding frame 14. First, this process for separating the process cartridge B into the toner/developing means holding unit C and cleaning means holding frame 14 will be described. Referring to FIG. 26, the process cartridge B is separated into the toner/developing means holding unit C and cleaning mean holding frame 14. Referring to FIG. 27(B), in order to disassemble the process cartridge B, the small screw 39, which was put through the screw hole 38*b* and screwed into the female threaded portion 14*j*, is removed. Then, the compression spring 38*e*, which was fitted in the spring seating recess 13*n* in the compressed state, is disengaged from the recess 13*n* and extracted through the through hole 14*k*. Then, the connecting portion 38 is removed by pulling the perpendicular portion 38*c* out of the hole 14*i*, as shown in FIG. 26. This removal of the connecting member 38 makes it possible for the toner/developing means holding unit C and cleaning means holding frame 14, which were connected in a manner to be pivotal about the connective projection 13*m*, to be easily separated in the left and right directions, respectively.

(Process for Removing First and Second Supporting Members)

Figure 38:
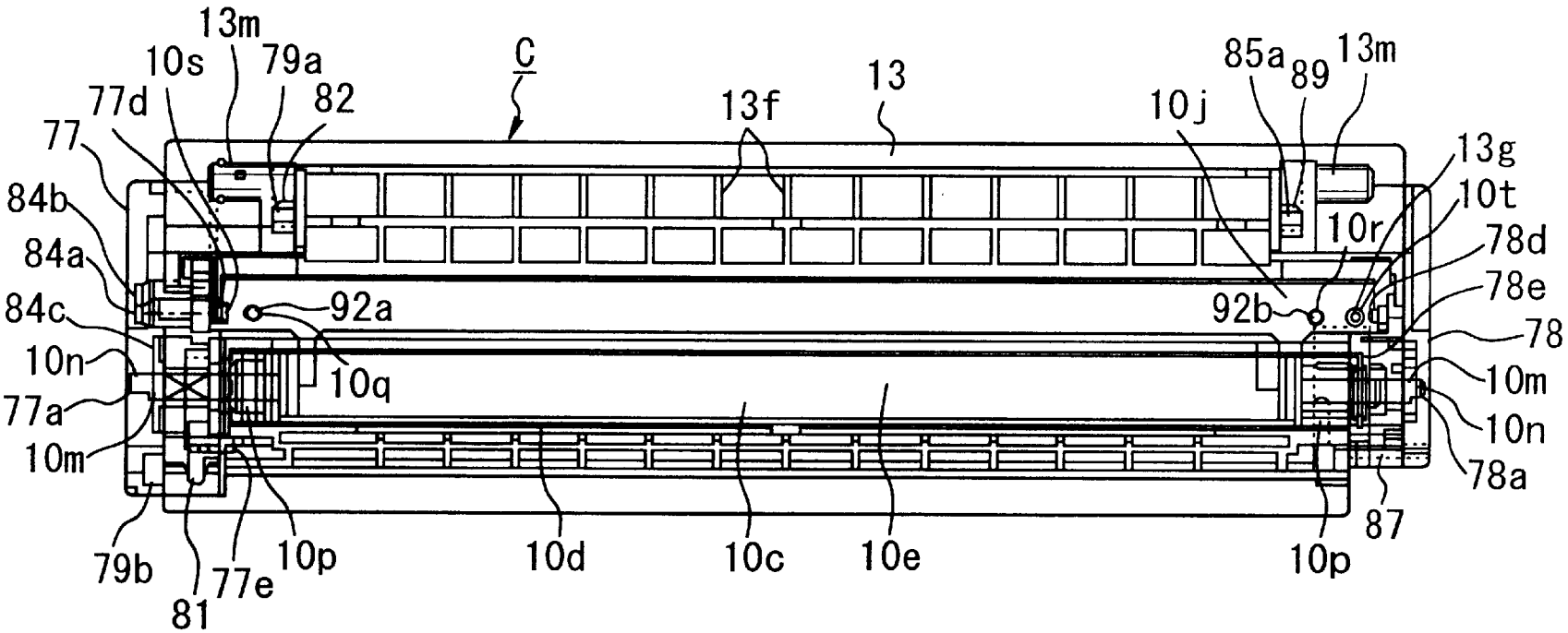
FIG. 38 is a front view of the toner/developing means holding frame before their disassembly, for showing its general structure.

Next, the operation for removing the first and second supporting members is carried out. However, prior to the description of this operation, the general structure of the toner/developing means holding unit C will be described with reference to FIG. 38. The development sleeve 10*d* is rotationally supported by the developing means holding frame 13, being in the opening 13*a* of the developing means holding frame 13, to the long edge of which the development blade 10*e* is anchored; a sleeve flange 10*p* fitted in one end of the development sleeve 10*d* and another sleeve flange 10*p* fitted in the other end of the development sleeve 10*d* are rotationally supported by the first and second supporting portions 81 and 87, respectively. Within the internal space of the development sleeve 10*d*, a magnet 10*c* is disposed. The shaft portions 10*m* of the magnet 10*c*, which project from the ends of the main body of the magnet 10*c*, one for one, in term of the length direction, are put through the corresponding sleeve flanges 10*p*. The end portion of the left shaft portion 10*m* and the end portion of the right shaft portion 10*m* are fitted in the hole 77*a* of the supporting member 77 and the hole 78*a* of the supporting member 78, and the supporting members 77 and 78 are solidly fixed to the corresponding ends of the toner/developing means holding unit C, with the use of screws. In other words, the left and right sleeve flanges 10*p* fitted in the left and right ends of the development sleeve 10*d* are rotationally supported by the first and second supporting plates 81 and 87, and the positions of the end portions of the left and right shaft portion 10*m* are accurately fixed by the first and second supporting member 77 and 78. The portions 10*n* of the left and right shaft portions 10*m*, which fit in the holes 77*a* and 78*a* of the first and second supporting members 77 and 78, are given a D-shaped cross section, and so are the holes 77*a* and 78*a*. Therefore, as the portions 10*n* are fitted into the holes 77*a* and 78*a*, the attitude of the magnet 10*c* in terms of its circumferential direction is accurately fixed.

Figure 39:
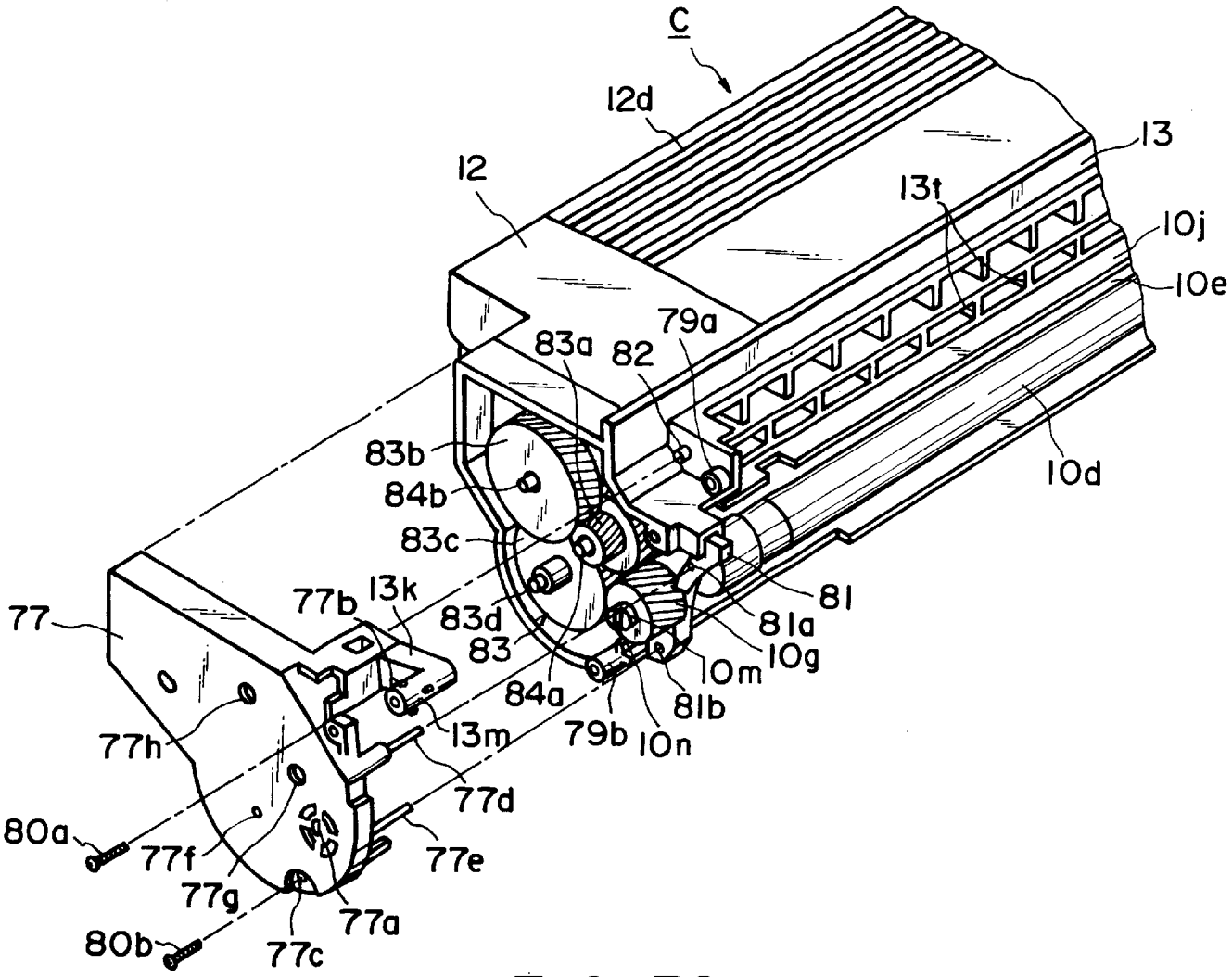
FIG. 39 is a perspective view of the toner/developing means holding frame, for showing the manner in which the first supporting member is removed.

Now, the process for removing the first and second supporting members will be described. Referring to FIG. 39, the first supporting member 77 is disposed to cover both ends of the toner holding frame 12 and developing means holding frame 13, in term of the length direction, which have been united. It covers the driving force transmission year train 83 for transmitting a driving force to the toner sending member 10*b* of the developing means 10, and also doubles as a part of the external frame of the process cartridge B. Next, referring to FIG. 41, the second supporting member 78 covers only the end of the developing means holding frame 13 in terms of the length direction, and also doubles as a part of the external frame of the process cartridge B. The first and second supporting members 77 and 78 support the portions 10*n* of the left and right shaft portions 10*m* of the magnet 10*c* disposed within the development sleeve 10*d* as the portions 10*n* are fitted in the holes 77*a* and 78*a*.

Also referring to FIG. 39, the first supporting member 77 is removed in the following manner. First, screws 80*a* and 80*b* are removed, which were put through the screw hole 77*b* of the arm portion 13*k* and the screw hole 77*c* in the bottom portion of the first supporting member 77, and screwed into the female threaded screw holes 79*a* and 79*b* which were on the toner/developing means holding unit C side and corresponded to the screw holes 77*b* and 77*c*, in order to fix the first supporting member 77 to the developing means holding frame 13. Next, pins 77*d* and 77*e* projecting from the inward surface of the first supporting member 77 are pulled out of the holes 81*a*and 81*b* of the first supporting plate 81, which is supporting the sleeve flange 10*p*, and a boss 83 on the toner/developing means holding unit C side is pulled out of an unshown hole located at the base of the arm portion 13*k*. Further, the portion 10*n* is pulled out of the hole 77*a*, and a gear shaft 83*d* is pulled out of a hole 77*f*. Then, the first supporting member 77 can be disengaged from the end of the toner/developing means holding unit C in terms of the length direction.

The first supporting member 77 is provided with the pins 77*d* and 77*e* which project inward, and the positions of which correspond to the positions of the holes 81*a* and 81*b* of the supporting plate 81 after the attachment of the first supporting plate 81 to a predetermined location. The toner/developing means holding unit C is provided with the female threaded screw holes 79*a* and 79*b*, the positions of which correspond to the positions of the screw holes 77*b* and 77*c* of the first supporting member 77. The screws 80*a* and 80*b* were put through the first supporting member 77 and anchored to the toner/developing means holding unit C, and the pins 77*d* and 77*e* are put through the first supporting plate 81 to hold the supporting plate 81 to the toner/developing means holding unit C, and also to accurately position the supporting plate 81 relative to the toner/developing means holding unit C. The end of the arm portion 13*k* of the first supporting member 77 is provided with the connective projection 13*m*, which is an integrally molded part of the arm portion 13*k* and is used for fitting the toner/developing means holding unit C into the deepest end of the connective recess 14*g* of the cleaning means holding frame 14.

Figure 40:
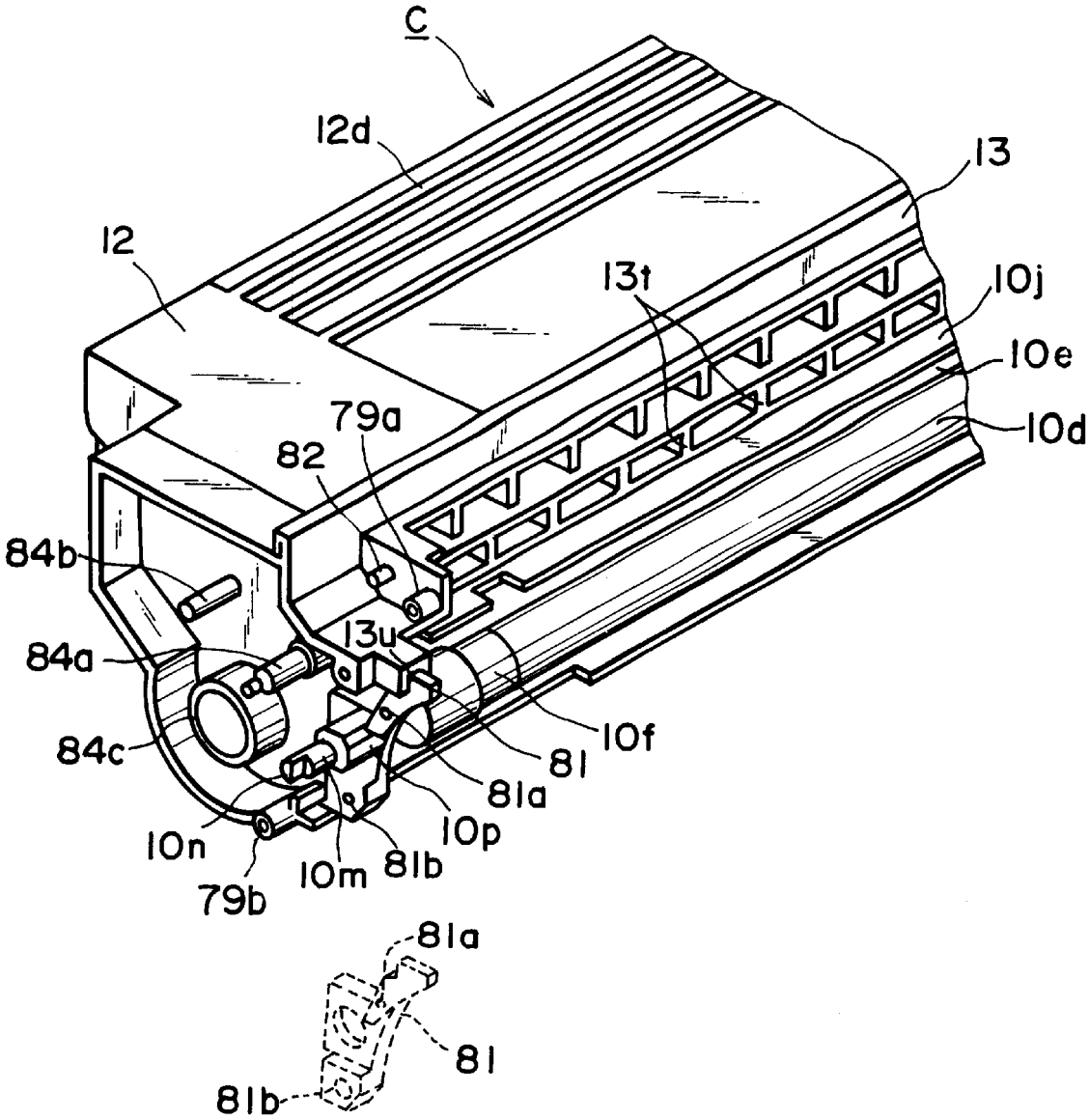
FIG. 40 is a perspective view of the toner/developing means holding frame after the removal of the driving force transmission gear trains.

The driving force transmission gear train 83 comprises four gears, which are different in diameter and are meshed with each other. More concretely, the driving force transmission gear train 83 comprises: the gear 10*g* attached to the sleeve flange 10*p* firmly fitted in one end of the development sleeve 10*d*; gears 83*a* and 83*b* mounted on shafts 84*a* and 84*b*, respectively, projecting from the toner holding frame 12; and a gear 83*c* attached to the end of the toner sending member 10*b* through the hole of a connective portion 84*c*. The unshown journal portion of the gear 83*c* is rotationally fitted in the hole of the connective portion 84*c* of the toner holding frame 12. The gear 10*g* meshes with the helical gear 7*c* fitted in the end of the photosensitive drum 7 supported by the cleaning means holding frame 14. Thus, the rotational force of the photosensitive drum 7 is transmitted to the toner sending member 10*b* through the gears 10*g*, 83*a*, 83*b*, and 83*c*, and drives the toner sending member 10*b*. Referring to FIG. 40, the gears 83*a*, 83*b*, and 83*c* can be removed from the shafts 84*a* and 84*b*, and the connective portion 84*c*, simply by pulling.

Also referring to FIG. 40, the first supporting plate 81 is disengaged from the developing means holding frame 13 in the following manner. First, the gear 10*g* attached to the sleeve flange 10*p* fitted in the end of the development sleeve 10*d* is removed. Then, the first supporting plate 81, which was tightly fitted in a square groove 13*y* of the developing means holding frame 13, and through which the sleeve flange 10*p* was loosely put, is rotated in the clockwise direction. Lastly, the first supporting plate 81 is pulled in the length direction to be disengaged from the developing means holding frame 13.

Next, referring to FIG. 41, the second supporting member 78 is removed in the following manner. First, small screws 86*a* and 86*b*, which were put through a screw hole 78*b* of the arm portion 78*c* and a screw hole 78*c* located at the approximate center of the second supporting member 78, and were screwed into the screw hole 85*a* and 85*b* on the developing means holding frame 13 side, which corresponded to the screw holes 78*b* and 78, are removed. Then, a pin 78*d* projecting from the inward surface of the second supporting member 78 is pulled out of a hole 88*a* of the second supporting portion 87 which is supporting the sleeve flange 10*p*. Further, the boss 89 on the developing means holding frame 13 side is pulled out of the unshown hole at the base of the arm portion 13*k*, and the portion 10*n* is pulled out of the hole 78*a*. Finally, the second supporting member 78 is disengaged from the end of the toner/developing means holding unit C in terms of the length direction.

The second supporting member 78 is provided with the pin 78*d* which projects from the inward surface of the second supporting member 78, and aligns with the hole 88*a* after the second supporting portion 87 is attached to a predetermined location of the developing means holding frame 13. This pin 78*d* is put through the second supporting portion 87 to fix the second supporting portion 87 to the developing means holding frame 13 while accurately positioning the second supporting portion 87 relative to the developing means holding frame 13.

The end of the arm portion 13*k* of the second supporting member 78 is provided with the connective projection 13*m*, which is an integrally molded part of the arm portion 13*k* and is used for fitting the toner/developing means holding unit C into the deepest end of the connective recess 14*g* of the cleaning means holding frame 14. To the inward side of the second supporting member 78, an electrode 80 for applying development bias to the development sleeve 10*d* is attached in a manner to surround the hole 78*a*. Thus, as the second supporting member 78 is removed, the contact between the electrode 90 and the contact 91 extended outward from within the development sleeve 10*d* is broken.

Figure 41:
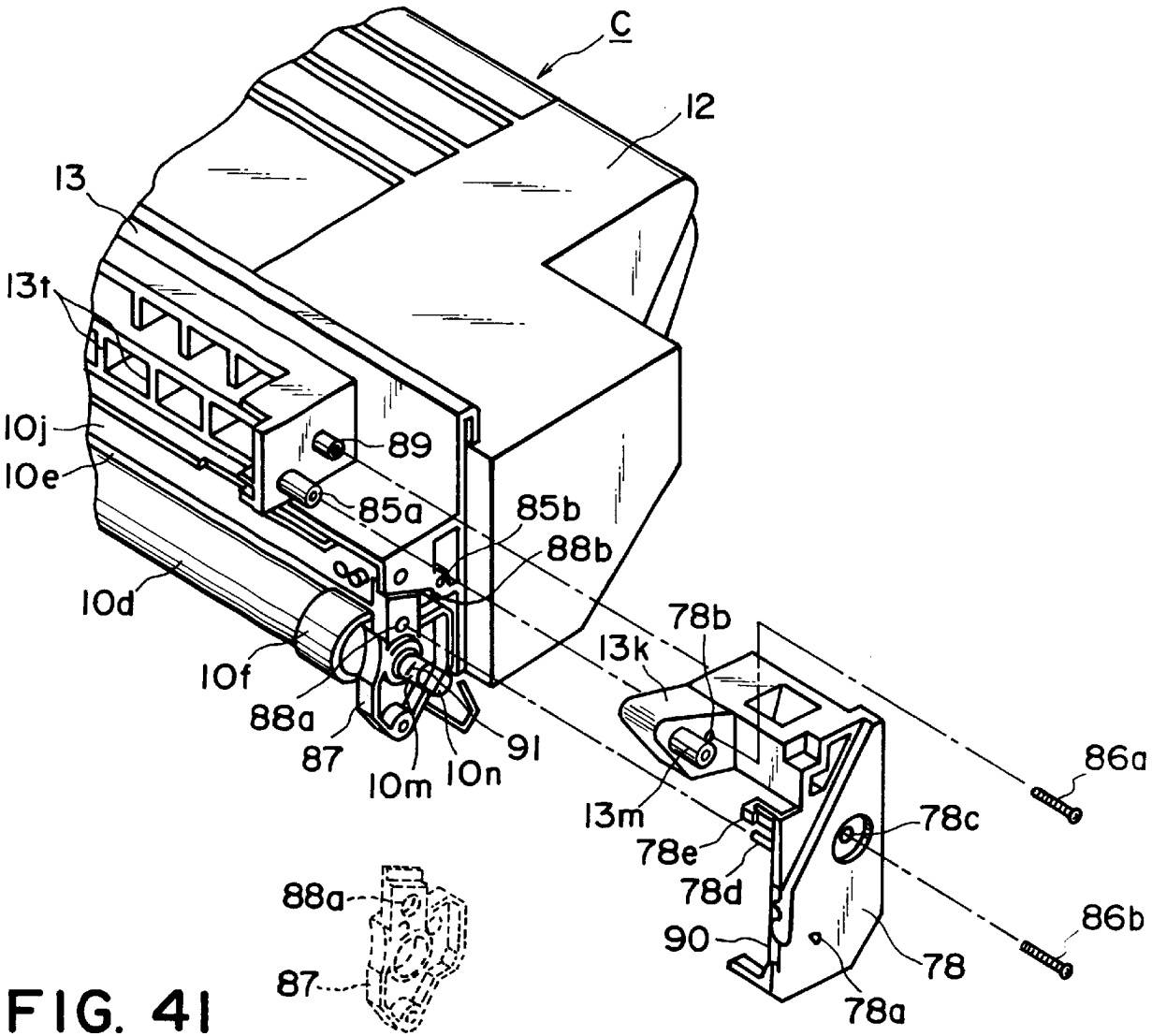
FIG. 41 is a perspective view of the toner/developing means holding frame, for showing the manner in which the second supporting member is removed from the developing means holding frame.

Next, referring to FIG. 41, the second supporting portion 87 is loosely fitted around the sleeve flange 10*p* firmly fitted in the end of the development sleeve 10*d*. It is removed from the developing means holding frame 13 by being rotated in the counterclockwise direction. In other words, the sleeve flange 10*p* at one end of the development sleeve 10*d* is rotationally supported by the first supporting plate 81, and the sleeve flange 10*p* at the other end of the development sleeve 10*d* is rotationally supported by the second supporting portion 87.

As described above, the first and second supporting plates 81 and 87 support the sleeve flanges 10*p*, one for one, which rotate with the development sleeve 10*d*. Therefore, abrasion resistant material, for example, polyacetal resin, polybutylene terephthalate, and the like, are used as the material for the first and second supporting plates 81 and 87. The first and second supporting members 77 and 78 nonrotationally support the shaft portions 10*m* of the magnet 10*c*; in other words, they do not support rotational members. Therefore, they do not need to be formed of abrasion resistant material, in consideration of production cost. In this embodiment, they are formed of polystyrene resin, which is lower in cost than the aforementioned abrasion resistant materials. In other words, in this embodiment, the first and second supporting plates 81 and 87 are formed as components independent from the first and second supporting members 77 and 78, and are formed of a material different from that used for the first and second supporting members 77 and 78. Therefore, they are lower in production cost, and better in terms of assembly efficiency. In the above described disassembly process, the second supporting member 78 is removed after the first supporting member 77 is removed. However, the order in which they are removed does not matter; the first supporting member 77 may be removed first. Further, when disassembly is automated, both may be removed at the same time. Incidentally, the order in which they are attached in a process for reattaching them, which will be described later, does not matter; either may be attached first, or both may be attached at the same time.

(Process for Removing Development Sleeve)

Next, referring to FIG. 42, after the portions, which were supporting the ends of the shaft portion 10*m*, are moved away by the removal of the first and second supporting members 77 and 78, the development sleeve 10*d* is removed in the direction perpendicular to its axial direction.

(Process for Removing Development Blade)

Next, screws 92*a* and 92*b* are removed, which were put through the screw holes 10*q* and 10*r* of the blade anchoring member 10*j*, and were screwed into the female threaded screw holes 13*u* and 13*v* in the blade anchoring surface 13*f* of the developing means holding frame 13, to fix the development blade 10*e* to the developing means holding frame 13. Then, the left and right positioning joggles 13*g* of the blade anchoring surface 13*f* of the developing means holding frame 13 are disengaged from the notch 10*s* and hole 10*t* of the blade anchoring member 10*j*, and the development blade 10*e* is disengaged from the developing means holding frame 13. The disengagement of the development blade 10*e* makes it possible to widely expose the opening 13*a* of the toner/developing means holding unit C, in the deep end side of which the wire antenna 27 and toner sending member 10*b* are disposed.

This concludes the operation for disassembling the toner/developing means holding unit C, and next, the operation comes to a point of reassembling the toner/developing means holding unit C.

(Process for Attaching Seals)

Needless to say, the process cartridge B to be remanufactured does not have the cover film 28 for sealing the opening 13*a*; the cover film 28 has been removed. If the opening 13*a* is sealed with the cover film 28 while remanufacturing the process cartridge B, the remanufactured process cartridge B becomes virtually the same as a new process cartridge. However, in this embodiment, the cover film 28 is not attached during the remanufacturing, since all that is necessary is that an overhauled toner/developing means holding unit C, in which a new cover film 28 has been not been pasted, is as airtight as the one in which a new cover film 28 has been pasted. Hereinafter, therefore, a method for sealing the toner/developing means holding unit C, airtightly enough to assure that toner does not leak from the toner/developing means holding unit C, without using the cover film 28, will be described. To clarify the meaning of the immediately preceding sentence, a phrase "airtightly enough to assure that toner does not leak" does not mean preventing toner from leaking while the process cartridge B is subjected to so-called normal handling, for example, while a user is mounting or dismounting the process cartridge B into or from the image forming apparatus A, while a user is hand carrying the process cartridge B. Rather, it means preventing toner from leaking while the process cartridge B is subjected to so-called rough conditions in terms of toner leakage, for example, while the process cartridge B is transported by a truck, a ship, an aircraft, or the like after it is remanufactured in a factory. Obviously, when the process cartridge B is used for the first time, the cover film 28 is pulled out (unless the cover film 28 is pulled out, an image cannot be formed). Thus, the user mounts or dismount the process cartridge B into or from the image forming apparatus A, or hand carries it, after the cover film 28 is removed. Therefore, it is expected, being common knowledge, that the process cartridge B is sealed airtightly enough to prevent toner from leaking while it is handled by the user. However, during the period from when the process cartridge B is shipped out of a factory to when it is delivered to the user, in other words, while the process cartridge B is transported by a truck, a ship, an aircraft, or the like, vibrations and shocks, which are far more severe than those which occur during the normal handling by the user, act on the process cartridge B. Therefore, measures for preventing toner leakage during transportation are sometimes necessary. The cover film 28 is a film for preventing toner from leaking during transportation. Thus, when the cover film 28 is not pasted during the remanufacturing of the process cartridge B, a sealing member which can take the place of the cover film 28 is necessary.

In this embodiment, a sealing member formed of elastic material is attached between the development blade 10*e* and developing means holding frame 13, instead of using the cover film 28, to seal the process cartridge B as airtightly as it is sealed with the cover film 28. Next, this sealing member will be described.

The reason toner leakage is likely to occur during the aforementioned transportation is that the various components of the process cartridge B deform for a brief moment due to vibrations and/or shocks, and therefore, gaps are created along the joints among them. Without the cover film 28, toner shifts toward the development sleeve 10*d* through the opening 13*a*. However, as described with reference to FIG. 11, the gap between the peripheral surface of the development sleeve 10*d* and the long edge of the developing means holding frame 13, that is, the end of the developing means holding frame 13 in terms of the width direction, is sealed with the blowout prevention sheet 10*i*, whereas the gaps between the ends of the development sleeve 10*d* in terms of the length direction, and the developing means holding frame 13, are sealed with the toner leakage prevention seals 10*h*. Further, the elastic development blade 10*e* is placed in contact with the peripheral surface of the development sleeve 10*d* in a manner to keep a predetermined contact pressure, to prevent toner from being borne on the peripheral surface of the development sleeve 10*d* by more than a predetermined amount. The toner borne on the peripheral surface of the development sleeve 10*d* is held to the peripheral surface of the development sleeve 10*d* by the magnetic force of the magnet 10*c*. Further, as described with reference to FIG. 15, the developing means holding frame 13 is provided with three long ribs 13*b*, 13*c*, and 13*d*, which extend in the length direction and are located so that as the development blade 10*e* is attached to the developing means holding frame 13, the first and second ribs 13*b* and 13*c* are pressed upon the development blade 10*e*, and the third rib 13*d* is pressed upon the blade anchoring member 10*j*, a piece of metallic plate or the like, for mounting the development blade 10*e*. The blowout prevention sheet 10*i*, toner leakage prevention seal 10*h*, and development blade 10*e* are formed of elastic material, and are kept compressed for sealing purposes, whereas the contact between the developing means holding frame 13 and development blade 10*e* is such that the development blade 10*e* is kept simply pressed upon the developing means holding frame 13. Also as described before, the developing means holding frame 13 and development blade anchoring member 10*j* are formed of polystyrene resin and metallic plate, respectively, and the development blade 10*e* is formed of approximately 1.3 mm thick urethane rubber or silicone rubber. Therefore, in microscopic terms, even the development blade 10*e* and developing means holding frame 13 remain compressed as the development blade 10*e* is kept pressed upon the developing means holding frame 13, although the amount by which they remain compressed is extremely small compared to the amount by which the elastic sheet and elastic seal remain compressed. More specifically, the contact between the third rib 13*d* and blade anchoring member 10*j* is actually a contact between polyethylene resin and metallic plate, in terms of material, and therefore, the amount of the compression which occurs as the two are pressed against each other is too small to mention. In comparison, the contacts between the first and second ribs 13*b* and 13*c* and the development blade 10*e* are between polystyrene resin and urethane rubber or silicone rubber in terms of material. However, the thickness of the development blade 10*e*, that is, the thickness of urethane rubber or silicone rubber, is only approximately 1.3 mm. Therefore, the amount of the deformation which occurs to the development blade 10*e* as the ribs and blade are pressed against each other is minuscule and is far smaller than the amount by which the toner leakage prevention seal 10*h* is deformed.

Further, both ends of the development blade anchoring member 10*j* of the development blade 10*e* are anchored with the screws 92*a* and 29*b*, and the sleeve flange 10*p* at one end of the development sleeve 10*d* and the sleeve flange 10*p* at the other end of the development sleeve 10*d* are supported by the developing means holding frame 13, with the interposition of the first and second supporting portions 81 and 87, respectively.

Thus, as vibrations and/or shocks act on the process cartridge B, in which the seals are structured as described above, and the development blade 10*e* and development sleeve 10*d* are supported as described above, the development blade 10*e*, development sleeve 10*d*, and developing means holding frame 13 sometimes partially deform for a brief moment. In particular, the development blade 10*e* and development sleeve 10*d* are supported only by their ends in terms of the length direction as described above, and therefore, they are likely to deform mostly across their center portions. However, the blowout prevention sheet 10*i* and development blade 10*e*, which are kept pressed upon the development sleeve 10*d*, are elastic, and therefore, even if the center portions of the development blade. 10*e* and development sleeve 10*d* deform, the blowout prevention sheet 10*i* and development blade 10*e* compensate for the deformations because of their elasticity, never losing their sealing performance. This is true of the end portions of the development sleeve 10*d* in terms of the length direction, which are closer to the supporting members, and therefore, lesser in deformation. In comparison, there is no elastic component between the development blade 10*e* and developing means holding frame 13 as described above, and the amount by which the development blade 10*e* and developing means holding frame 13 deform or compress, without losing their resiliency, as they are pressed against each other, is minuscule. Thus, on rare occasions, their center portions deform by the amount more than compensatable by their compressibility, creating gaps between them. Therefore, the only thing which must be done in order to prevent toner from leaking during transportation of a remanufactured process cartridge is to better seal between the development blade 10*e* and developing means holding frame 13.

Figure 46:
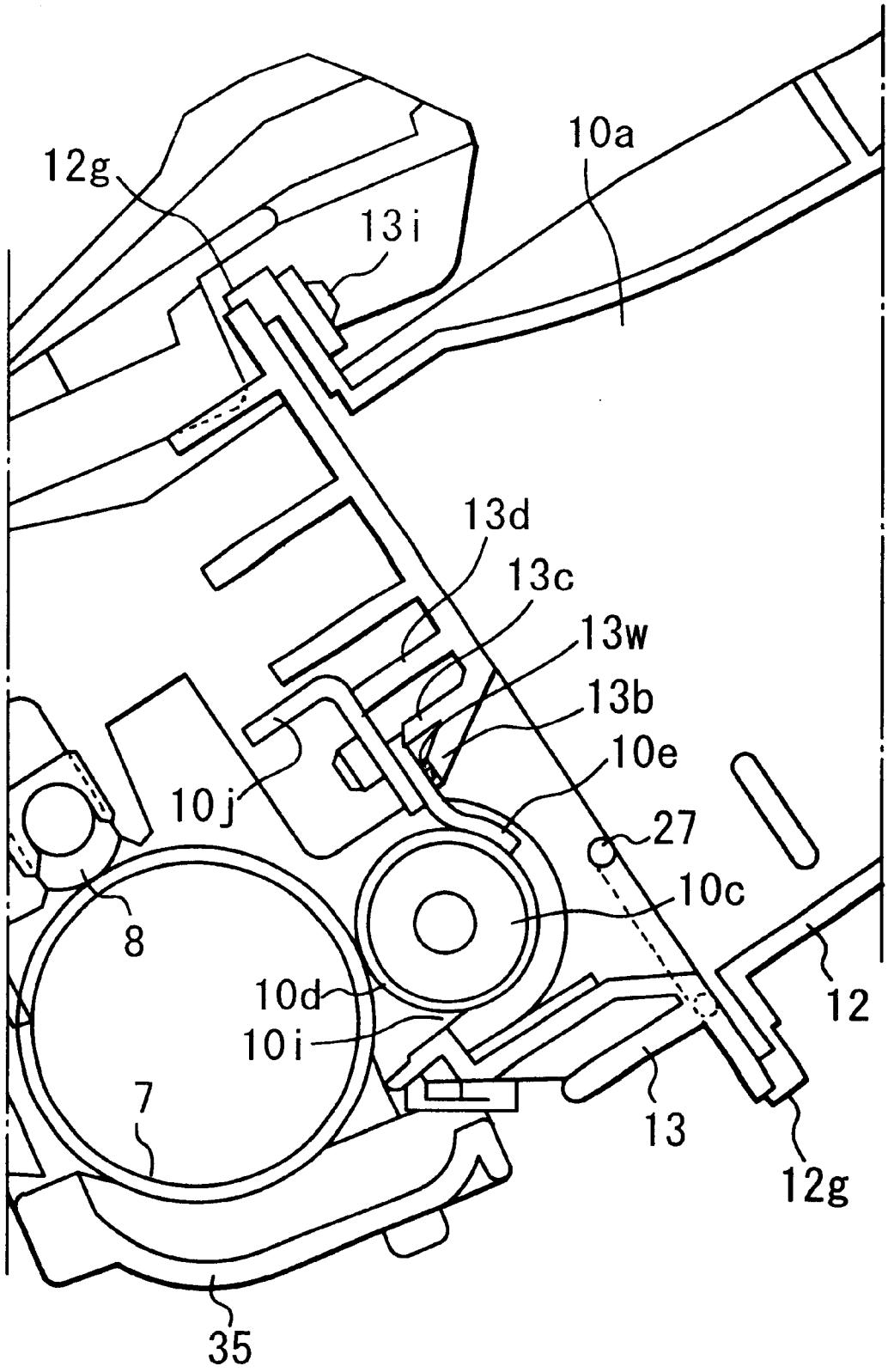
FIG. 46 is an enlarged sectional view of a portion of the toner/developing means holding frame after the pasting of the sealing member to the frame.

Thus, in this embodiment, a sealing member 13*w* is attached on top of the first rib 13*b*, as shown in FIGS. 45 and 46, to better seal between the development blade 10*e* and developing means holding frame 13. More specifically, the sealing member 13*w* formed of very elastic foamed material such as MOLTPRENE (commercial name) is pasted on top of the first rib 13*b* from one end to the other end in terms of the length direction, with the use of double-sided adhesive tape or adhesive, so that the ends of the sealing member 13*w* in terms of the length direction make contact with the toner leakage prevention seals 10*h*, one for one. In other words, the sealing member 13*w* is pasted on top of the first rib 13*b* of the developing means holding frame 13 across the entire range between the left and right toner leakage prevention seals 10*h*. Thus, the dimension of the sealing member 13*w* in terms of the length direction becomes approximately the same as the length of the development blade 10*e*. With the placement of the sealing member 13*w* as described above, even if the development blade 10*e* and developing means holding frame 13 become separated from each other across a given range for a brief moment, the sealing member 13*w* instantly expands to keep sealed between the development blade 10*e* and developing means holding frame 13.

Where the sealing member 13*w* is pasted does not need to be limited to the first rib 13*b*. For example, it may be pasted on the second rib 13*c*, the third rib 13*d*, between the first and second ribs 13*b* and 13*c*, or between the second and third ribs 13*c* and 13*d*. Further, it may be pasted to the portion of the development blade 10*e* or the portion of the blade anchoring member 10*j*, which opposes any of the ribs or any interval among the ribs. Further, the member for better sealing between the development blade 10*e* and developing means holding frame 13 does not need to be formed of elastic material. For example, a long and narrow magnet may be attached as a sealing member so that toner is kept confined by the magnetic force. Further, two or more sealing members 13*w* may be provided.

(Process for Filling Overhauled Toner/Developing Means Holding Unit C with Toner)

Figure 43:
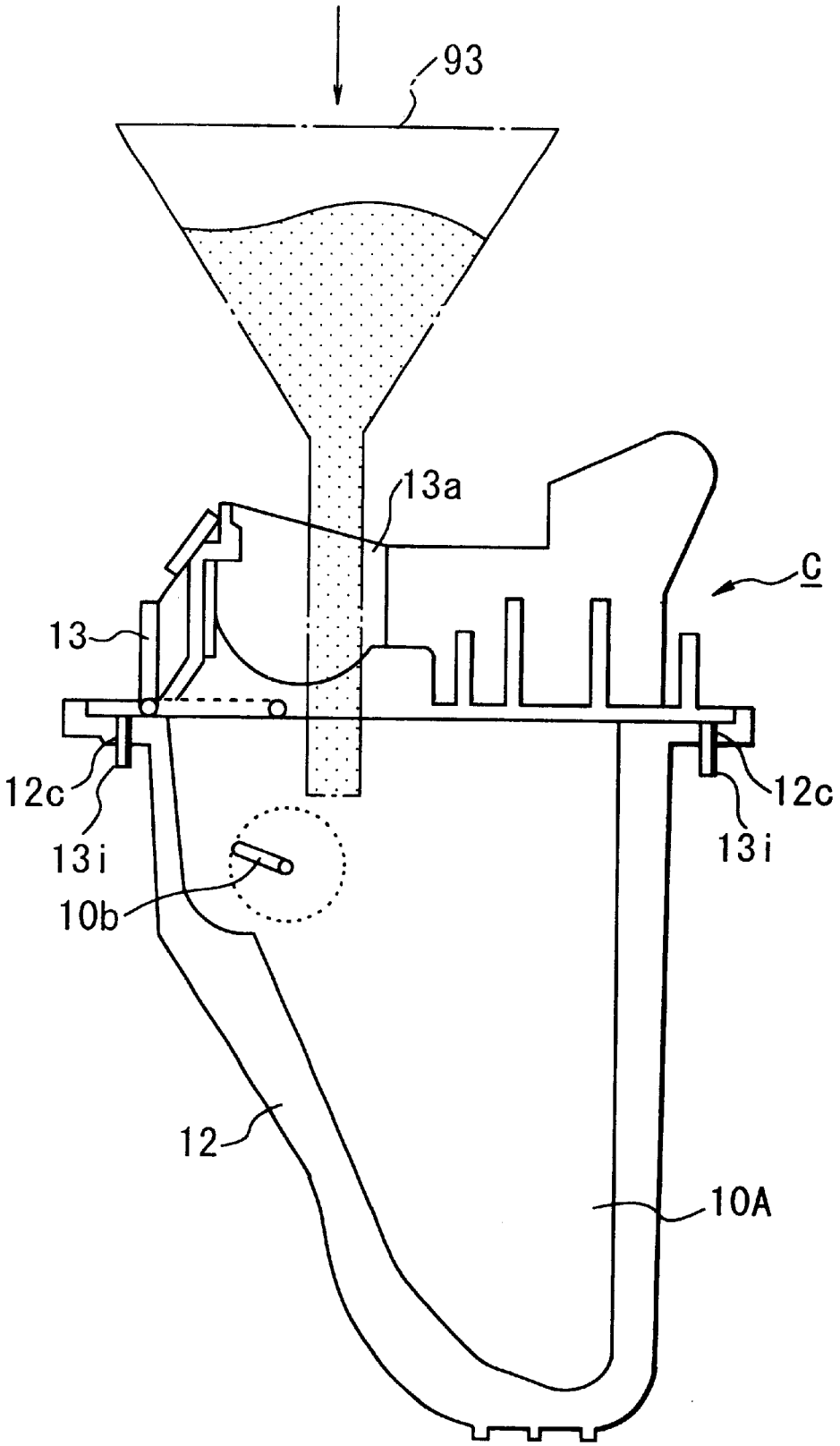
FIG. 43 is a vertical sectional view of the toner/developing means holding frame and a funnel, for showing how toner is filled into the frame.

Next, the overhauled toner/developing means holding unit C is filled with toner. Referring to FIG. 43, when filling the overhauled toner/developing means holding unit C, the toner/developing means holding unit C is held so that the opening 13*a* faces upward, and a funnel or the like is placed on top of the toner/developing means holding unit C so that the nozzle portion of the funnel is inserted into the toner storing bin 10*a* through the opening 13*a*. Then, replacement toner prepared in advance is poured into the funnel 93 as indicated by an arrow mark to fill the toner into the toner storing bin 10*a*. The device used for filling the overhauled toner/developing means holding unit C does not need to be limited to the funnel 93. Any device may be employed as long as it can smoothly fill toner into the toner storing bin 10*a* without leaking the toner. For example, toner filling may be automated with the use of a mechanism capable of automatically delivering a predetermined amount of toner from a nozzle.

(Process for Reattaching Development Blade)

Next, the development blade 10*e* is reattached following in reverse order "process for Removing Development Blade" described before. More specifically, referring to FIG. 42, the development blade 10*e* is attached by attaching the blade anchoring member 10*j* to the blade anchoring surface of the developing means holding frame 13 with the use of the small screws 92*a* and 92*b* which are screwed into the developing means holding frame 13. Incidentally, before reattaching the removed development blade 10*e*, the removed development blade 10*e* is cleaned of toner particles adhering to the development blade 10*e*, by blasting it with air or the like, and is tested for whether or not it is reusable. If it does not meet predetermined performance standards, it is exchanged with a new one. However, if a given development blade 10*e* is known, through the studies conducted during the development stage, and/or statistical studies carried out during numerous remanufacturing processes, to have a high probability that it will need to be replaced with a new one, it should be replaced with a new one without testing it. Replacing such a development blade with a new one during remanufacturing without testing it sometimes improves remanufacturing efficiency.

(Process for Reattaching Development Sleeve)

Next, the development sleeve 10*d* is reattached following in reverse order the process for removing the development sleeve 10*d*, so that the development sleeve 10*d* covers the opening 13*a*; the ends of the development sleeve 10*d* contact the toner leakage prevention seals 10*h*, one for one; and the peripheral surface of the development sleeve 10*d* contacts the blowout prevention sheet 10*d*. Before reattaching the development sleeve 10*d*, the removed development sleeve 10*d* is cleaned of toner particles adhering to the development sleeve 10*d*, by blasting it with air or the like, and is tested for whether or not it is reusable. If it does not meet predetermined performance standards, it is exchanged with a new one. However, if a given development sleeve 10*d* is known, through the studies conducted during the development stage, and/or statistical studies carried out during numerous remanufacturing processes, to have a high probability that it will need to be replaced with a new one, it should be replaced with a new one without testing it. Replacing such a development sleeve with a new one during remanufacturing without testing it sometimes improves remanufacturing efficiency.

(Process for Reattaching First and Second Supporting Members)

Next, the first and second supporting members 77 and 78 are reattached following in reverse order the process for removing the first and second supporting members 77 and 78. More specifically, referring to FIG. 41, after the second supporting portion 87 is fitted around the sleeve flange 10*p* of the development sleeve 10*d*, the second supporting portion 87 is fitted in the groove of the developing means holding frame 13, and the portion 10*n* is fitted into the hole 78*a* of the second supporting member 78. Then, these are screwed to the developing means holding frame 13 with the use of the small screws 86*a* and 86*b*. Next, referring to FIG. 40, the first supporting plate 81 is fitted around the sleeve flange 10*p* of the development sleeve 10*d*, and fitted in the square groove 13*y* of the developing means holding frame 13, and the sleeve flange 10*p* is fitted with the gear 10*g*. Further, the shafts 84*a*, 84*b*, and connective portion 84*c* projecting from the toner holding frame 12 are fitted with the gears 83*a*, 83*b*, and 83*c*, correspondingly, the gears being meshed among themselves. Next, the first supporting member 77 is attached to the toner holding frame 12 so that the pins 77*d* and 77*e* of the first supporting member 77 are inserted into the holes 81*a* and 81*b*; the connective portion 10*n* is fitted in the hole 77*a*; and the gear shaft 83*a* is fitted in the hole 77*f*. Then, these are screwed together to complete the toner/developing means holding unit C shown in FIG. 38.

Figure 44:
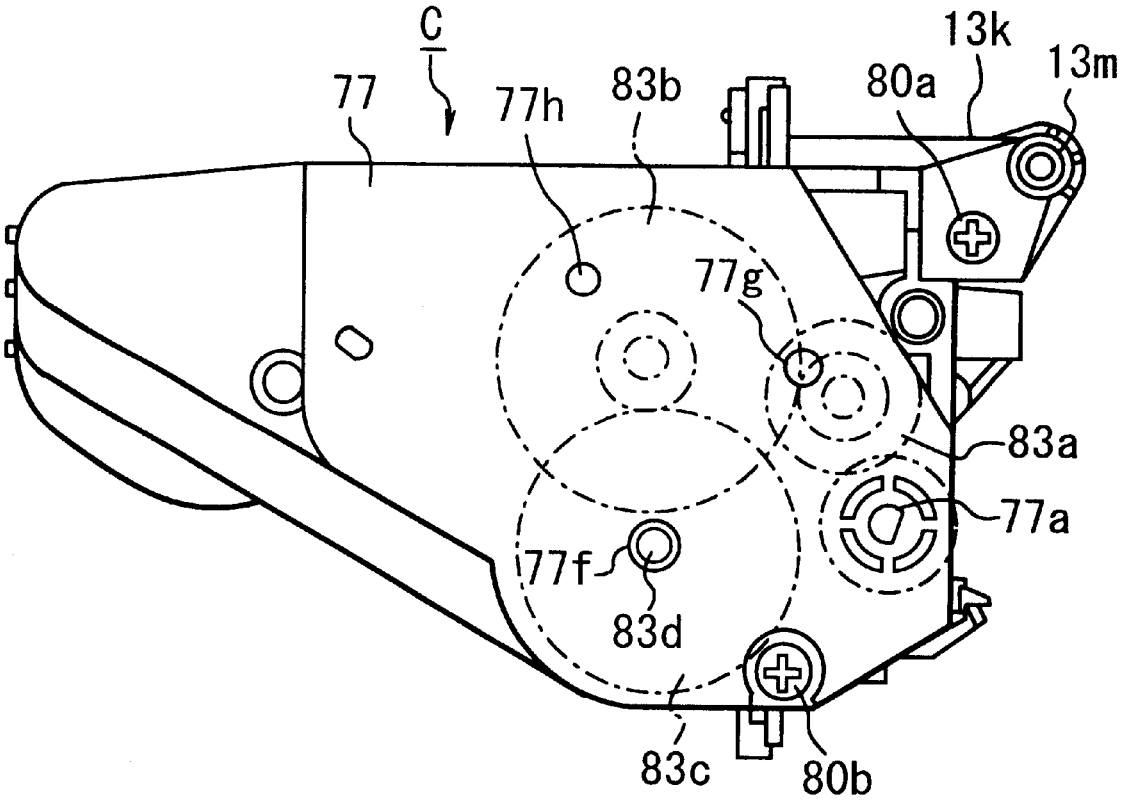
FIG. 44 is a side view of the toner/developing means holding frame, for showing the holes made in the first supporting member.

Referring to FIG. 44, in this embodiment, the first supporting member 77 is provided with holes 77*g* and 77*h*, the positions of which correspond to that of the driving force transmission gear train 83. Thus, assemblers can visually confirm through these holes whether or not the gears have been correctly attached after the assembly of the toner/developing means holding unit C, for example, during the final test carried out at the end of the assembly in a factory. Further, if necessary, the manner in which those gears rotate can be confirmed through these holes 77*g* and 77*h* by manually rotating the gear 10*g* attached to the sleeve flange 10*p*. Therefore, assembly efficiency is drastically improved. In consideration of the need for visually confirming the presence of the gears and the manner in which the gears rotate, and also the need for reducing the invasion of dust or the like as much as possible, the first supporting member 77 is provided with two holes 77*g* and 77*h*, which are approximately 2 mm–10 mm, preferably, approximately 5 mm, in diameter. The holes 77*g* and 77*h* are desired to be positioned so that the manner in which the gears are meshed, or the presence of each gear can be confirmed. In this embodiment, one hole is located where the manner in which the gear 83*a* and 83*b* are meshed (position corresponding to the meshing point between the two gears) can be confirmed, and the other hole is located where the presence of the gear 83*b* can be confirmed (position corresponding to the gear 83*b*). The provision of the above described holes are not mandatory; they may be provided as necessary. When providing these holes, their number, sizes, and locations, should be optimally selected as appropriate.

(Process for Overhauling Cleaning Unit)

Figure 47:
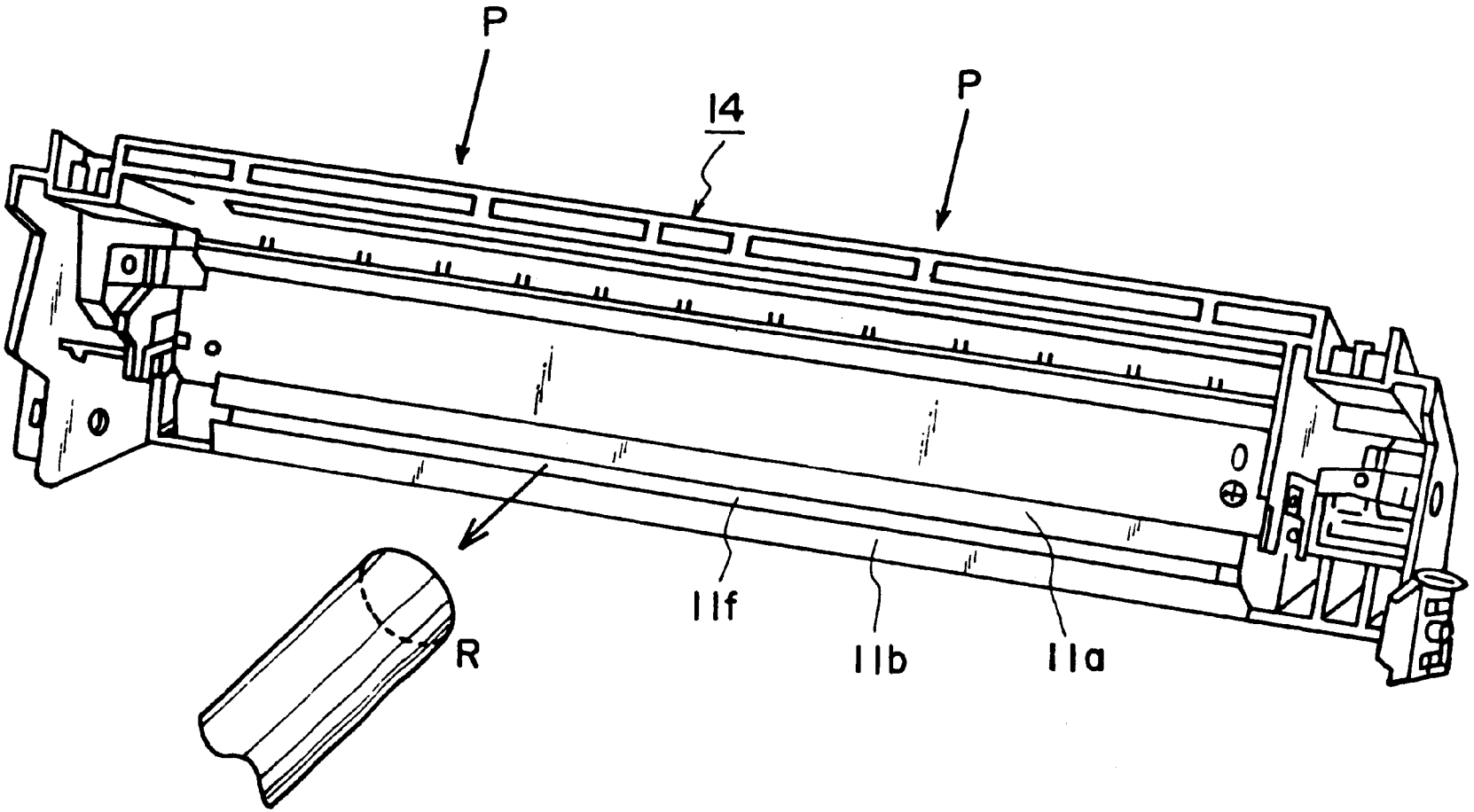
FIG. 47 is a perspective view of a cleaning unit and a vacuuming nozzle, for showing the method for overhauling the cleaning unit.

Next, the cleaning unit is overhauled. As described with reference to FIG. 8(A), one end of the photosensitive drum 7 has the helical gear 7*c*, which is firmly attached to the photosensitive drum 7 by crimping, using adhesive, or the like methods, and the other end has the gear flange 7*d*, which also is firmly fixed to the photosensitive drum 7. The boss 7*d*1 of the gear flange 7*d* attached to one end of the photosensitive drum 7 is fitted in the bearing portion 14*a* of the cleaning means holding frame 14. Then, the metallic shaft 21 (which is an iron shaft in this embodiment) is inserted into the hole of the helical resin gear 7*c* attached to the other end of the photosensitive drum 7, and is fixed to the cleaning means holding frame 14. As a result, the photosensitive drum 7 is rotationally attached to the cleaning means holding frame 14. The shaft 21 is a single piece component, and the shaft portion 21*a* and collar portion 21*b* of the shaft 21 are integral parts of the shaft 21. The shaft 21 is fixed to the cleaning means holding frame 14 by screwing the collar portion 21*b* to the cleaning means holding frame 14 with the use of the small screws 21*c*. Thus, in order to disassemble the cleaning unit, first, the small screws 21*c* are removed from the cleaning means holding frame 14 with a screwdriver or the like, and the shaft 21 is pulled out of the hole of the helical gear 7*c*. Then, the boss 7*d*1 of the gear flange 7*d* is pulled out of the bearing portion 14*a* of the cleaning means holding frame 14. Then, the photosensitive drum 7 can be removed from the cleaning means holding frame 14. Next, referring to FIG. 47, after the removal of the photosensitive drum 7 from the cleaning means holding frame 14, the cleaning means holding frame 14 is secured on a suitable table, and the suction nozzle R of a vacuuming apparatus (unshown) is placed in contact with the cleaning means holding frame 14 by hand so that the suction nozzle R aligns with the gap 11*f* between the cleaning blade 11*a* and the receptor sheet 11*b*. Then, the suction nozzle R is moved in the direction parallel to the gap 11*f*, while tapping the top surface of the cleaning means holding frame 14 at the portions pointed out by arrow marks, to vacuum away the removed residual toner in the cleaning means holding frame 14. After the vacuuming of the removed residual toner, the cleaning blade 11*a* and the receptor sheet 11*b* are removed, and the interiors of the cleaning means holding frame 14 and the removed residual toner bin 11*c* are cleaned by an air blast or the like. The removed photosensitive drum 7 and the cleaning blade 11*a* are cleaned of the toner adhering thereto, by an air blast or the like, and examined for whether or not they are reusable. Those which do not meet predetermined performance standards, are exchanged with new components. Incidentally, a given component of a process cartridge which is known, through the studies conducted during the development stage of the process cartridge and/or statistical studies of the component carried out during numerous remanufacturing processes, to have a high probability that it will need to be replaced with a new one, should be replaced with a new one without testing it. Replacing such a component with a new one without testing it sometimes improves remanufacturing efficiency. After a new cleaning blade 11*a*, or a recycled cleaning blade 11*a*, and a new receptor sheet 10*c*, are attached to the cleaning means holding frame 14, a new photosensitive drum, or a recycled photosensitive drum 7, is rotationally attached to the cleaning means holding frame 14 following in reverse order the process followed to remove the photosensitive drum 7 from the cleaning means holding frame 14.

(Process for Reconnecting Units)

Next, the various units are reconnected following in reverse order the process for separating the units. More specifically, referring to FIG. 38, the toner/developing means holding unit C is connected to the cleaning means holding frame 14 so that the connective projections 13*m* projecting from the first and second supporting members 77 and 78 of the toner/developing means holding unit C are fitted into the connective recesses 14*g* on the cleaning means holding frame 14 side. Then, the connecting members 38 are attached so that the springs 38*e* are put through the through holes 14*k*; the perpendicular portions 38*c* are fitted in the holes 14*i*; and the main structures 38*a* are fitted into the anchoring portions 14*h* of the cleaning means holding frame 14. Then, the main structures 38*a* are screwed to the cleaning means holding frame 14 to keep the toner/developing means holding unit C and cleaning means holding frame 14 securely connected. This concludes the assembly of the process cartridge B.

The above described processes are the essential processes for remanufacturing a process cartridge. They are parts of only one example of a process cartridge remanufacturing method in accordance with the present invention. The order in which these processes are carried out, and a method for remanufacturing a process cartridge do not need to be limited to those described above. Thus, the preceding description of the present invention will be supplemented below so that a process cartridge remanufacturing method in accordance with the present invention will be accurately understood.

First, (Process for Overhauling Cleaning Unit) was described before (Process for Reattaching First and Second Supporting Members). This does not mean that (Process for Reattaching First and Second Supporting Members) is always carried out after (Process for Overhauling Cleaning Unit). Since the toner/developing means holding unit C and cleaning means holding frame 14 are separated from each other through (Process for Separating Units), they may be independently overhauled. In other words, they may be overhauled at the same time, or in parallel. Obviously, one of them may be overhauled after the other is overhauled.

Secondly, (Process for Filling Toner) was described as a process in which toner is filled through the hole 13*a* as shown in FIG. 43, and therefore, it was described as a process carried out between (Process for Pasting Seal Under Development Blade) and (Process for Reattaching Development Blade). However, a portion through which the toner holding frame 12 is refilled with toner does not need to be limited to the opening 13*a*. For example, toner may be refilled through an unshown original toner filling hole of the toner holding frame 12. The original toner filling hole is a hole of the toner holding frame 12, which is provided for filling the toner holding frame 12 with toner after the cover film 12 is pasted to the toner holding frame 12, along the long edges of the opening 12*e* when assembling a process cartridge using new components. Of course, it is possible to make a hole through the toner holding frame 12, at a position corresponding to the toner storing bin 10*a*, with the use of a drill or the like, fill toner through this hole, and close the hole with a seal or the like. If the opening 12*e* is left exposed when toner is filled through the unshown original toner filling hole, or the hole made with a drill or the like, toner will leak through the opening 12*e*. Therefore, toner should be filled after (Process for Reattaching First and Second Supporting Members), because such an arrangement improves assembly efficiency.

Thirdly, the development blade and development sleeve, which have been removed from the toner/developing means holding unit C, and the photosensitive drum and the cleaning blade, which have been removed from the cleaning means holding frame, are not always reattached to the very toner/developing means holding unit C and the cleaning means holding frame, respectively, from which they have been removed. That is, when a process cartridge is remanufactured through a so-called production line, the development blades, for example, having been removed from the toner/developing means holding unit C, are stored in a group of a certain number in a tote box or the like, and delivered to the reattachment line after being cleaned by an air blast. Therefore, there is no guarantee that each development blade is attached to the very toner/developing means holding unit C from which it was removed. However, as long as a toner/developing means holding unit C to which a given development blade is attached is the same in specifications as the toner/developing means holding unit C from which the development blade was removed, it is not mandatory that the development blade be attached to the very toner/developing means holding unit C from which it was removed; admittedly there are some dimensional discrepancies resulting from manufacturing tolerances. This is also true of the development sleeve, the photosensitive drum, and the cleaning blade. Further, a toner/developing means holding unit or a cleaning means holding frame is not always united with the cleaning means holding frame or the toner/developing means holding unit, respectively, from which it was separated, and for the same reason as that given above regarding the development blade, it is not mandatory that a toner/developing means holding unit or a cleaning means holding frame be united with the very cleaning means holding frame or toner/developing means holding unit, respectively, from which it was separated.

The embodiment described above includes a process cartridge remanufacturing method in which process cartridges are recovered and disassembled after their service lives expire; the components obtained through the disassembly of the process cartridges are grouped by component type; some of the components are replaced with new components (without being recycled); and the thus obtained components are reassembled into process cartridges following the above described processes, and a process cartridge remanufacturing method in which a process cartridge is remanufactured uses the same components as those in the very process cartridge, with a few exceptions which must be replaced with new components, or recyclable components from other process cartridges.

Further, it is obvious that each of the above described processes may be automated using robots as appropriate. Not only is the present invention applicable to the above described process cartridge B for forming a monochromatic image, but also to a process cartridge which comprises a plurality of developing means 10, and forms a multicolor image (for example, a dichromatic image, a trichromatic image, a full-color image, and the like). Further, the present invention is compatible with various well-known developing methods, for example, the two component magnetic brush based developing method, the cascade developing method, the touch-down developing method, and the cloud developing method. Further, not only is the present invention compatible with the so-called contact charging method and structure in the above described first embodiment, but also with various other charging methods, for example, one of the conventionally used charging methods and structures, in which a piece of tungsten wire is surrounded with a shield formed of metallic material such as aluminum on three sides, and high voltage is applied to the tungsten wire to generate positive or negative ions, which are transferred onto the peripheral surface of a photosensitive drum to uniformly charge the peripheral surface of the photosensitive drum. The charging means may be in the form of a blade (charge blade), a pad, a block, a rod, or a wire, in addition to the above described roller. The method for cleaning the toner remaining on the photosensitive drum 7 may employ a cleaning means in the form of a blade, a fur brush, a magnetic brush, or the like. The above described process cartridge B may be a cartridge in which an image bearing member and a developing means are integrally disposed, and which is removably mountable in the main assembly of an image forming apparatus; a cartridge in which a charging means, a cleaning means or a developing means, and an electrophotographic photosensitive member, are integrally disposed, and which is removably mountable in the main assembly of an image forming apparatus; or a cartridge in which at least a developing means and an electrostatic photosensitive member are integrally disposed, and which is removably mountable in the main assembly of an image forming apparatus. Further, in the preceding embodiments of the present invention, a laser beam printer was referred to as an image forming apparatus. However, the application of the present invention does not need to be limited to a laser beam printer. It is obvious that the present invention is also applicable to various other image forming apparatuses, for example, an LED printer, an electrophotographic copying machine, a facsimile machine, a word processor, and the like.

As described above, the present invention realizes a simple method for remanufacturing a process cartridge.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for a process cartridge detachably mountable to a main assembly of an electrophotographic image forming apparatus, the process cartridge including a first frame for supporting an electrophotographic photosensitive drum, a second frame supporting a developing roller for developing an electrostatic latent image formed on the electrophotographic photosensitive drum and a developer accommodating portion for accommodating a developer to be used for development of the electrostatic latent image by the developing roller, the first frame and the second frame being rotatably coupled with each other, said method comprising:

(a) a frame separating step of separating the first frame and the second frame from each other;

(b) a developing blade dismounting step of dismounting, from the second frame, a developing blade mounted to the second frame to regulate an amount of the developer deposited on the developing roller;

(c) a sealing material mounting step of mounting an elastic sealing material in a gap between the second frame and the developing blade;

(d) a developer filling step of filling the developer into the developer accommodating portion through a developer supply opening for supplying, to the developing roller, the developer accommodated in the developer accommodating portion;

(e) a developing blade mounting step of mounting the developing blade to the second frame; and (f) a frame coupling step of coupling the first frame and the second frame.

2. A remanufacturing method for a process cartridge detachably mountable to a main assembly of an electrophotographic image forming apparatus, the process cartridge including a first frame for supporting an electrophotographic photosensitive drum, a second frame supporting a developing roller for developing an electrostatic latent image formed on the electrophotographic photosensitive drum and a developer accommodating portion for accommodating a developer to be used for development of the electrostatic latent image by the developing roller, the first frame and the second frame being rotatably coupled with each other, said method comprising:

(a) a frame separating step of separating the first frame and the second frame from each other;

(b) a developing blade dismounting step of dismounting, from the second frame, a developing blade mounted to the second frame to regulate an amount of the developer deposited on the developing roller;

(c) a sealing material mounting step of mounting a sealing material between the second frame and the developing blade;

(d) a developing blade mounting step of mounting the developing blade to the second frame;

(e) a developer filling step of filling the developer into the developer accommodating portion through a developer filling port provided in the developer accommodating portion; and (f) a frame coupling step of coupling the first frame and the second frame.

3. A method according to claim 1 or 2, wherein the sealing material is mounted to the developing blade or to the second frame.

4. A method according to claim 1 or 2, wherein the developing blade to be mounted to the second frame in said developing blade mounting step is the developing blade removed from the second frame of the process cartridge, or a developing blade removed from a second frame of another process cartridge.

5. A method according to claim 1 or 2, further comprising a developing roller dismounting step of dismounting the developing roller from the second frame prior to said developing blade dismounting step, and a developing roller mounting step of mounting a developing roller to the second frame prior to said frame coupling step and after said developing blade mounting step.

6. A method according to claim 5, wherein the developing roller to be mounted to the second frame in said developing roller mounting step is the developing roller removed from the second frame of the process cartridge, or a developing roller removed from a second frame of another process cartridge.

7. A method according to claim 5, wherein said developing roller dismounting step includes a supporting member dismounting step of dismounting, from the second frame, a first supporting member mounted to one longitudinal end portion of the developing roller and a second supporting member mounted to the other longitudinal end portion, and said developing roller mounting step includes a supporting member mounting step of mounting the first supporting member to the one longitudinal end portion and mounting the second supporting member to the other longitudinal end portion.

8. A method according to claim 7, wherein the first supporting member and the second supporting member to be mounted to the second frame in said supporting member mounting step are the first supporting member and the second supporting member removed from the second frame of the process cartridge, or first and second supporting members removed from a second frame of another process cartridge.

9. A method according to claim 1 or 2, wherein the first frame and the second frame coupled in said frame coupling step are those separated in said frame separating step, or are those randomly selected from first frames and second frames provided by separating them in a plurality of process cartridges.

10. A method according to claim 1 or 2, the process cartridge further comprising a cleaning blade for removing the developer remaining on the electrophotographic photosensitive drum and said method further comprising an electrophotographic photosensitive drum dismounting step of dismounting the cleaning blade and dismounting the electrophotographic photosensitive drum, from the first frame, prior to said frame coupling step, and a developer removing step of removing from the first frame the developer removed from the electrophotographic photosensitive drum removed by the cleaning blade.

11. A method according to claim 10, further comprising a developing roller dismounting step of dismounting the developing roller from the second frame, wherein the dismounted electrophotographic photosensitive drum is reused or is replaced with a new electrophotographic photosensitive drum, or the dismounted developing roller is reused or replaced with a new developing roller, or the dismounted developing blade is reused or replaced with a new developing blade, or the dismounted cleaning blade is reused or is replaced with a new cleaning blade.

12. A method according to claim 11, wherein the electrophotographic photosensitive drum is reused and is the one which has been removed from said first frame of the process cartridge or is an electrophotographic photosensitive drum dismounted from a first frame of another process cartridge.

13. A method according to claim 11, wherein the cleaning blade in the process cartridge after said coupling step is the one removed from said first frame of the process cartridge or is a cleaning blade dismounted from a first frame of another process cartridge.

14. A remanufacturing method for a process cartridge detachably mountable to a main assembly of an electrophotographic image forming apparatus, the process cartridge including an electrophotographic photosensitive drum, a first frame for supporting the electrophotographic photosensitive drum and a cleaning blade for removing a developer remaining on the electrophotographic photosensitive drum, and a second frame supporting a developing roller for developing an electrostatic latent image formed on the electrophotographic photosensitive drum and having a developer accommodating portion accommodating a developer to be used for development of the electrostatic latent image by the developing roller, comprising:

(a) a frame separating step of separating the first frame and the second frame from each other;

(b) a drum exchanging step of exchanging the electrophotographic photosensitive drum mounted to the first frame with a new electrophotographic photosensitive drum;

(c) a developing roller dismounting step of dismounting the developing roller mounted to the second frame;

(d) a developing blade dismounting step of dismounting, from the second frame, a developing blade mounted to the second frame to regulate an amount of the developer deposited on the developing roller;

(e) a sealing material mounting step of mounting a sealing material between the second frame and the developing blade;

(f) a developer filling step of filling the developer into the developer accommodating portion through a developer supply opening for supplying, to the developing roller, the developer accommodated in the developer accommodating portion;

(g) a developing blade mounting step of mounting the developing blade to the second frame;

(h) a developing roller mounting step of mounting a developing roller to the second frame; and (i) a frame coupling step of coupling the first and second frames.

15. A method according to claim 14, wherein the sealing material is mounted to the developing blade or to the second frame.

16. A method according to claim 14 or 15, wherein the developing blade to be mounted to the second frame in said developing blade mounting step is the developing blade removed from the second frame of the process cartridge, or a developing blade removed from a second frame of another process cartridge.

17. A method according to claim 14 or 15, wherein the developing roller to be mounted to the second frame in said developing roller mounting step is the developing roller removed from the second frame of the process cartridge, or a developing roller removed from a second frame of another process cartridge.

18. A method according to claim 14 or 15, wherein said developing roller dismounting step includes a supporting member dismounting step of dismounting, from the second frame, a first supporting member mounted to one longitudinal end portion of the developing roller and a second supporting member mounted to the other longitudinal end portion, and said developing roller mounting step includes a supporting member mounting step of mounting the first supporting member to the one longitudinal end portion and mounting the second supporting member to the other longitudinal end portion.

19. A method according to claim 18, wherein the first supporting member and the second supporting member to be mounted to the second frame in said supporting member mounting step are the first supporting member and the second supporting member removed from the second frame of the process cartridge, or first and second supporting members removed from a second frame of another process cartridge.

20. A method according to claim 14 or 15, wherein the first frame and the second frame coupled in said frame coupling step are those separated in said frame separating step, or are those randomly selected from first frames and second frames provided by separating them in a plurality of process cartridges.

21. A method according to claim 14 or 15, further comprising an electrophotographic photosensitive drum dismounting step of dismounting, before said drum exchanging step, the cleaning blade and the electrophotographic photosensitive drum from the first frame and a developer removing step of removing from the first frame the developer removed from the electrophotographic photosensitive drum removed by the cleaning blade.

22. A method according to claim 14 or 15, further comprising a cleaning blade dismounting step of dismounting the cleaning blade, wherein the dismounted developing roller is reused or replaced with a new developing roller, or the dismounted developing blade is reused or replaced with a new developing blade, or the dismounted cleaning blade is reused or is replaced with a new cleaning blade.

23. A method according to claim 22, wherein the cleaning blade in the process cartridge after said frame coupling step is the one removed from the first frame of the process cartridge or is a cleaning blade dismounted from a first frame of another process cartridge.

* * * * *

UNITED STATES PATENT AND TRADEMARK OFFICE

CERTIFICATE OF CORRECTION

PATENT NO. : 6,615,008 B2
DATED : September 2, 2003
INVENTOR(S) : Akira Higeta et al.

It is certified that error appears in the above-identified patent and that said Letters Patent is hereby corrected as shown below:

Title page,
Item [56], References Cited, FOREIGN PATENT DOCUMENTS, insert
-- JP 8-305258 11/1996 --, and -- JP 7-181857 7/1995 --.
Item [57], ABSTRACT,
Line 15, "the" 2nd occurrence, should be deleted.

Column 13,
Line 44, "(Vpp = 1800V)" should read -- (Vpp ≈ 1800V) --.
Line 45, "(Vdc1'-670V)," should read -- (Vdc1 ≈ -670V), --.

Column 14,
Line 41, "(Vpp = 1600" should read -- (Vpp x 1600 --.
Line 42, "(Vdc2 = -500" should read -- Vdc2 ≈ -500 --.

Column 33,
Line 47, "81aand" should read -- 81a and --.

Column 36,
Line 43, "dismount" should read -- dismounts --.

Column 39,
Line 32, ""process" should read -- Process --.

Signed and Sealed this

Thirteenth Day of April, 2004

JON W. DUDAS
*Acting Director of the United States Patent and Trademark Office*